US006873308B2

(12) United States Patent
Sagano et al.

(10) Patent No.: US 6,873,308 B2
(45) Date of Patent: Mar. 29, 2005

(54) IMAGE DISPLAY APPARATUS

(75) Inventors: Osamu Sagano, Tokyo (JP); Naoto Abe, Tokyo (JP); Kohei Inamura, Kanagawa (JP); Hiroshi Saito, Kanagawa (JP); Takeshi Ikeda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 244 days.

(21) Appl. No.: 10/188,892

(22) Filed: Jul. 5, 2002

(65) Prior Publication Data

US 2003/0030654 A1 Feb. 13, 2003

(30) Foreign Application Priority Data

| | | |
|---|---|---|
| Jul. 9, 2001 | (JP) | 2001-208249 |
| Jul. 9, 2001 | (JP) | 2001-208359 |
| Nov. 19, 2001 | (JP) | 2001-353851 |
| Nov. 19, 2001 | (JP) | 2001-353889 |
| Nov. 27, 2001 | (JP) | 2001-361478 |
| Nov. 29, 2001 | (JP) | 2001-364561 |
| Dec. 4, 2001 | (JP) | 2001-370466 |
| Dec. 7, 2001 | (JP) | 2001-374624 |

(51) Int. Cl.[7] ..... G09G 3/20
(52) U.S. Cl. ..... 345/75.2; 345/691
(58) Field of Search ..... 345/74.1, 75.1, 345/75.2, 690, 691

(56) References Cited

U.S. PATENT DOCUMENTS

| | | | | |
|---|---|---|---|---|
| 5,734,361 | A | 3/1998 | Suzuki et al. | 345/74 |
| 6,404,135 | B1 * | 6/2002 | Shino | 315/169.1 |

FOREIGN PATENT DOCUMENTS

| | | | | |
|---|---|---|---|---|
| JP | 1-91515 | | 4/1989 | |
| JP | 7-273650 | | 10/1995 | |
| JP | 8-248920 | | 9/1996 | |
| JP | 2001-013907 | * | 1/2001 | G09G/3/20 |

* cited by examiner

*Primary Examiner*—Alexander Eisen
(74) *Attorney, Agent, or Firm*—Fitzpatrick, Cella, Harper & Scinto

(57) ABSTRACT

The present invention is to provide an image display apparatus capable of properly correcting or adjusting, with small-scale hardware, variations in drive conditions due to electric resistance of matrix wiring on a display panel. The image display apparatus includes an adjusted image data calculation unit 14 for calculating adjusted image data as image data that has been compensated for the influence of voltage drop caused by resistance of at least the row wiring and a scan unit. The image display apparatus also includes an amplitude adjustment unit having a function for adjusting the amplitude of adjusted image data Dout, and a modulator 8 the takes in the adjusted image data with the amplitude adjusted and outputs a modulation signal to the column wiring.

31 Claims, 57 Drawing Sheets

EMISSION CURRENT PULSE WHEN NO VOLTAGE DROP TAKES PLACE

ACTUAL EMISSION CURRENT PULSE

ADJUSTED EMISSION CURRENT PULSE

※ IE : EMISSION CURRENT WHEN NO VOLTAGE DROP TAKES PLACE

EMISSION CURRENT PULSE WHEN NO VOLTAGE DROP TAKES PLACE

ACTUAL EMISSION CURRENT PULSE

ADJUSTED EMISSION CURRENT PULSE $$CA=((Xn+1-x)*CData[k][n]+(x-Xn)*CData[k][n+1])/(Xn+1-Xn)$$

$$CB=((Xn+1-x)*CData[k+1][n]+(x-Xn)*CData[k+1][n+1])/(Xn+1-Xn)$$

$$CD=CA*(Dk+1-data)+CB*(data-Dk)/(Dk+1-Dk)$$

○ : GAIN IS NOT AVERAGED (FORMULA 20)
● : GAIN IS AVERAGED (FORMULA 21)

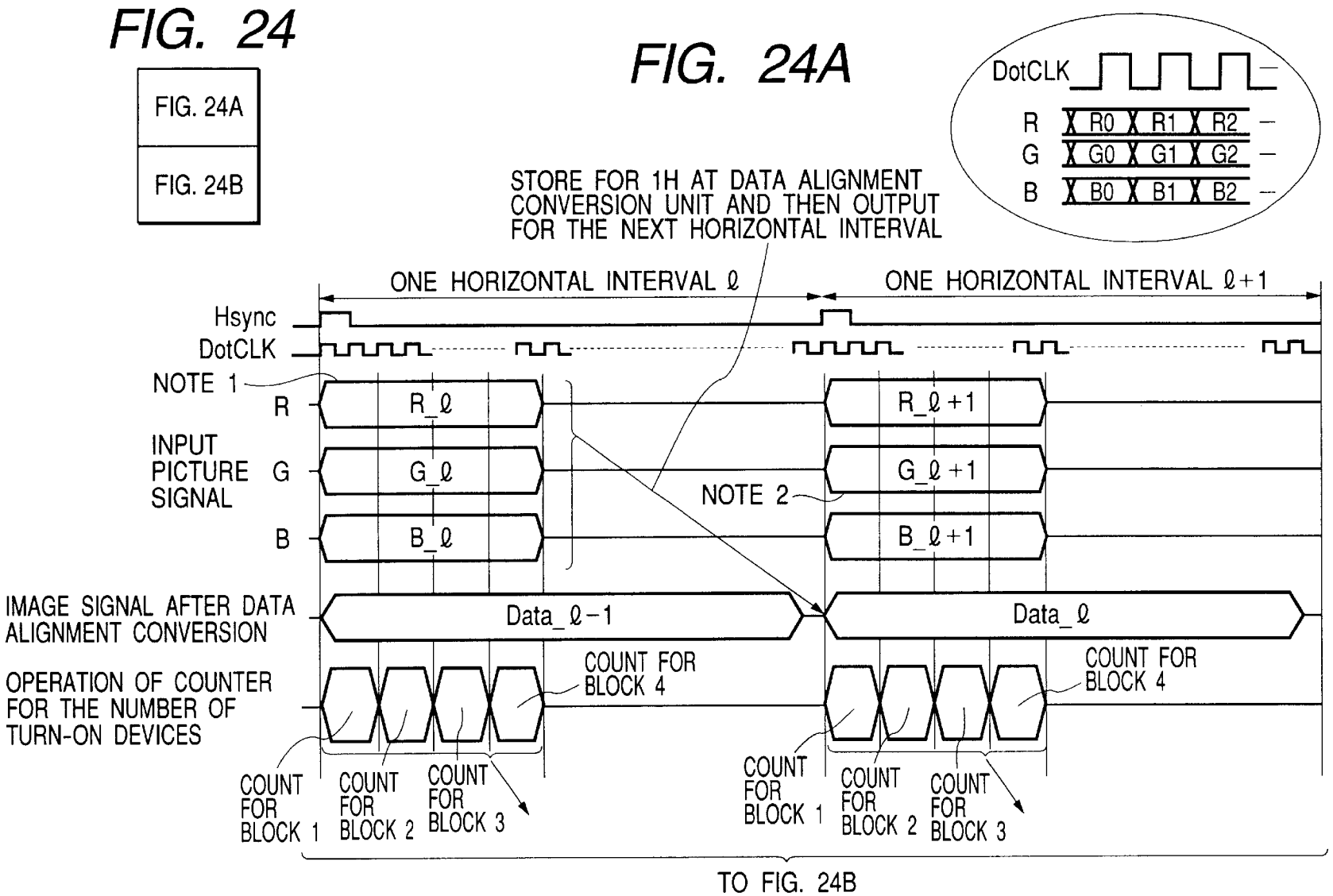
FIG. 24
FIG. 24A
FIG. 24B
DotCLK
R
G
B
R0
R1
R2
G0
G1
G2
B0
B1
B2
STORE FOR 1H AT DATA ALIGNMENT CONVERSION UNIT AND THEN OUTPUT FOR THE NEXT HORIZONTAL INTERVAL
ONE HORIZONTAL INTERVAL ℓ
ONE HORIZONTAL INTERVAL ℓ+1
Hsync
DotCLK
NOTE 1
INPUT PICTURE SIGNAL
R_ℓ
G_ℓ
B_ℓ
R_ℓ+1
G_ℓ+1
B_ℓ+1
NOTE 2
IMAGE SIGNAL AFTER DATA ALIGNMENT CONVERSION
Data_ℓ−1
Data_ℓ
OPERATION OF COUNTER FOR THE NUMBER OF TURN-ON DEVICES
COUNT FOR BLOCK 1
COUNT FOR BLOCK 2
COUNT FOR BLOCK 3
COUNT FOR BLOCK 4
TO FIG. 24B FIG. 30A
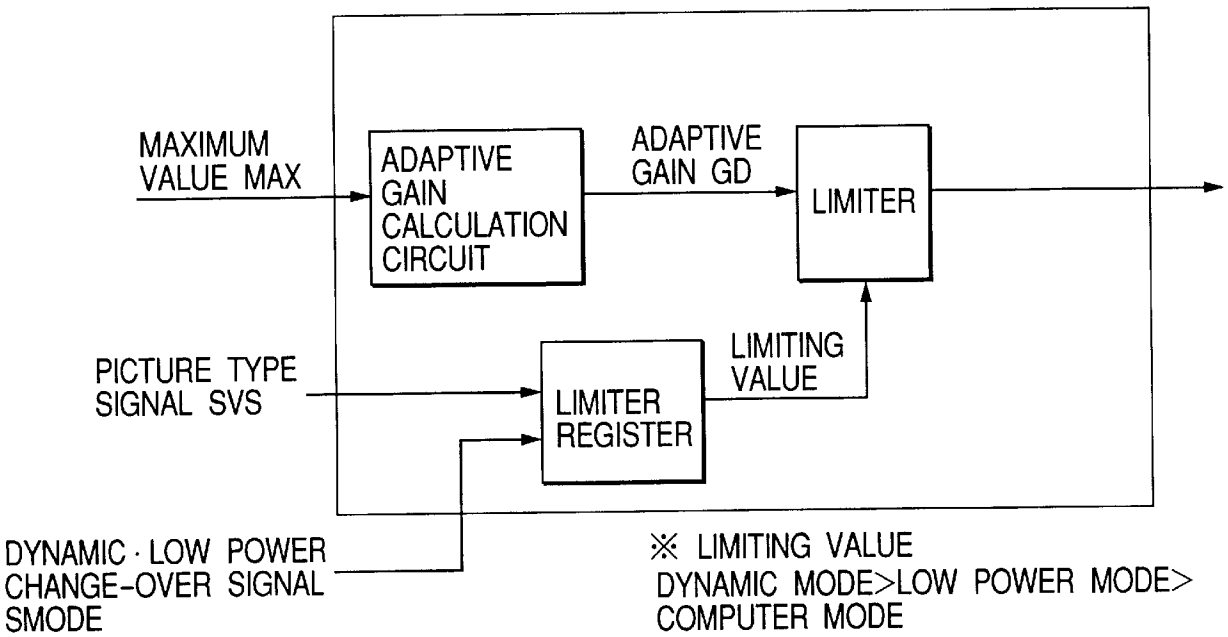
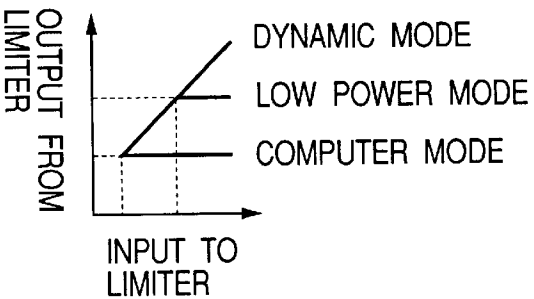
FIG. 30B

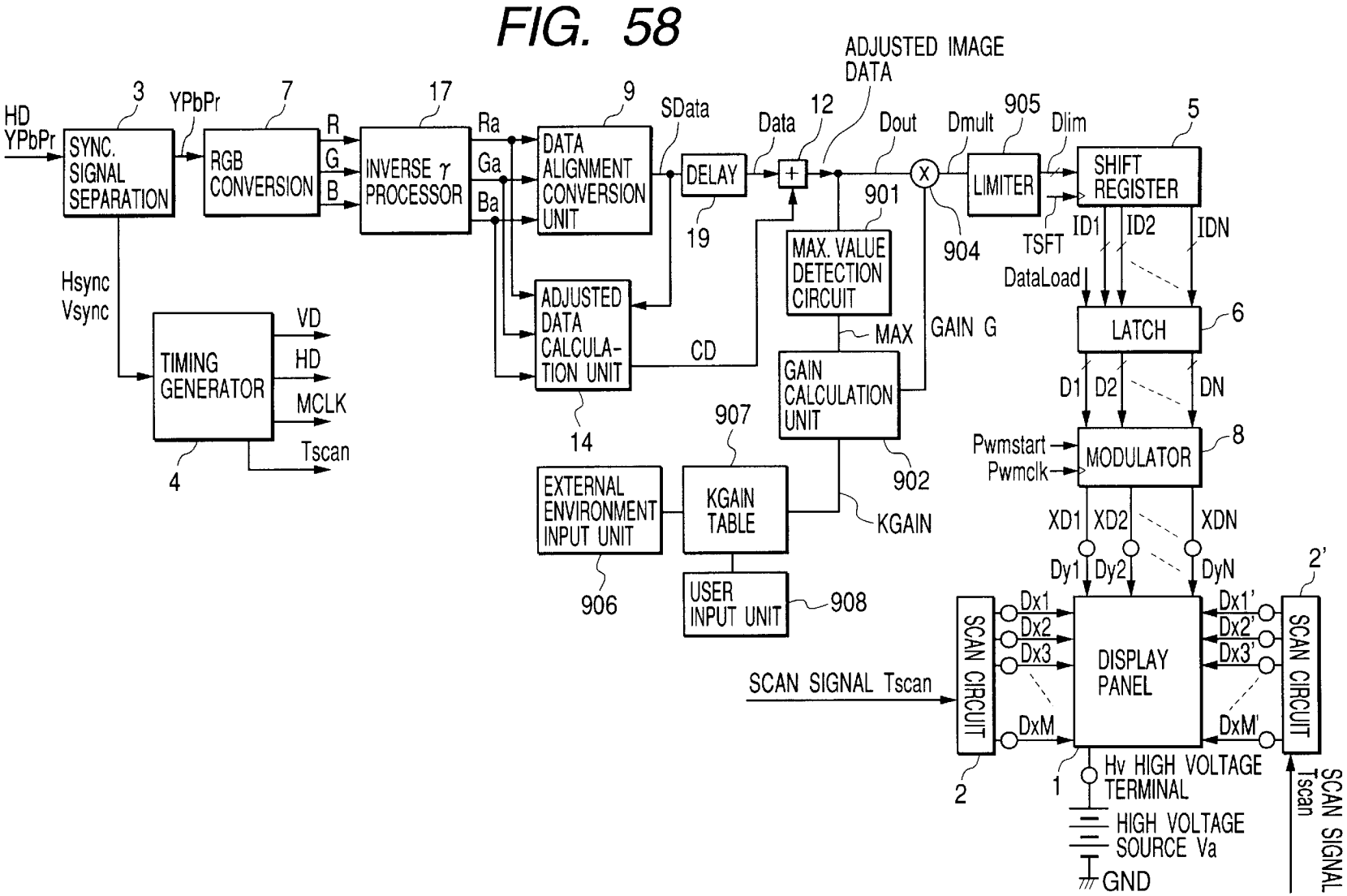
FIG. 58
HD
YPbPr
SYNC. SIGNAL SEPARATION
3
YPbPr
RGB CONVERSION
7
R
G
B
INVERSE γ PROCESSOR
17
Ra
Ga
Ba
DATA ALIGNMENT CONVERSION UNIT
9
SData
DELAY
19
Data
12
ADJUSTED DATA
Dout
Dmult
LIMITER
905
Dlim
SHIFT REGISTER
5
IDN
ID2
ID1
TSFT
DataLoad
LATCH
6
DN
D2
D1
MODULATOR
8
Pwmstart
Pwmclk
XDN
XD2
XD1
DyN
Dy2
Dy1
DISPLAY PANEL
1
Dx1
Dx2
Dx3
DxM
Dx1'
Dx2'
Dx3'
DxM'
SCAN CIRCUIT
2
SCAN CIRCUIT
2'
SCAN SIGNAL Tscan
Hv HIGH VOLTAGE TERMINAL
HIGH VOLTAGE SOURCE Va
GND
SCAN SIGNAL Tscan
TIMING GENERATOR
4
VD
HD
MCLK
Tscan
Hsync
Vsync
904
GAIN G
901
MAX. VALUE DETECTION CIRCUIT
MAX
GAIN CALCULATION UNIT
902
KGAIN
ADJUSTED DATA CALCULATION UNIT
14
CD
907
KGAIN TABLE
908
USER INPUT UNIT
EXTERNAL ENVIRONMENT INPUT UNIT
906

IMAGE DISPLAY APPARATUS

BACKGROUND OF THE INVENTION

1. Field of the Invention

The present invention relates to an image display apparatus provided with image forming devices arranged in a matrix. For example, the present invention is applied to a television receiver or a display apparatus for receiving television signals or display signals from a computer or the like to display images using a display panel that is provided with a plurality of surface conduction devices arranged in a matrix and a fluorescent screen receiving electron irradiation and emitting light. In particular, the present invention relates to image data adjustment means for correcting a drop in drive voltage due to electric resistance of the matrix wiring or the like on the display panel, and digital image data processing means having amplitude adjustment means for controlling the amplitude of the adjusted image data.

2. Related Background Art

Conventionally, as image display apparatuses of this type, Japanese Patent Application Laid-Open No. 8-248920 discloses an image display apparatus for calculating adjusted data using statistical operations and synthesizing an electron beam requiring value and a correction value to correct a reduction in luminance resulting from voltage drop due to wiring resistance such as resistance of electric connections to electron-emitting devices.

FIG. 63 is a block diagram of a schematic configuration of an image display apparatus according to the prior art.

The following will describe a configuration related to adjustment of image data.

First, luminance data corresponding to one line of digital image signals are added up at an adder 206, and correction factor data corresponding to the added value is read from a memory 207.

On the other hand, the digital image signals are serial-parallel converted at a shift register 204, held in a latch circuit 205 for a predetermined period of time, and inputted at predetermined timing into multipliers 208 provided for respective column wirings.

The multipliers 208 multiply the luminance data and the correction data read from the memory 207 together on a wiring basis, and transfers the data after adjusted to a modulation signal generator 20ninthe modulation signal generator 209 generates modulated signals corresponding to the data adjusted so that an image will be displayed on the display panel based on the modulated signals.

In this configuration, statistical operations are performed to determine the sum or average of digital image signals such as the addition processing performed by the adder 206 on the luminance data corresponding to one line of digital image signals so that the data will be adjusted based on the resultant value.

On the other hand, as typical signal processing means, Japanese Patent Application Laid-Open No. 01-091515 discloses a pulse width modulator having an overflow detection unit and a limiter, and Japanese Patent Application Laid-Open No. 07-273650 discloses an A/D conversion circuit having an overflow detection part and a gain limitation part.

The above-mentioned configurations, however, require large-scale hardware such as multipliers provided for respective column wirings, a memory for outputting adjusted data, an adder for supplying an address signal to the memory, and so on.

Further, the adjustment of image data may cause overflow, and hence disturbance in the display image.

The present invention has been made to solve the above conventional problems, and it is an object thereof to provide an image display apparatus that suitably compensates for the influence of voltage drop due to resistance of the matrix wiring on the display panel and internal resistance of scan means with a reduced hardware configuration so that an image will be displayed with excellent image quality.

SUMMARY OF THE INVENTION

In attaining the above object and according to the present invention, there is provided an image display apparatus including a display panel having plural rows of wiring and plural columns of wiring, and image forming devices connected with the rows and columns of wiring and arranged in a matrix, scan means for selectively scanning the rows of wiring one by one, and modulation means connected with the columns of wiring, the image display apparatus comprising:

adjusted image data calculation means for calculating such adjusted image data as to compensate image data for the influence of voltage drop caused by resistance of at least the rows of wiring; and amplitude adjustment means for adjusting the amplitude of the adjusted image data so that the amplitude will fall within an input range of the modulation means, wherein the modulation means takes in the adjusted image data with the amplitude adjusted and outputs modulated signals to the columns of wiring.

The amplitude adjustment means preferably includes a limiter for multiplying the adjusted data or the image data by gain and limiting the amplitude of the data so that the multiplication result will fall within the input range of the modulator.

The amplitude adjustment means preferably includes a maximum value detection unit for detecting the maximum value of the outputs of the adjusted image data calculation means, a gain calculation unit for calculating the gain so that the maximum value will fall within the input range of the modulation means, and filter means for limiting variations in gain on a frame basis.

Preferably, the amplitude adjustment means further includes a scene change judgment unit for detecting that the scene of a display image is changed, wherein when a scene change is judged, the filter means does not limit the variations in gain.

The amplitude adjustment means preferably includes a limitation unit for limiting the gain to or below a presettable upper limit value.

The maximum value detection unit preferably excludes adjusted image data for one to one-tenth of the total rows of wiring from the upper and lower ends of the display area so that the maximum value of the adjusted image data for the other rows will be detected.

Preferably, the scene change judgment unit divides the entire screen into areas to judge whether a scene change occurs in each area, and judges a scene change on the entire screen from the judgment result of each area.

The amplitude adjustment means preferably includes an intensity of external illumination input unit for detecting the intensity of illumination around the image display apparatus and outputting a signal according to the detection result so that gain will be adjusted according to the output signal from the intensity of external illumination input unit.

The amplitude adjustment means preferably includes at least two operation modes, which include a first mode for referring to the output of the adjusted image data calculation means on a frame basis to calculate adaptive gain of the adjusted image data calculated on a frame basis so that the output will correspond to the input range of the modulation means, and a second mode for outputting preset fixed gain that does not vary from frame to frame, wherein when the input picture signal is a television picture signal, the first mode is selected, while when it is a computer picture signal, the second mode is selected.

BRIEF DESCRIPTION OF THE DRAWINGS

FIGS. 30A and 30B are block diagrams of a gain calculation unit according to a sixth embodiment of the present invention.

FIG. 58 is a block diagram showing a schematic configuration of an image display apparatus according to a seventeenth embodiment of the present invention.

DETAILED DESCRIPTION OF THE PREFERRED EMBODIMENTS

Referring now to the accompanying drawings, embodiments of the present invention will be described in detail by taking as examples image display apparatuses using surface conduction electron-emitting devices (hereinafter called SCEs).

(First Embodiment)

(General Outline)

In a display apparatus using SCEs arranged in a simple matrix, current flowing into scan wiring and resistance of the scan wiring cause a voltage drop, and hence degradation of display images. To avoid this, the image display apparatus according to the embodiment of the present invention is provided with a processing circuit that properly compensates for the influence on the display images of voltage drop over the scan wiring. Further, in the embodiment, the processing circuit can be realized in a relatively small circuit configuration.

An adjustment circuit predictively calculates, according to input image data, the degradation of display images due to voltage drop to determine adjusted data for correcting the degradation so that the input image data will be adjusted.

The inventors have carefully studied the following type of image display apparatus as the image display apparatus in which such an adjustment circuit is incorporated.

The following will describe in due course an outward appearance of a display panel of the image display apparatus according to the embodiment of the present invention, electrical connections in the display panel, characteristics of a surface conduction electron-emitting device, a display panel driving method, a mechanism of voltage drop that occurs due to electric resistance of the scan wiring, and a method and apparatus that compensate for the influence of voltage drop.

(Outward Appearance of Image Display Apparatus)

Figure 1:
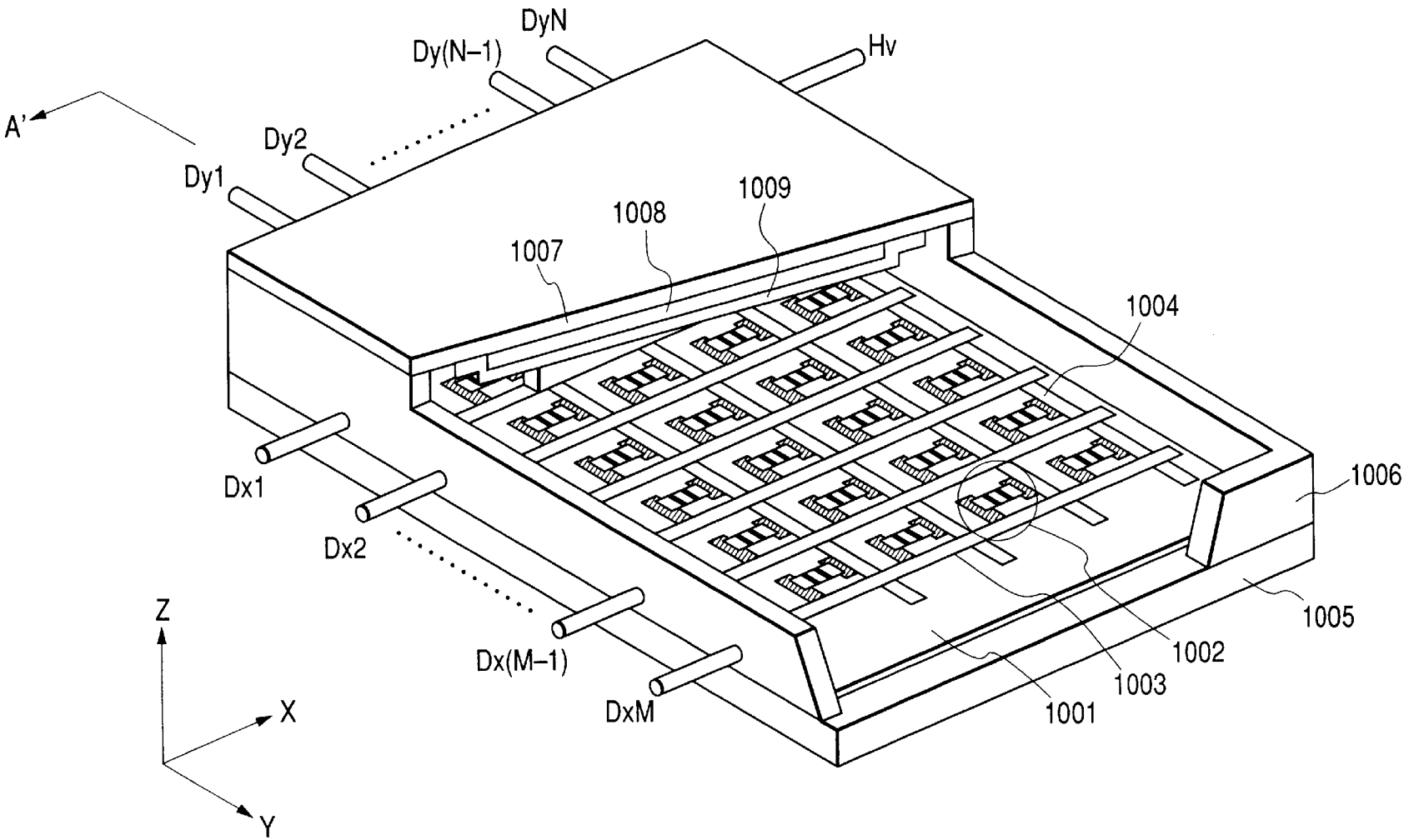
FIG. 1 is a perspective view showing an outward appearance of an image display apparatus according to embodiments of the present invention.

FIG. 1 is a perspective view of the display panel used in the image display apparatus according to the embodiment, in which part of the panel is cut away to show the inner layout. In the drawing, a rear plate 1005, side walls 1006, and a face plate 1007 form a hermetic housing for maintaining the inside of the display panel under vacuum.

Figure 2:
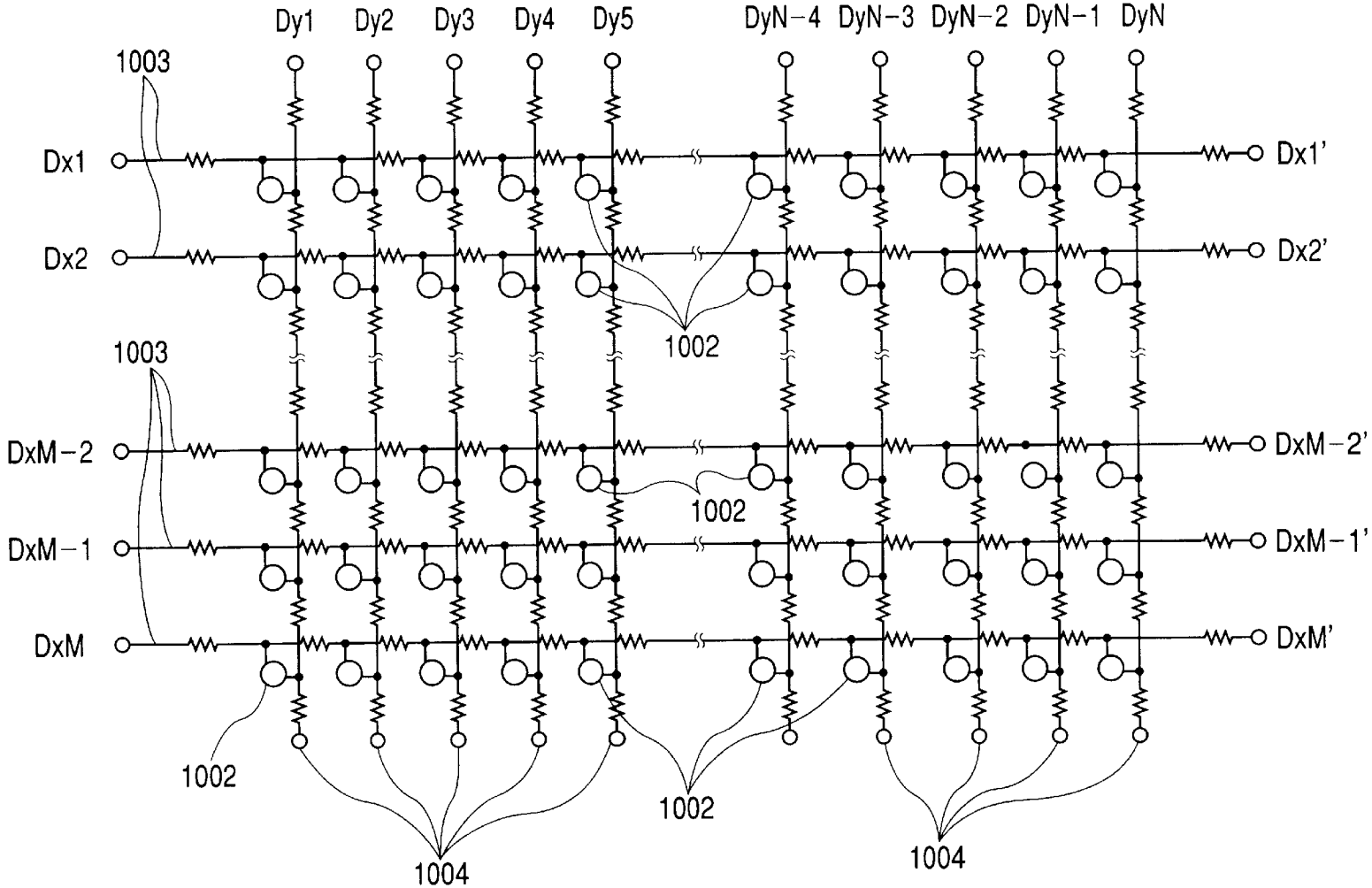
FIG. 2 is a diagram showing electrical connections on a display panel.

A substrate 1001 is fixed on the rear plate 1005, and N×M SCEs 1002 as image forming devices are formed on the substrate. Row wiring (scan wiring) 1003, column wiring (modulation wiring) 1004, and the SCEs are connected as shown in FIG. 2.

Phosphors 1008 for primary colors, that is, red, blue, and green, is formed on the undersurface of the face plate 1007 in correspondence with each pixel.

A metal back 1009 is formed on the undersurface of the phosphor film 1008.

A high voltage terminal Hv is electrically connected to the metal back 1009. A high voltage is applied to the high voltage terminal Hv to apply the high voltage across the rear plate 1005 and the face plate 1007.

(Characteristics of SCE)

The SCE has an (emission current Ie)-to-(device-applied voltage Vf) characteristic, and a (device current If)-to-(device drive-applied voltage Vf) characteristic. The emission current Ie is much smaller than the device current If, and since it is difficult to show both on the same scale, two graphs are plotted on different scales.

The SCE has three characteristics of emission current Ie as follows:

First, the emission current Ie sharply increases when a voltage equal to or higher than a given voltage (called a threshold voltage Vth) is applied to the device, while little emission current Ie is detected when a voltage lower than the threshold voltage Vth is applied to the device.

Second, since the emission current Ie varies depending on the voltage Vf applied to the device, the voltage Vf may be made variable so that the magnitude of emission current Ie can be controlled.

Third, since the SCE is fast and responsive, emission time of the emission current Ie can be controlled depending on the voltage Vf applied time.

If the first characteristic is utilized for the image display apparatus using the display panel shown in FIG. 1, images can be displayed while scanning the display screen line by line. In other words, a voltage equal to or higher than the threshold voltage Vth is applied to driven devices according to desired emission luminance, while a voltage lower than the threshold voltage Vth is applied to non-selected devices. Then the devices to be driven are switched from one to another to scan the display screen line by line, thus displaying images.

If the second characteristic is utilized, emission luminance of the phosphors can be controlled by the voltage Vf applied to the devices, thus displaying images.

If the third characteristic is utilized, emission time of the phosphors can be controlled according to the time during which the voltage Vf is applied to the devices, thus displaying images.

According to the present invention, the image display apparatus performs modulation using the third characteristic.

(Display Panel Driving Method)

Figure 4:
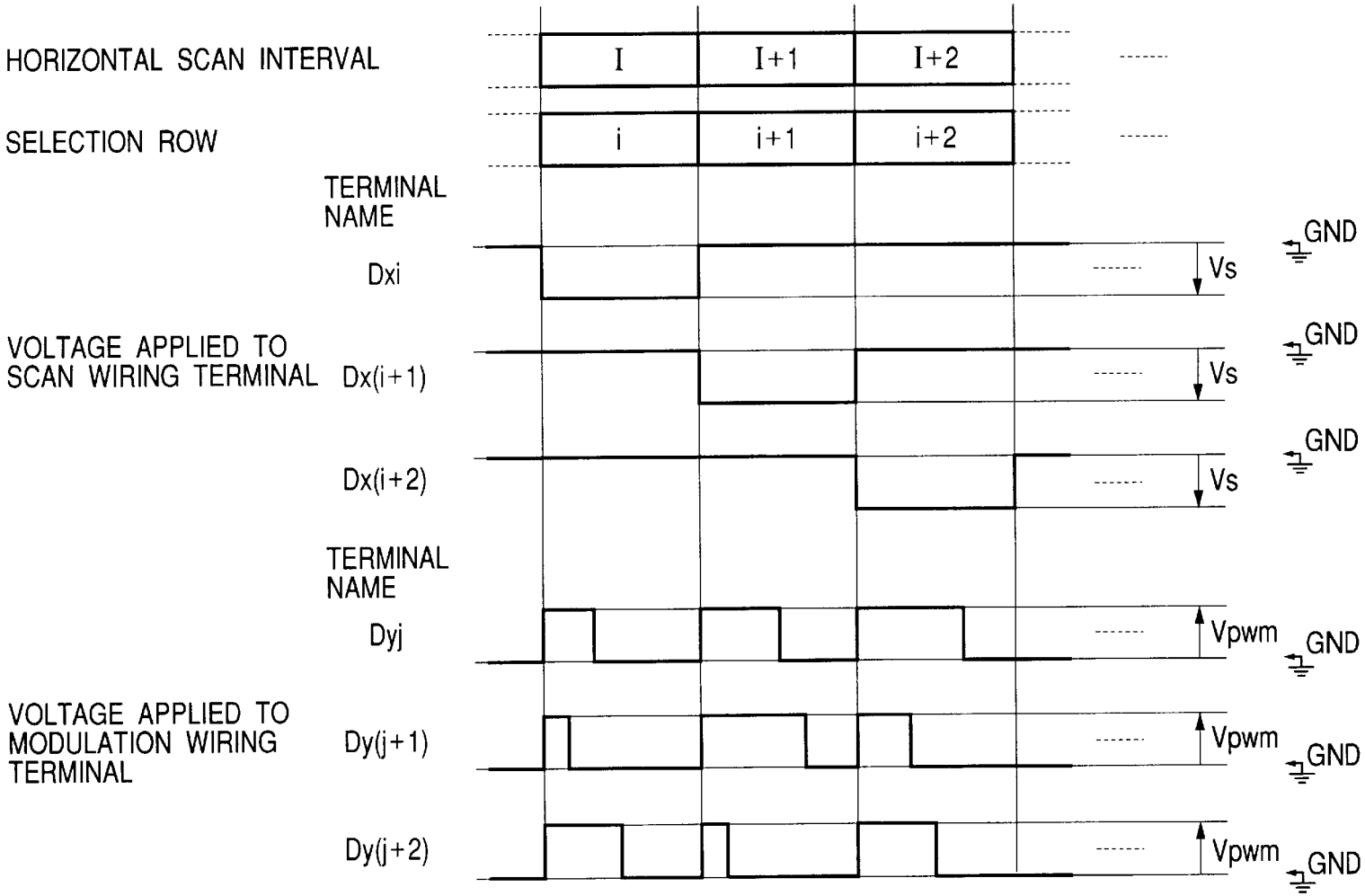
FIG. 4 is a diagram showing a driving method for the display panel.

FIG. 4 shows an example of voltage applied to voltage supplying terminals of the scan wiring and modulation wiring when the display panel of the present invention is driven.

Here, a horizontal scan interval I means an interval during which light is emitted from pixels in the i-th row.

To make the pixels in the i-th row emit light, the i-th row of the scan wiring is brought to a selected state, and a selection voltage Vs is applied to a corresponding voltage supplying terminal Dxi. On the other hand, the other voltage supplying terminals Dxk (where k=1, 2, . . . N, and k≠i) of the scan wiring are brought to a non-selected state, and a non-selection voltage Vns is applied thereto.

Figure 3:
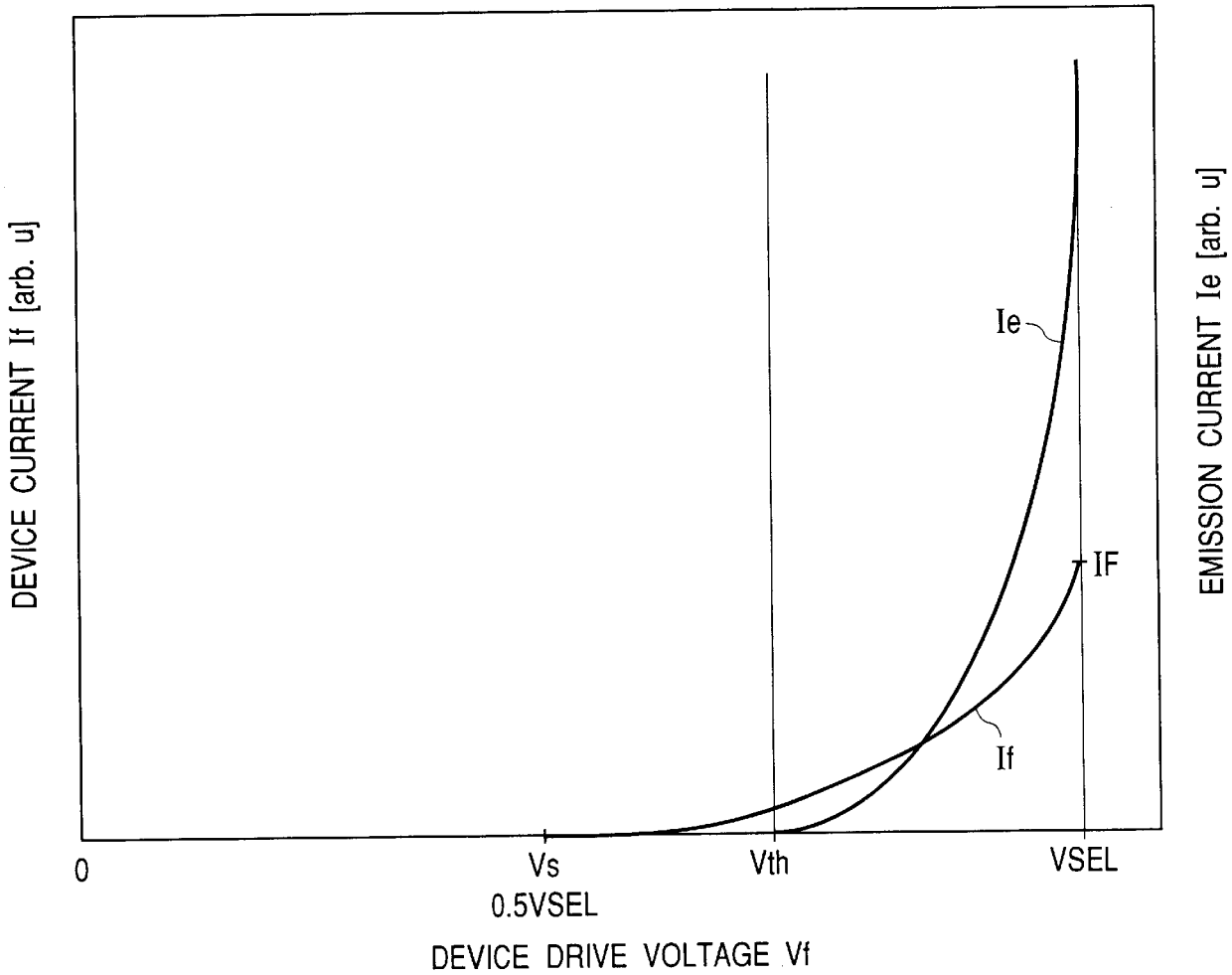
FIG. 3 is a graph showing characteristics of a surface conduction electron-emitting device.

In the embodiment, the selection voltage Vs is set to −0.5 VSEL corresponding to half the voltage VSEL shown in FIG. 3, while the non-selection voltage Vns is set to the GND potential.

A pulse width-modulated signal with voltage amplitude Vpwm is applied to voltage terminals of the modulation wiring. In the conventional apparatus, when no adjustment is made, the pulse width of the pulse width-modulated signal to be supplied to the j-th modulation wiring is decided according to the size of image data to be displayed on the pixel in the i-th row and j-th column, and all the columns of modulation wiring are supplied with pulse width-modulated signals according to the size of image data on each pixel.

In contrast, in the apparatus of the present invention, the pulse width of the pulse width-modulated signal to be supplied to the j-th modulation wiring is decided according to the size of image data on an image to be displayed on the pixel in the i-th row and j-th column and the amount of adjustment, in order to correct a reduction in luminance due to the influence of voltage drop to be described later, and all the columns of modulation wiring are supplied with the pulse width-modulated signals decided.

In the embodiment, the voltage Vpwm is set to +0.5 VSEL.

(Voltage Drop in Scan Wiring)

As discussed above, the basic problem that the image display apparatus of the present invention has is that, since a voltage drop in the scan wiring of the display panel causes potential rise on the scan wiring, the voltage applied to the SCEs drops to reduce emission current from the SCEs. The following will describe the mechanism of voltage drop.

The voltage drop varies depending on the design specifications and fabrication method of the SCEs, but device current for one SCE is about several hundred $\mu$A when the voltage VSEL is applied.

If only one pixel in a row of scan wiring selected during a horizontal scan interval is made to emit light and the other pixels in the row are not made to emit light, since device current flowing into the selected row of scan wiring from the modulation wiring is just a small amount of current for one pixel (that is, several hundred $\mu$A as mentioned above), less voltage drop will occur with less reduction in emission luminance.

On the other hand, if all the pixels in the selected row is made to emit light during the horizontal scan interval, since current for all the pixels in the row flows into the selected row of scan wiring from all the columns of modulation wiring, the total amount of current will become several hundred mA to a few A, which results in the occurrence of voltage drop on the scan wiring due to wiring resistance of the scan wiring.

The occurrence of voltage drop on the scan wiring causes a drop of voltage applied across both ends of each surface conduction electron-emitting device. This causes a drop of emission current emitted from the surface conduction electron-emitting device, and hence a reduction in emission luminance.

There is a further complicated problem that the amount of voltage drop also varies according to degrees of pulse width modulation even during one horizontal scan interval.

Suppose that pulse width-modulated signals to be supplied to respective columns are outputted at synchronous rise timing with the pulse width depending on the size of data inputted as shown in FIG. 4. In such a case, turn-on pixels, though depend on the input data, are generally high in number immediately after the leading edge of the pulse during one horizontal scan interval, and then the turn-on pixels are turned off in order from the pixel with the lowest luminance. Thus the number of turn-on pixels are gradually reduced with time during one horizontal scan interval.

The amount of voltage drop that takes place on the scan wiring also has a tendency to be high in number at the beginning of one horizontal scan interval and gradually decreases.

Since the pulse width-modulated signal varies its output at every cycle corresponding to one level of modulation, the voltage drop varies at every cycle corresponding to one level of modulation.

The above description was made about voltage drop in the scan wiring.

(Method of Calculating Voltage Drop)

A method of compensating for the influence of voltage drop will now be described in detail.

To determine the amount of adjustment for compensation for the influence of voltage drop, it is necessary to provide hardware for real-time prediction of the magnitude of voltage drop and its time variations.

However, since the display panel of the image display apparatus according to the present invention is typically provided with thousands of modulation wiring, it is very hard to calculate voltage drop at points of intersection of all the columns of modulation wiring and the rows of scan wiring, and manufacturing hardware for real-time calculation is impractical.

For this reason, positions in each row are broken into blocks, and further divided into blocks in the direction of the size of image data, so that the amount of voltage drop is calculated for each block.

The advantage of breaking the row into blocks is based on the following characteristics of voltage drop:

i) A voltage drop that occurs on the scan wiring at some point in one horizontal scan interval traces a very smooth curve that shows a continuous amount in space.

ii) The amount of voltage drop varies according to the size of image to be display, but it varies at every cycle corresponding to one level of pulse width modulation. It can be roughly said that the amount of voltage drop is large near the leading edge of the pulse, and becomes small with time or is maintained.

In other words, the driving method shown in FIG. 4 can never increase the amount of voltage drop in one horizontal scan interval.

Specifically, the amount of voltage drop in a degenerate model to be described below is calculated at plural time points to roughly predict how the voltage drop varies with time.

(Calculation of Voltage Drop in Degenerate Model)

Figure 5A:
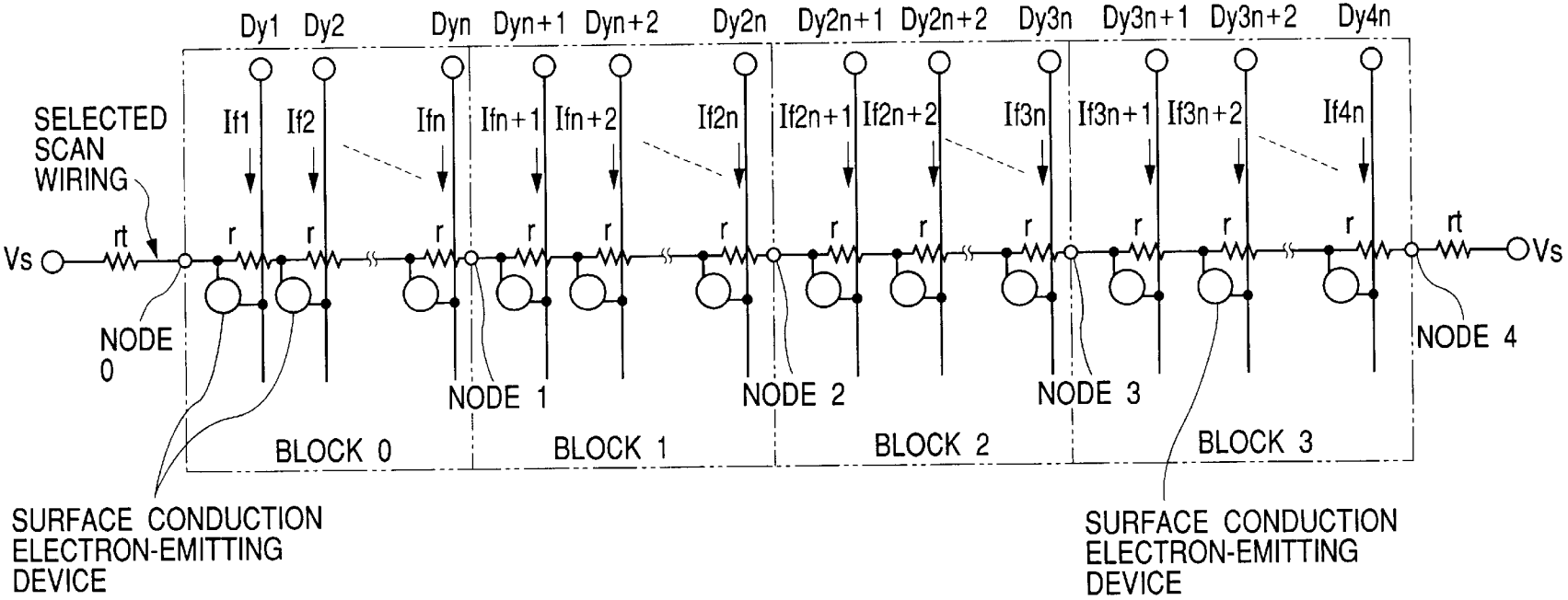
FIGS. 5A, 5B and 5C are diagrams for explaining a degenerate model.

FIG. 5A is a circuit diagram for explaining blocks and nodes when degenerated.

For the sake of simplification, only the selected scan wiring, associated columns of modulation wiring, and SCEs to be connected at the points of intersection are illustrated in FIG. 5A.

Suppose that it is known whether each pixel on the selected scan wiring is in the turn-on state or not (that is, whether the output of the modulator is "H" or "L") at some point in one horizontal scan interval.

In the turn-on state, device current flowing into the selected scan wiring from each column of modulation wiring is defined as Ifi where i is a row number (i=1, 2, . . . N).

Figure 5B:
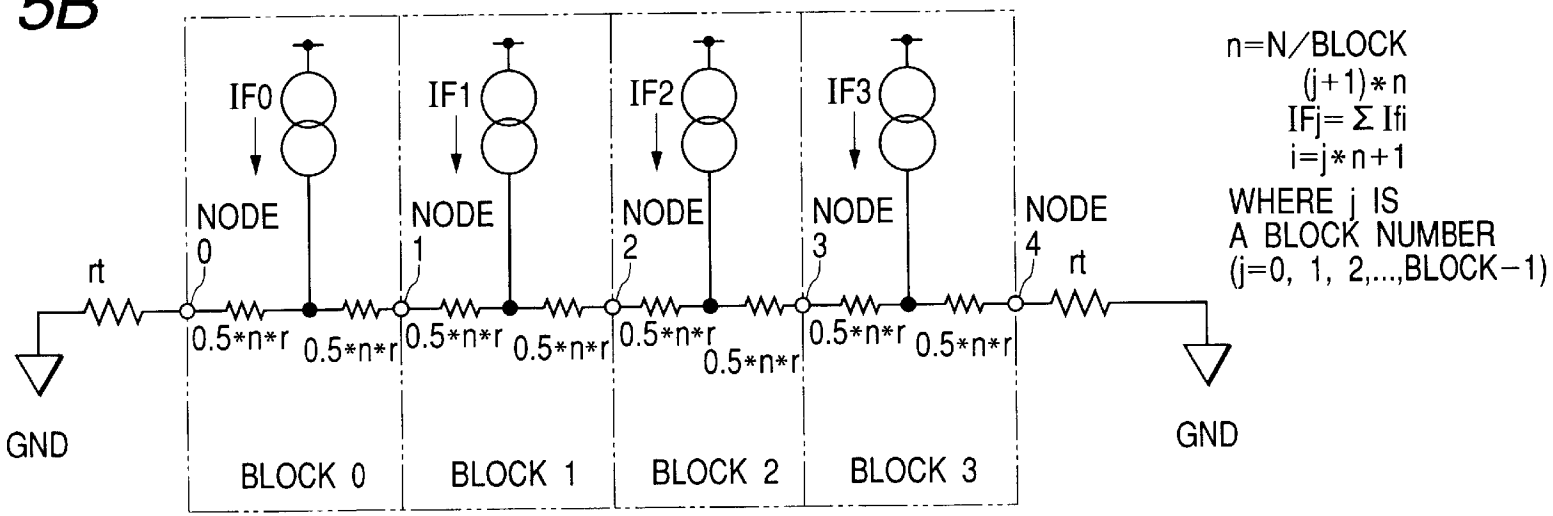
Figure 5C:
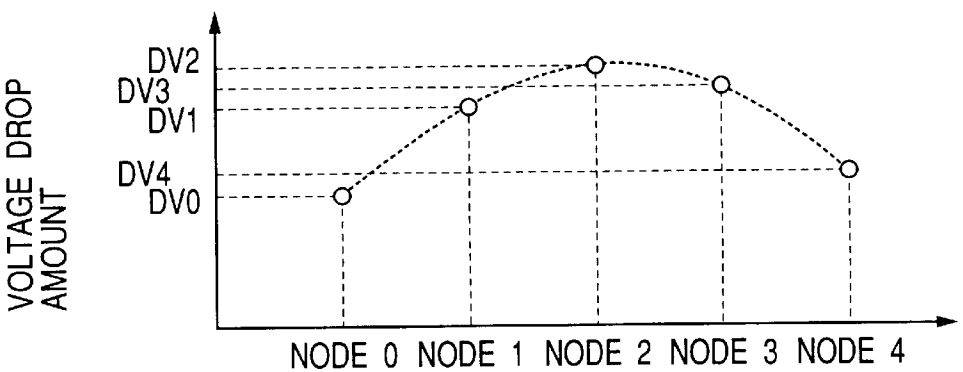

Also, as shown in FIGS. 5A, 5B, and 5C, a block is defined as a group composed of connections of n columns of modulation wiring and the selected scan wiring, and the surface conduction electron-emitting devices arranged at the points of intersection. In the embodiment, they are broken into four blocks.

Further, positions of nodes are set at boundary positions between blocks. The nodes indicate horizontal positions (reference points) for discrete calculations of the amount of voltage drop that occurs on the scan wiring in the degenerate model.

In the embodiment, five nodes 0 to 4 are set at the boundary positions.

FIG. 5B is a circuit diagram for explaining the degenerate model.

In the degenerate model, n columns of modulation wiring included in one block is degenerated into one column, and a connection is so established that the one column line will be placed at the center of the block of the scan wiring.

Further, the degenerated modulation wiring in each block is connected to a current source from which the sum of currents IF0 to IF3 in each block is flown.

In other words, IFj (j=0, 1, . . . 3) is current expressed in the following equation:

$$IFj = \sum_{i=j\times n+1}^{(j+1)\times n} Ifi \qquad \text{(Eq. 1)}$$

In FIG. 5A, the voltage across both ends of the scan wiring is Vs, while in FIG. 5B the voltage is the GND. Since in the degenerate model, current flowing from the modulation wiring into the selected scan wiring is modeled on the current source, the amount of voltage drop at each point on the scan wiring can be calculated by calculating voltage (difference of potential) at each point with respect to the power supplying source as reference (GND) potential (that is, as reference potential to calculate the amount of voltage drop).

The surface conduction electron-emitting devices are not shown in FIG. 5B because, when viewed from the selected scan wiring, the voltage drop itself does not vary regardless of the presence or absence of the surface conduction electron-emitting devices as long as an equivalent amount of current is flown into each block from the modulation wiring. Since the value of the total amount of current flown from the current source in each block is set to the value of the total amount of device current in each block (Equation 1), the surface conduction electron-emitting devices can be omitted in the drawing.

Further, wiring resistance of the scan wiring in each block is set n times as large as wiring resistance r in one section (where one section indicates a section of the scan wiring between a point of intersection with a column wiring and a point of intersection with another adjacent column wiring. In the embodiment, it is assumed that wiring resistance in one section of the scan wiring is uniform).

In such a degenerate model, the amounts of voltage drop DV0 to DVfourthat occurs at each node on the scan wiring can be easily calculated from the following product sum equation:

$$DV0=a00\times IF0+a01\times IF1+a02\times IF2+a03\times IF3$$

$$DV1=a10\times IF0+a11\times IF1+a12\times IF2+a13\times IF3$$

$$DV2=a20\times IF0+a21\times IF1+a22\times IF2+a23\times IF3$$

$$DV3=a30\times IF0+a31\times IF1+a32\times IF2+a33\times IF3$$

$$DV4=a40\times IF0+a41\times IF1+a42\times IF2+a43\times IF3$$

As a result, the following equation is established:

$$DVi = \sum_{j=0}^{3} aij \times IFj \qquad \text{(Eq. 2)}$$

$$(i = 0, 1, 2, 3, 4)$$

where aij denotes voltage developed across the i-th node when unit current is pumped into the j-th block alone in the degenerate model (hereinafter defined as aij).

The voltage aij is delivered from Kirchhoff's Law, and may be stored as a table once has been calculated.

Further, an approximation is made to the sum of currents IF0 to IF3 in each block determined from Equation:

$$IFj = \sum_{i=j\times n+1}^{(j+1)\times n} If\,i = IFS \times \sum_{i=j\times n+1}^{(j+1)\times n} Count\ i \qquad \text{(Eq. 4)}$$

In the above equation, Count i takes "1" when the i-th pixel on the selected scan wiring is in the turn-on state, or "0" when it is in the turn-off state.

Further, IFS denotes the product of an coefficient α, which takes on values from 0 to 1, and the device current IF flown when the voltage VSEL is applied across both ends of one surface conduction electron-emitting device.

In other words, IFS is defined as:

$$IFS=\alpha\times IF \qquad \text{(Eq. 5)}$$

It is apparent from Equation 3 that device current proportional to the number of turn-on devices in each block is flown from the column wiring in the block into the selected scan wiring. In this case, the device current IFS for one device is defined as the product of the device current IF for one device and the coefficient $\alpha$ for the following reason: A calculation of the amount of voltage drop requires repeated calculations of voltage rises on the scan wiring due to voltage drops and the amount of device current degradation due to the voltage rises, but making such convergent calculations using hardware is impractical. Therefore, according to the present invention, $\alpha$IF is approximately used as a convergent value of IF. Specifically, the rate (=$\alpha$1) of decrease of IF to the maximum voltage drop (entire white), and the rate (=$\alpha$2) of decrease of IF to the minimum voltage drop (minimum=0) are estimated in advance so that the convergent value of IF will be determined as a mean value of $\alpha$1 and $\alpha$2 or $0.8\times\alpha1$.

FIG. 5C shows an example of a curve of voltage drop obtained as a result of calculations of the amounts of voltage drop DV0 to DV4 at respective nodes using the degenerate model in certain turn-on states.

In this case, since the voltage drops trace very smooth curves, it is assumed that the voltage drops between nodes take on approximate values as indicated by dotted lines in FIG. 5C.

Use of such a degenerate model makes it possible to calculate a voltage drop at the position of a node corresponding to a desired time point for the input image data.

The above-mentioned result is easily delivered from calculations of the amounts of voltage drop at certain turn-on states using the degenerate model.

Although the voltage drop that occurs on the selected scan wiring varies with time during one horizontal scan interval, the variations have been predicted by determining the number of turn-on devices at each of several time points during one horizontal scan interval and calculating the voltage drop using the degenerate model in the turn-on state in the manner as mentioned above.

It should be noted that the number of turn-on devices in each block at some point in one horizontal scan interval can be easily determined by referring to the image data in the block.

As an example, if the number of bits of data inputted to a pulse width modulation circuit is 8, the pulse width modulation circuit outputs a pulse with a width varied according to the size of the input data.

In other words, when the input data is 0, the pulse width modulation circuit outputs "L", while when the input data is 255, it outputs "H" during one horizontal scan interval. When the input data is 12eighthe pulse width modulation circuit outputs H in the first half of one horizontal scan interval, and L in the latter half.

In this case, the number of turn-on devices at a start time of the pulse width-modulated signal (at a pulse rise time in the example of the modulation signal) can be easily detected by counting input data that are larger than 0 from among all input data to the pulse width modulation circuit.

Similarly, the number of turn-on devices at some point in one horizontal scan interval is easily detected by counting input data that are larger than 128 from among all input data to the pulse width modulation circuit.

Image data are compared with the threshold to count true outputs of the comparator, thus easily calculating the number of turn-on devices at any point in time.

For the sake of simplifying the following description, the amount of time called a time slot is defined here.

The time slot represents the amount of time that has elapsed since the pulse width-modulated signal rose in one horizontal scan interval. That is, time slot=0 is defined to represent the amount of time immediately after the start time of the pulse width-modulated signal.

Time slot=64 is defined to represent the amount of elapsed time from the start time of the pulse width-modulated signal until 64 levels of pulse width modulation is completed.

Similarly, time slot=128 is defined to represent the amount of elapsed time from the start time of the pulse width-modulated signal until 64 levels of pulse width modulation is completed. In the example, although the pulse width is modulated using the rise time as the reference, the present invention is not limited thereto. Like the rise time, a pulse fall time can also be used as the reference when the pulse width is modulated. In this case, however, the time slot travels in the direction opposite to that of the time axis.

(Calculation of Adjusted Data from the Amount of Voltage Drop)

As discussed above, repeated calculations using the degenerate model makes possible approximate and discrete calculations of time variations in voltage drop during one horizontal scan interval.

Figure 6:
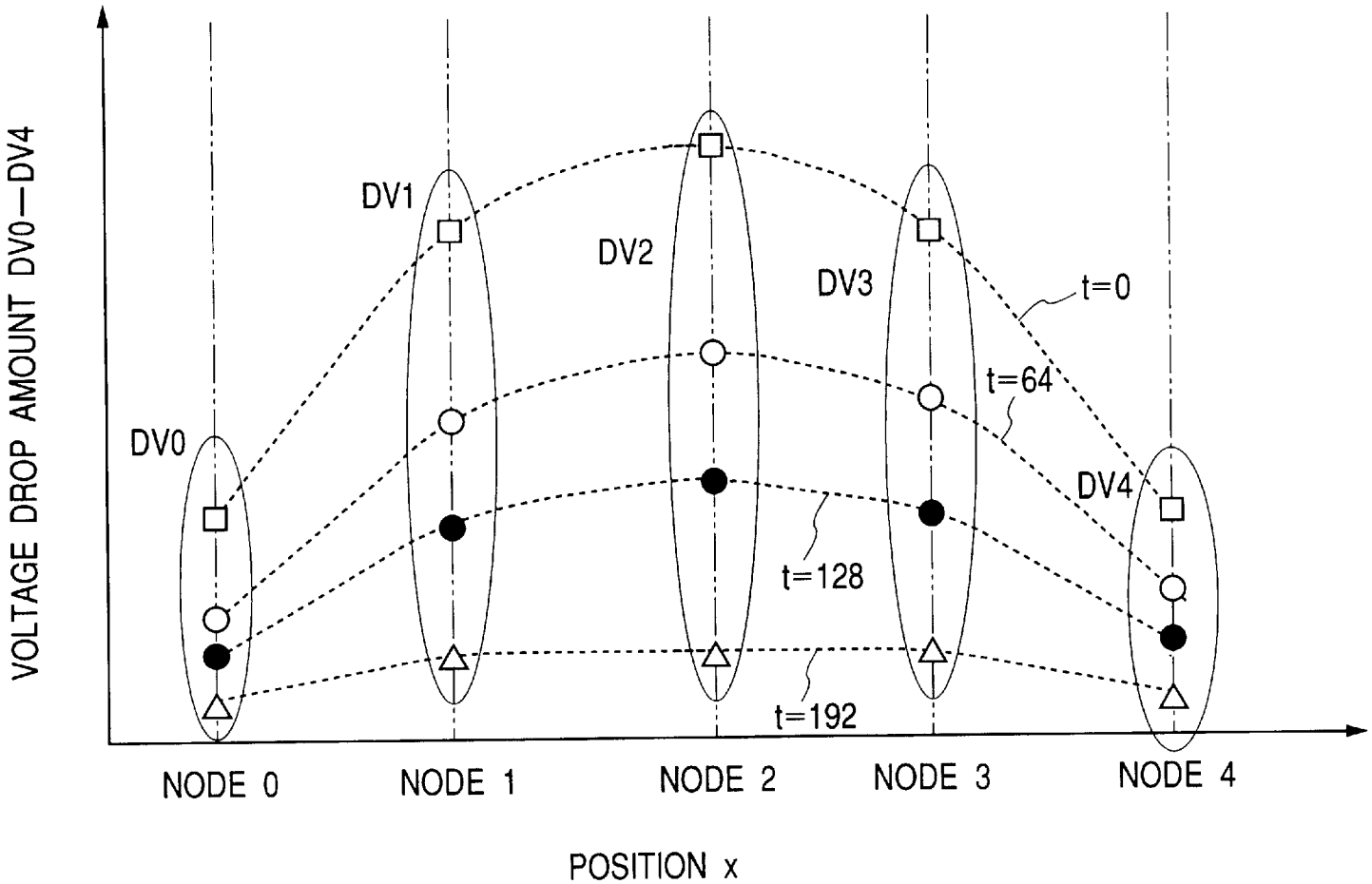
FIG. 6 is a graph showing the amount of voltage drop discretely calculated.
Figure 7:
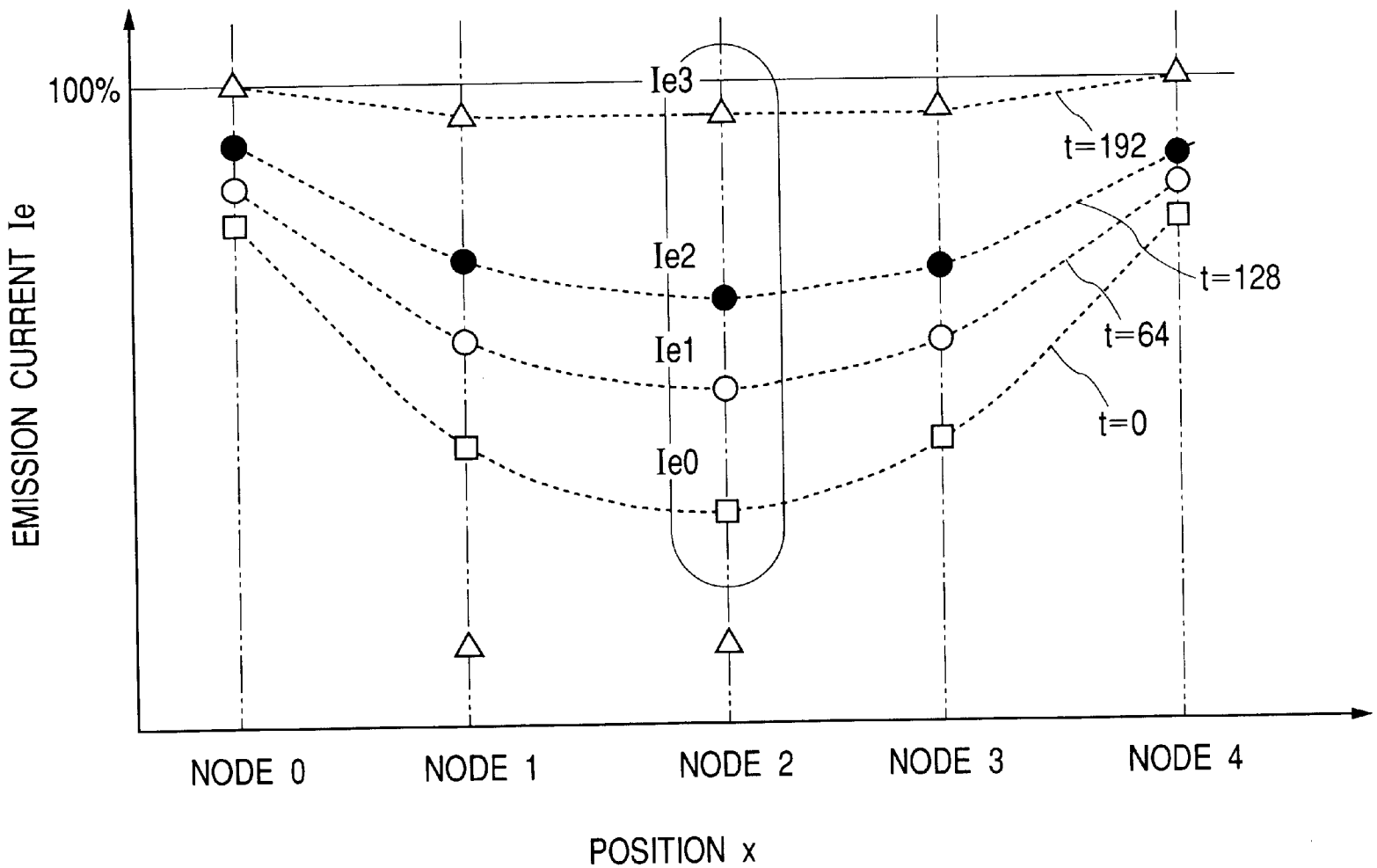
FIG. 7 is a graph showing variations in emission current discretely calculated.

FIG. 6 shows examples of curves of voltage drop as a result of repeated calculations of voltage drop to calculate the time variations in voltage drop in the scan wiring (the voltage drop and its time variations shown in FIG. 7 are examples of calculation results for certain image data, and voltage drop for another data will be varied differently).

In FIG. 6, the degenerate model is used at four points in time, namely in time slots 0, 64, 128, and 192, to make discrete calculations of voltage drop at the points in time respectively.

Although in FIG. 6 amounts of voltage drop at respective nodes are connected by dotted lines, the dotted lines are just used for convenience in viewing, the actual voltage drops calculated using the degenerate model have been discretely calculated at respective nodes marked with □, ○, ●, and Δ.

As the next logical step after finding that the amount of voltage drop and its time variations can be calculated, the inventors have studied a method of calculating adjusted data for adjusting image data from the amount of voltage drop.

FIG. 7 is a graph illustrating estimated emission current emitted from the surface conduction electron-emitting devices that are in the turn-on state when a voltage drop as shown in FIG. 7 takes place on the selected scan wiring.

In FIG. 7, the amount of emission current at each point in time and each position is expressed on the ordinate on a percentage basis by choosing the amount of emission current emitted with no voltage drop as 100%, while the horizontal positions are expressed on the abscissa.

As shown in FIG. 7, emission current is determined at the horizontal position of node 2 (reference point) as follows:

When time slot=0, the emission current is Ie0, when time slot=6fourthe emission current is Ie1, when time slot=12eighthe emission current is Ie2, and when time slot=192, the emission current is Ie3.

FIG. 7 is delivered from the amounts of voltage drop of FIG. 6 and the "drive voltage-to-emission current" graph of FIG. 3. Specifically, values of emission current when voltages obtained by subtracting the amounts of voltage drops from the voltage VSEL are applied are mechanically plotted.

In other words, FIG. 7 means that current is emitted from the surface conduction electron-emitting devices in the turn-on state, not from the surface conduction electron-emitting devices in the turn-off state.

The method of calculating adjusted data for adjusting image data from the amount of voltage drop.

(Method of Calculating Adjusted Data)

Figure 8A:
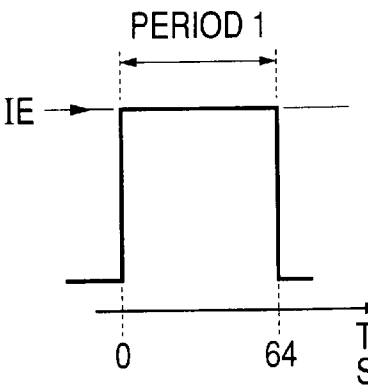
FIGS. 8A, 8B and 8C are graphs for explaining another calculation method for adjusted data.
Figure 8B:
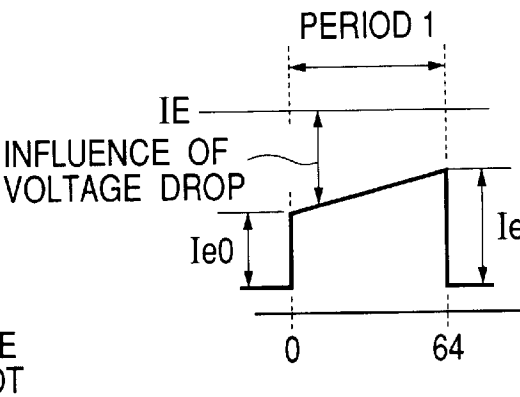
Figure 8C:
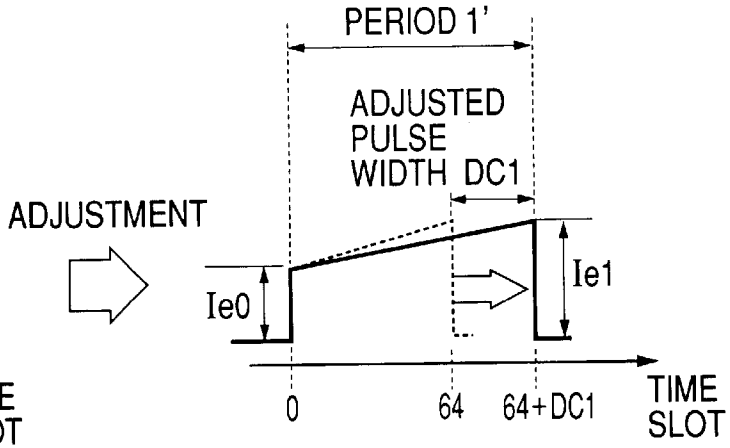

FIGS. 8A, 8B, and 8C are diagrams for explaining the method of calculating adjusted data having the amount of voltage drop from the time variations in emission current shown in FIG. 7. FIGS. 8A, 8B, and 8C show an example of adjusted data calculated for image data the size of which is 64.

The emission amount of luminance is nothing but the emission amount of electric charge obtained by integrating emission currents induced by the emission current pulses. For this reason, the following description of variations in luminance due to voltage drop will be based on the emission amount of electric charge.

If the emission current without influence of voltage drop is IF, and time corresponding to one level of pulse width modulation is Δt, the emission amount of electric charge Q0 to be emitted by the emission current pulse when the size of image data is 64 can be expressed by multiplying the amplitude IE of the emission current pulse by the pulse width (64×Δt) as follows:

$$Q0=IE\times 64\times\Delta t \quad \text{(Eq. 6)}$$

However, in actual situations, a phenomenon in which emission current drops due to the occurrence of voltage drop on the scan wiring takes place.

The emission amount of electric charge to be emitted by the emission current pulse when allowance should be made for the influence of voltage drop can be approximately calculated in a manner described below. In other words, if the emission currents at node 2 and time slot=64 are Ie0 and Ie1, and the emission current during the interval between 0 and 64 is approximated to linearly vary between Ie0 and Ie1, the emission amount of electric charge in this period takes a trapezoidal area as shown in FIG. 8B.

Specifically, the emission amount of electric charge can be calculated as follows:

$$Q1=(Ie0+Ie1)\times 64\times\Delta t\times 0.5 \quad \text{(Eq. 7)}$$

It is assumed as shown in FIG. 8C that when the pulse is widened by DC1 so that a correction will be made to compensate for the amount of emission current degradation due to the occurrence of voltage drop, the influence of voltage drop can be compensated for.

When a correction is made to compensate for the voltage drop, and as a result, when the pulse is widened, it is considered that the amount of emission current varies in each time slot. However, it is assumed here that, for the sake of simplification, the emission current is Ie0 when time slot=0, and the emission current is Ie1 when time slot=(64+DC1) as shown in FIG. 8C.

Further, the emission current in the interval between the time slot 0 and the time slot (64+DC1) is approximated to take on values on a line that linearly connects the two points of emission current.

As a result, the emission amount Q2 of electric charge emitted by the adjusted emission current pulse can be calculated as follows:

$$Q2=(Ie0+Ie1)\times(64+Dc1)\times\Delta t\times 0.5 \quad \text{(Eq. 8)}$$

If this value is equivalent to the above-mentioned value Q0, the following equation is obtained:

$$IE\times 64\times\Delta t=(Ie0+Ie0)\times(64+Dc1)\times\Delta t\times 0.5$$

If this equation is solved with respect to DC1, the following equation is obtained:

$$DC1=((2\times IE-Ie0-Ie1)/(Ie0+Ie1))\times 64 \quad \text{(Eq. 9)}$$

Thus, the adjusted data is calculated for the image data the size of which is 64.

In other words, the amount of adjustment CData corresponding to DC1 (that is, CData=DC1) has only to be added to the image data the size of which is 64 at node 2 as expressed in Equation 9.

Figure 9A:
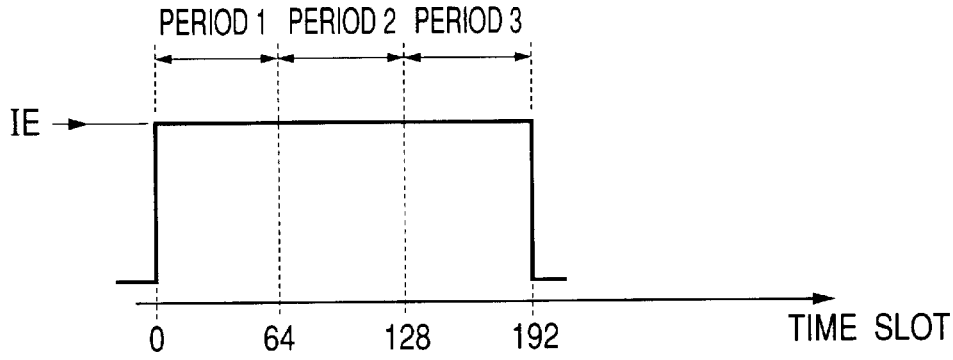
FIGS. 9A, 9B and 9C are graphs for explaining a calculation example of adjusted data when the size of image data is 192.
Figure 9B:
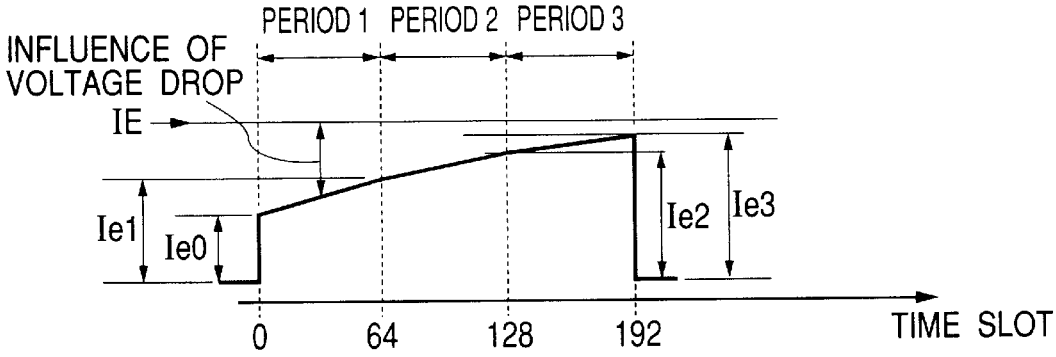
Figure 9C:
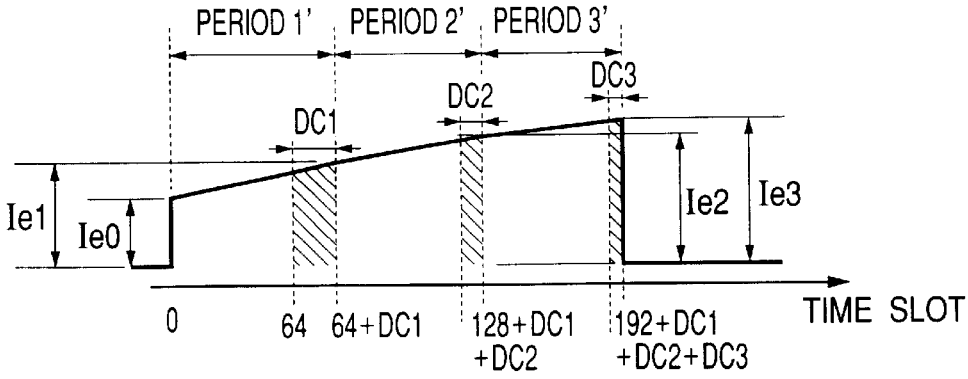

The amount of adjustment can also be determined for the image data the size of which is 192 in the same manner in each of three periods as shown in FIGS. 9A, 9B, and 9C.

If the pulse width is 0, since there is no influence of voltage drop on the emission current, it is natural that the adjusted data should be 0. Thus the adjusted data CData to be added to the image data is set to 0.

Such calculations of adjusted data that were performed on image data located at intervals, namely in the time slots 0, 64, 128, and 192, are aimed at reducing calculated amounts.

Figure 10B:
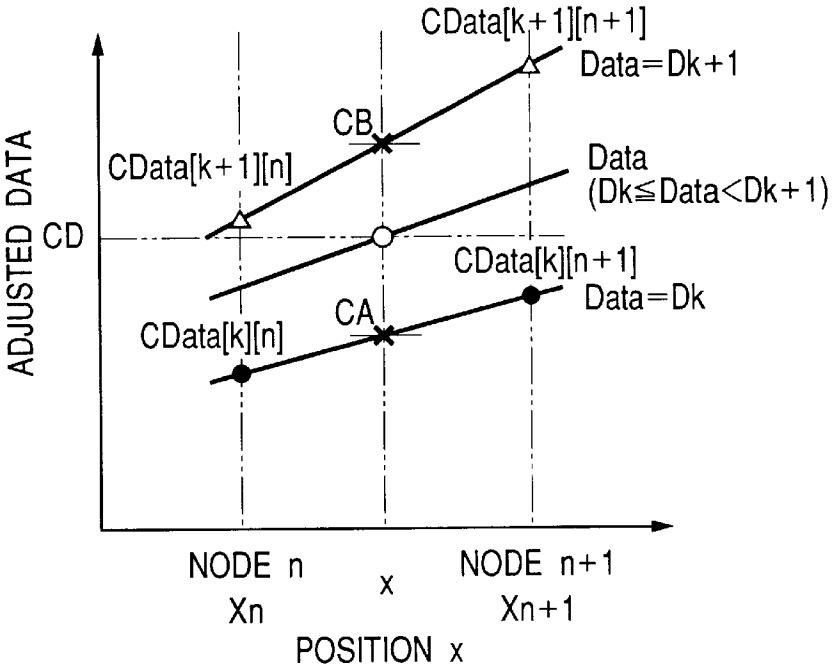
FIGS. 10A and 10B are graphs for explaining on interpolation method for adjusted data.
Figure 10A:
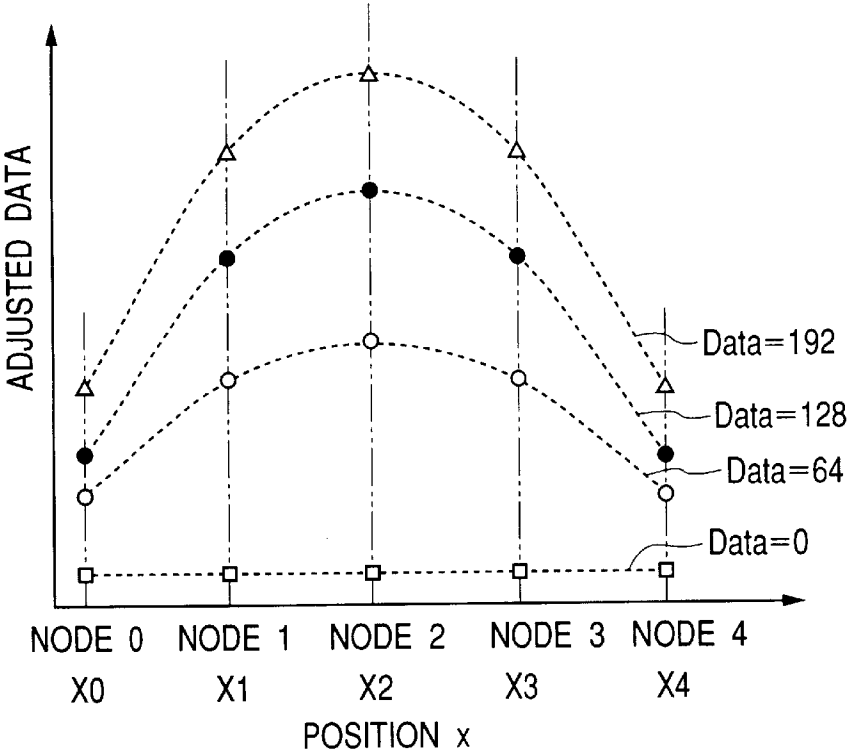

FIG. 10A shows examples of discrete adjusted data determined for certain input data by the above-mentioned method. In FIG. 10A, the abscissa corresponds to horizontal display position along which positions of nodes are taken, while the ordinate corresponds adjusted data size.

The discrete adjusted data are calculated with respect to positions of nodes marked with □, ○, ●, and Δ in FIG. 10A, and sizes of image data (image data reference values of 0, 64, 128, and 192).

(Method of Interpolating Discrete Adjusted Data)

The adjusted data discretely calculated are discrete data that have been determined with respect to respective nodes, and they are not given at any horizontal position (column wiring number). In addition, the adjusted data is for image data the size of which takes one of the reference values predetermined with respect to each node, and it is not determined according to the actual size of any image data.

Therefore, the inventors have considered interpolation of the adjusted data discretely calculated to calculate adjusted data that would match the actual size of any input image data on each column wiring.

FIG. 10B is a graph showing a method of calculating adjusted data corresponding to image data Data at position x between node n and node n+1.

It is assumed that discrete adjusted data at positions Xn and Xn+1 corresponding to node n and node n+1 have been already calculated.

It is further assumed that Data as input image data takes on values between image data reference values Dk and Dk+1.

If discrete adjusted data determined with respect to the reference value of k-th image data at node n is denoted as CData[k][n], adjusted data CA with a pulse width Dk at position x can be calculated by the linear approximation method from the values CData[k][n] and CData[k][n+1] as follows:

$$CA=\frac{(Xn+1-x)\times CData[k][n]+(x-Xn)\times CData[k][n+1]}{Xn+1-Xn} \quad \text{(Eq. 17)}$$

It should be noted that Xn and Xn+1 denote horizontal display positions of node n and node n+1, and they are constants that were determined when the blocks were decided as mentioned above.

On the other hand, adjusted data CB for image data Dk+1 at position x can be calculated as follows:

$$CB = \frac{(Xn+1-x)\times CData[k+1][n] + (x-Xn)\times CData[k+1][n+1]}{Xn+1-Xn} \quad \text{(Eq. 18)}$$

The adjusted data CA and CB can be linearly approximated to calculate adjusted data CD for the image data Data at position x as follows:

$$CD = \frac{CA\times(Dk+1-Data) + CB\times(Data-Dk)}{Dk+1-Dk} \quad \text{(Eq. 19)}$$

The method using Equation 17 to Equation 19 makes it easy to calculate from discrete adjusted data adjusted data that matches or fits any actual position or size of image data.

The adjusted data thus calculated is added to the image data to correct or adjust the image data so that pulse width modulation will be performed according to the image data after adjusted (called the adjusted image data) . This makes it possible to reduce the influence of voltage drop on display images that has been the problem in the conventional, and hence improve image quality.

Another conventional problem that hardware for adjustment has been needed can also be solved by introducing an approximation method such as the degenerating method discussed above. The introduction of such an approximation method reduces calculated amounts, and has the advantage that it can be implemented in a very small hardware configuration.

(Description of Features of Entire System and Each Part)

Description will now be made about a hardware configuration of the image display apparatus in which adjusted data calculation means is incorporated.

Figure 11:
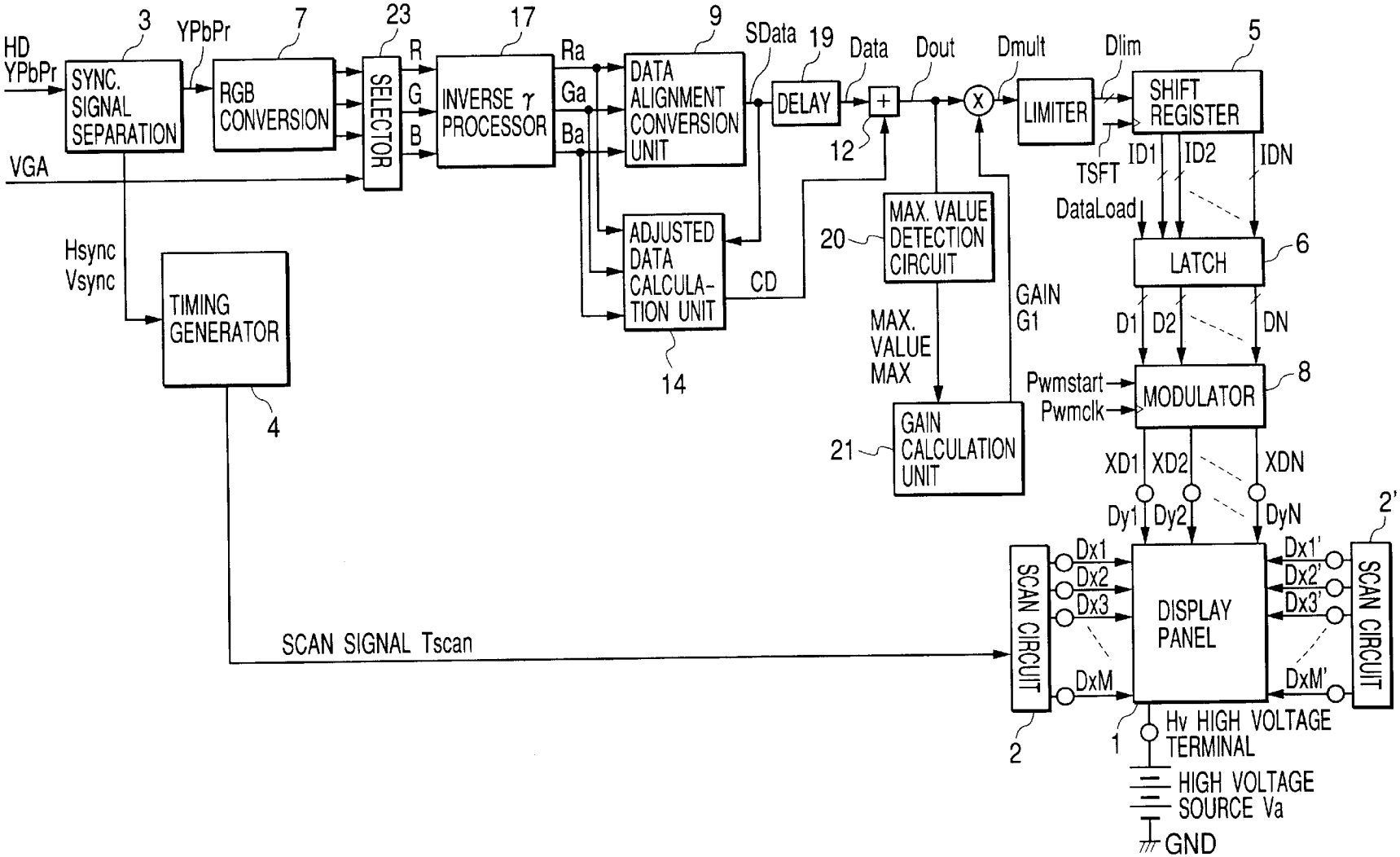
FIG. 11 is a block diagram showing a schematic configuration of an image display apparatus according to a first embodiment of the present invention.

FIG. 11 is a block diagram showing a schematic circuit configuration. Shown in FIG. 11 are the display panel 1 shown in FIG. 1, voltage supplying terminals Dx1–DxM and Dx1'–DxM' for the scan wiring of the display panel 1, voltage supplying terminals Dy1–DyN for the modulation wiring of the display panel 1, the high voltage terminal Hv for applying an accelerating voltage across the face plate and the rear plate, and the a high voltage source Va. Also shown in FIG. 11 are a scan circuit 2, a synchronizing signal separation circuit 3, a timing generator 4, an RGB conversion circuit 7 for converting a YPbPr signal from the synchronizing signal separation circuit 3 into RGB signals, a selector 23 for switching between TV and computer picture signals, and an inverse γ processor 17. Further shown in FIG. 11 are a sift register 5 for one line of image data, a latch circuit 6 for one line of image data, a pulse width modulator 8 for outputting a modulated signal to the modulation wiring of the display panel, an adder 12, an adjusted data calculation unit 14, a maximum value detection circuit 20, and a gain calculation unit 21.

In addition, in FIG. 11, R, G, and B denote RGB parallel input picture data, Ra, Ga, Ba are RGB parallel picture data subjected to inverse γ conversion to be described later, Data is image data subjected to parallel-to-serial conversion through a data alignment conversion unit 9, CD is adjusted data calculated by the adjusted data calculation unit 14, and Dout is image data (adjusted image data) adjusted by the adder adding the adjusted data and the image data.

(Synchronizing Signal Separation Circuit and Selector)

In the embodiment, the image display apparatus can display both television signals such as NTSC, PAL, SECAM, or HDTV, and computer outputs such as VGA.

A picture signal in HDTV format is separated from synchronizing signals Vsync and Hsync through the synchronizing signal separation circuit. The synchronizing signals are supplied to the timing generator 4, while the picture signal from which the synchronizing signals have been separated is supplied to the RGB conversion circuit seventhe RGB conversion circuit 7 is internally provided with a low-pass filter and an A/D converter, not shown, in addition to the conversion circuit from YPbPr to RGB, so that YPbPr is converted into digital RGB signals to be supplied to the selector 23.

On the other hand, a picture signal like VGA outputted from a computer is subjected to A/D conversion by means of an A/D converter, not shown, and supplied to the selector 23.

The selector 23 outputs a picture signal by switching between the television signal and the computer signal according to which picture signal the user wants to display.

(Timing Generator)

The timing generator 4 incorporates therein a PLL circuit to generate timing signals that support various picture formats so as to time the operation of each part.

The timing signals generated by the timing generators include a timing signal Tsft for controlling the operation timing of the sift register 5, a control signal Dataload for latching data from the sift register 5 to the latch circuit 6, a pulse width modulation starting signal Pwmstart for the modulator 8, a clock Pwmclk for pulse width modulation, and a control signal Tscan for controlling the operation of the scan circuit 2.

(Scan Circuit)

Figure 12:
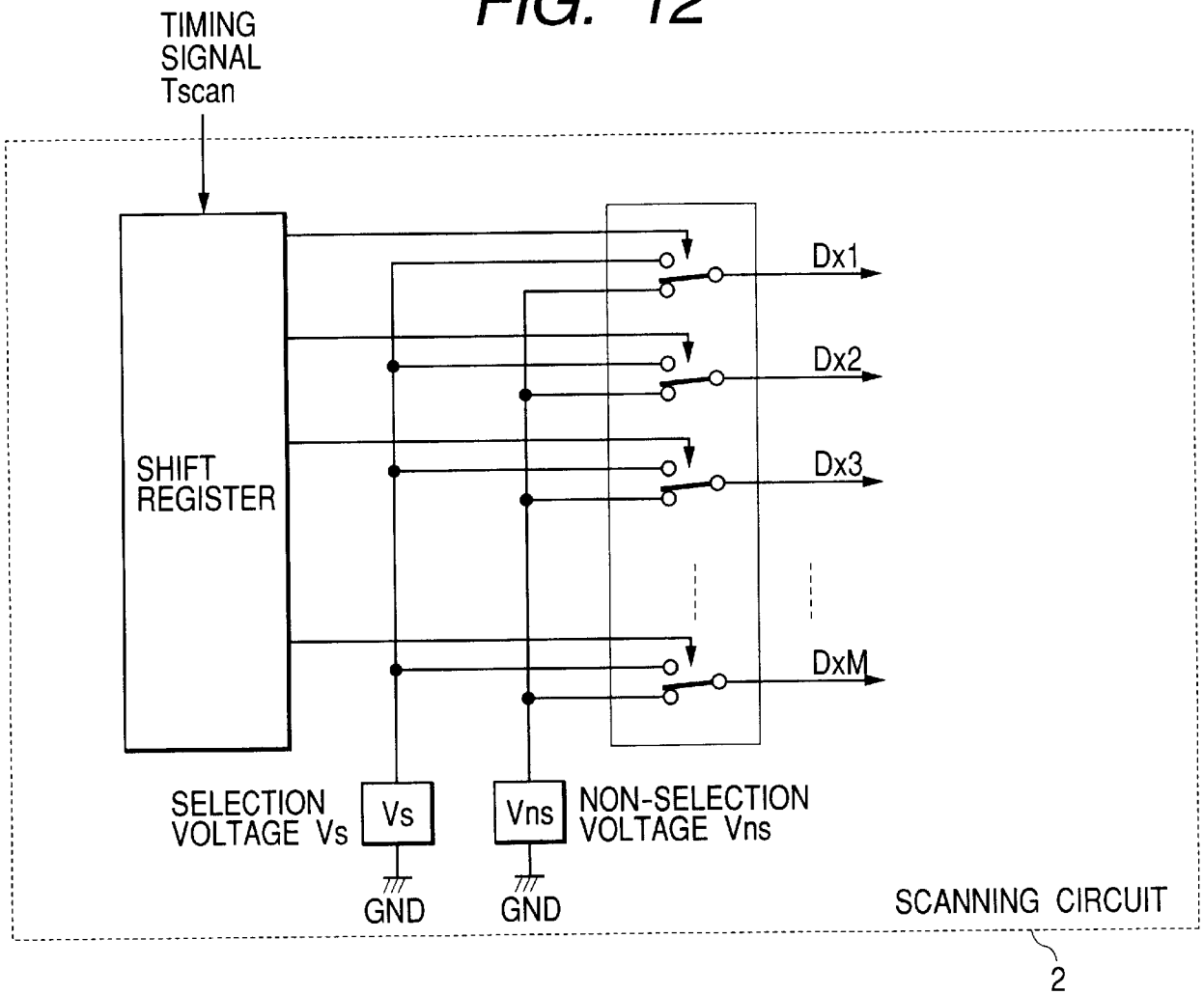
FIG. 12 is a block diagram showing a configuration of a scan circuit of the image display apparatus.
Figure 13:
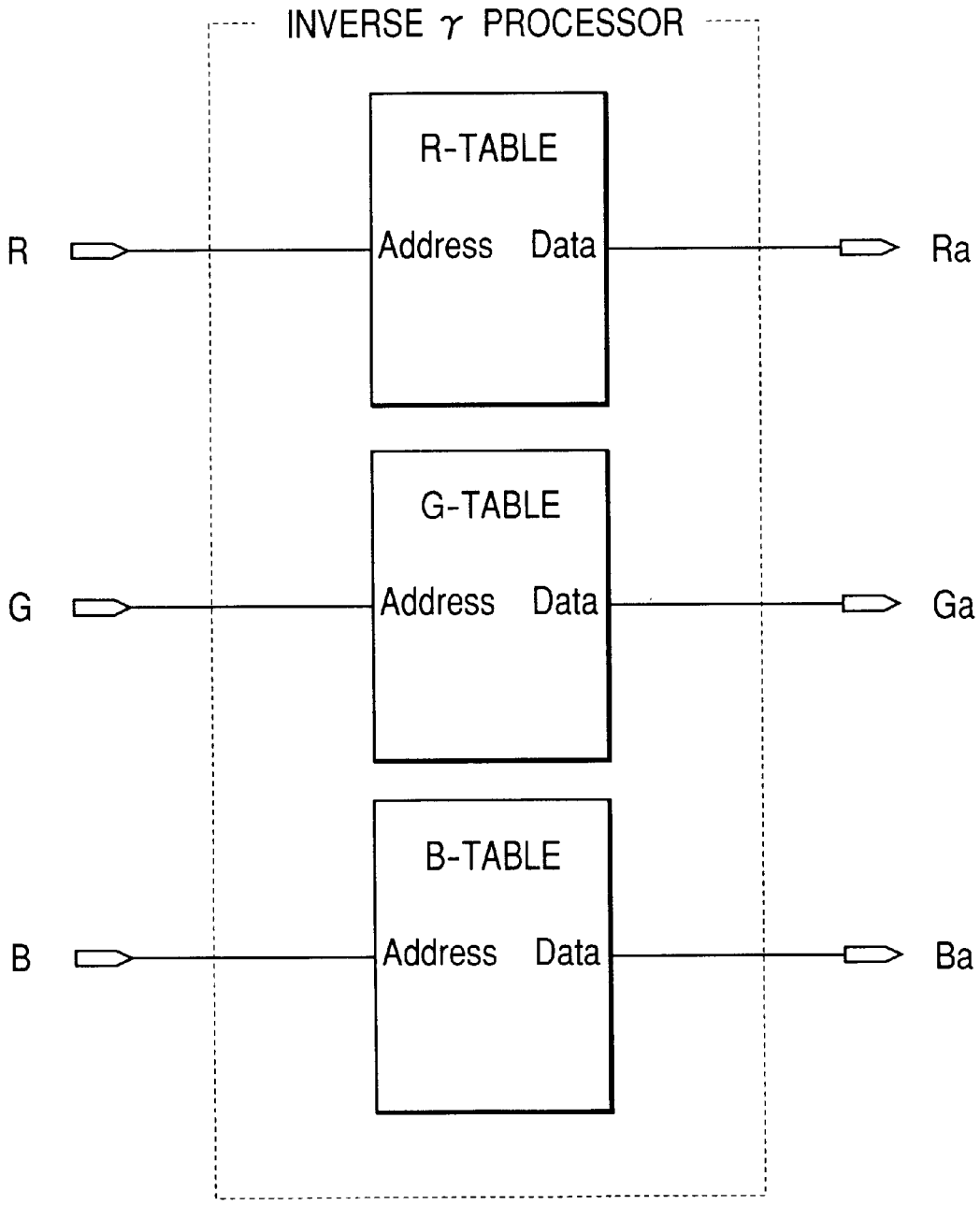
FIG. 13 is a block diagram showing a configuration of an inverse γ processor of the image display apparatus.

As shown in FIG. 12, the scan circuits 2 and 2' are circuits that output a selection voltage Vs or non-selection voltage Vns to the connection terminals Dx1–DxM or Dx1'–DxM' to perform sequential scanning of the display panel line by line in one horizontal scan intervals.

The scan circuits 2 and 2' are synchronized with the timing signal Tscan from the timing generator 4 to switch one selected scan wiring to another in sequence at every horizontal scan interval.

It should be noted that Tscan is a timing signal group composed of a vertical synchronizing signal, a horizontal synchronizing signal, and the like.

As shown in FIG. 12 the scan circuits 2 and 2' are each constituted of M switches, a sift register, and the like. Each of the switches is preferably made up of a transistor or FET.

To reduce the influence of voltage drop on the scan wiring, the scan circuits 2 and 2' are preferably connected to both ends of the scan wiring of the display panel 1 so that the display panel will be driven from both ends.

However, the embodiment is effective even when the scan circuits are not connected to both ends of the scan wiring. In this case, the embodiment is applicable merely by changing parameters in Equation 3.

(Inverse γ Processor)

The CRT has an input-to-light emitting characteristic of 2.2 power-law (hereinafter called an inverse γ characteristic).

Taking into account such a characteristic of the CRT, the input picture signal is typically converted according to a γ characteristic of 1/2.2 or 0.45 so that the input picture signal will show a linear light-emitting characteristic when displayed on the CRT.

On the other hand, the display panel of the image display apparatus according to the embodiment of the present invention has an almost linear light-emitting characteristic with respect to the voltage applied time, and when subjected to modulation based on drive voltage applied time, the input picture signal needs to be converted based on the inverse γ characteristic (hereinafter called the inverse γ conversion).

The inverse γ processor 17 shown in FIG. 11 is a circuit in which the input picture signal is subjected to the inverse γ conversion.

In the embodiment, the inverse γ processor 17 is so constituted that the inverse conversion processing is performed using memory.

Assuming that the number of bits of each of the picture signals R, G, and B is 8, and the number of bits of each of the picture signals Ra, Ga, and Ba as outputs of the inverse γ processor 17 is 8, the inverse γ processor 17 uses a memory for 8-bit address and 8-bit data in each color.

(Data Alignment Conversion Unit)

Figure 14:
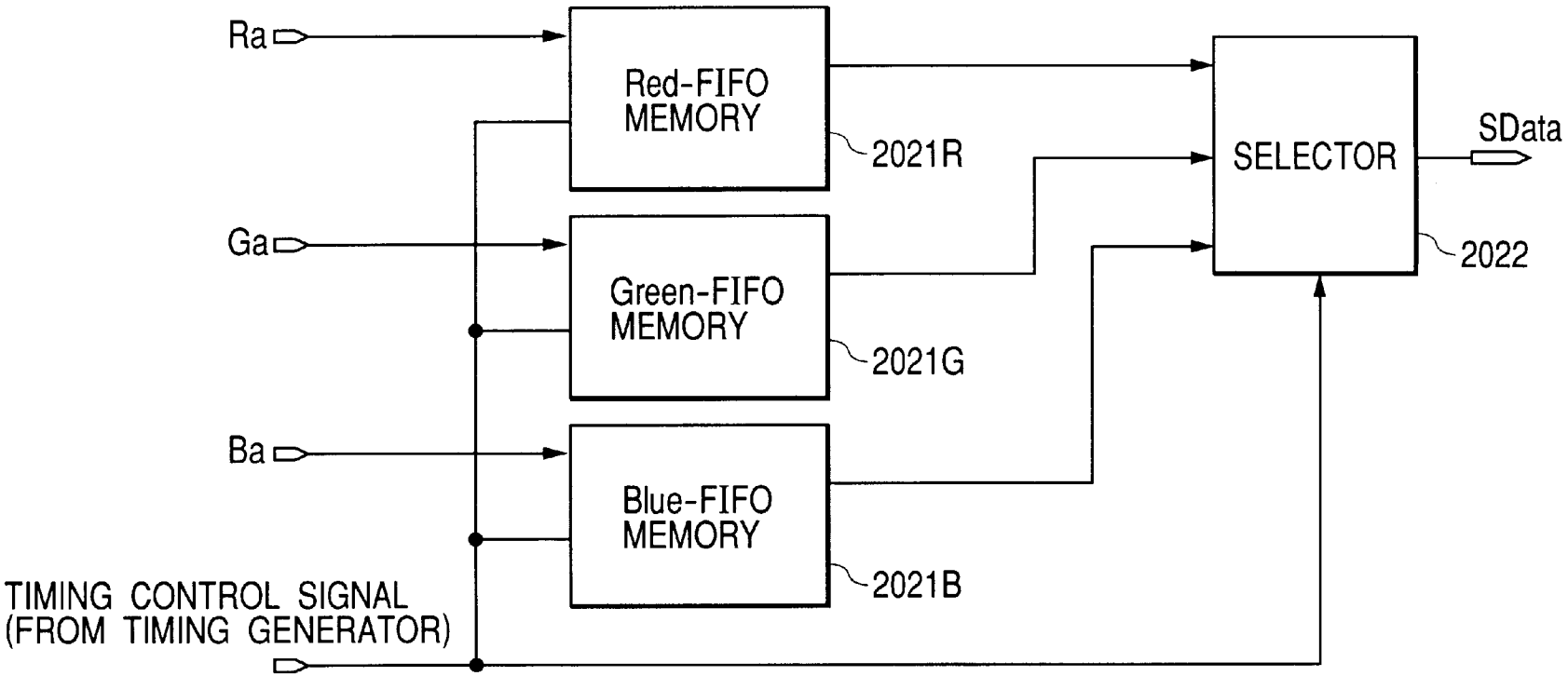
FIG. 14 is a block diagram showing a configuration of a data alignment conversion unit of the image display apparatus.

The data alignment conversion unit 9 is a circuit that parallel-to-serial converting the RGB parallel picture signals Ra, Ga, and Ba in alignment with the pixel array on the display panel. As shown in FIG. 14, the data alignment conversion unit 9 is constituted of FIFO (First In-First Out) memories 2021R, 2021G, and 2021B for respective colors R, G, and B, and a selector 2022.

Each of the FIFO memories is further provided with two memories, not shown in FIG. 14, for odd-numbered and even-numbered word lines corresponding to the number of horizontal pixels. When picture data is inputted into an odd-numbered line, the data is written into the FIFO memory for the odd-numbered lines, while image data stored in the immediately preceding horizontal scan interval is read out of the FIFO memory for even-numbered lines. On the other hand, when picture data is inputted into an even-numbered line, the data is written into the FIFO memory for even-numbered lines, while image data stored in the immediately preceding horizontal scan interval is read out of the FIFO memory for odd-numbered lines.

The data read out of the FIFO memory are subjected to Parallel-to-serial conversion in alignment with the pixel array on the display panel, and outputted as RGB serial image data SData. Although details of the operation of the data alignment conversion unit 9 are omitted here, it operates based on the timing control signals from the timing generator 4.

(Delay Circuit 19)

The image data SData rearranged by the data alignment conversion unit 9 is inputted into the adjusted data calculation unit 14 and a delay circuit 19. As will be described later, an adjusted data interpolation unit of the adjusted data calculation unit 14 refers to horizontal position information x from a timing control circuit and the value of the image data SData to calculate adjusted data accordingly.

The delay circuit 19 is provided for absorbing time to complete the adjusted data calculation (the above-mentioned adjusted data interpolation processing) . In other words, the delay circuit 19 is means that retards the transfer of the image data Data so that the adder 12 will add the image data Data to corresponding adjusted data CD in the right way. This means may be of a flip-flop type.

(Adder 12)

The adder 12 is means that adds the image data Data and the adjusted data CD from the adjusted data calculation unit 14. The addition makes a correction to the image data Data, and the image data corrected or adjusted is transferred as adjusted image data Dout to the maximum value detection circuit 20 and a multiplier.

It is preferable that the number of bits of the adjusted image data Dout as the output of the adder 12 should be determined so as not to cause overflow when the adjusted data is added to the image data.

To be more specific, if the image data Data is 8 bits wide with a maximum value of 255, and the adjusted data CD is 7 bits wide with a maximum value of 1twentiethe maximum value of addition results is 255+120=375.

In this case, it is preferable that the adder 12 should output 9-bit-wide adjusted image data Dout so as not to cause overflow.

(Overflow Processing (Amplitude Adjustment Means))

As discussed above, the present invention is to realize the adjustment in the form of the adjusted image data Dout obtained by adding the calculated adjusted data CD to the image data Data.

Suppose here that the number of bits of the modulator 8 is 8, and the number of bits of the adjusted image data Dout as the output of the adder 12 is 9.

In this case, if the adjusted image data Dout is transferred to the modulator 8 as it is, an overflow will take place.

In other words, more than 8 bits of data is folded in the modulator 8 for modulating 8 bits of data, resulting in a significant reduction in picture quality.

To cope with this, the amplitude of the adjusted image data needs to be adjusted before inputted to the modulator 8.

If the number of input bits of the modulator 8 increases, the overflow that takes place on the input side of the modulator 8 can be prevented. However, the pulse width of the modulated signal outputted from the modulator 8 cannot be unlimitedly widened.

In other words, since the image display apparatus according to the present invention is to sequentially select each row of scan wiring to be driven, the widths of pulses outputted from the modulator 8 have to fall with a range in which all the pulse widths do not exceed the scan time.

Therefore, the upper limit of the input range of the modulator 8 is set by an input data value corresponding to the maximum input value determined by the number of bits of the modulator 8 or the maximum modulatable pulse width (that is, time to select one row of scan wiring).

In the embodiment, the following will describe such a case that the upper limit of the input range of the modulator 8 is set by the maximum input data value for the modulator 8.

To prevent overflow, the maximum value of adjusted image data Dout in the case an entire white pattern of which the input data image is maximum is inputted (that is, when the number of bits of the image data is 8, (R, G, B)=(FFh, FFh, FFh) is inputted) may be estimated in advance so that the adjusted image data Dout will be multiplied by such gain that falls within the input range of the modulator 8. This method is called the fixed gain method below.

Although no overflow takes place by the fixed gain method, a display image, especially an image pixel area in which average luminance is low, may be darkened because low gain is multiplied despite room enough to display the image with higher gain.

On the other hand, the maximum value of the adjusted image data Dout may be detected on a frame basis to calculate such gain that falls within the input range of the modulator 8 so that the adjusted image data Dout will be multiplied by the gain, thereby preventing the overflow. This method is called the adaptive gain method below.

The adaptive gain method requires the maximum value detection circuit 20 for detecting the maximum value MAX of the adjusted image data Dout on a frame basis, the gain calculation unit 21 for calculating gain GA by which the maximum value of the adjusted image data Dout is multiplied, and a multiplier for multiplying the adjusted image data Dout and gain G1 together, and so on.

In the adaptive gain method, it is preferable to calculate the gain on a frame basis so as to prevent overflow.

The gain could be calculated for each horizontal line to prevent the overflow. In this case, however, since the gain varies from one horizontal line to another, such a calculation is undesirable because it gives a sense of discomfort, that is, it makes the viewer feel as if something is wrong with the display image.

The above are brief descriptions of the fixed gain method and the adaptive gain method.

The inventors have confirmed that either of the methods can be used to calculate gain and adjust the amplitude of the adjusted image data properly.

In the embodiment, it is assumed that the gain adjustment is made by the adaptive gain method.

The following will describes in detail a circuit configuration as means for adjusting the amplitude of the adjusted image data using the adaptive gain method according to the embodiment.

(Maximum Value Detection Means (Maximum Value Detection Circuit))

The maximum value detection circuit 20 is connected to each part as shown in FIG. 11.

The maximum value detection circuit 20 is a circuit for detecting the maximum value from among values of adjusted image data Dout outputted in one frame.

The maximum value detection circuit 20 can be easily made up of a comparator, a register, and the like. The maximum value detection circuit 20 compares a value stored in the register with the size of adjusted image data Dout sequentially transferred, and when the adjusted image data Dout is larger than the register value, the register value is updated with the data value.

In this case, the register value is reset to 0 at the beginning of each frame, and the maximum value of the adjusted image data in the frame is stored in the register at the end of the frame.

The maximum value of the adjusted image data Dout thus detected is transferred to the gain calculation unit 21.

(Gain Calculation Means (Gain Calculation Unit))

The gain calculation unit 21 is means for calculating gain for use in adjusting the amplitude based on the adaptive gain method so that the adjusted image data Dout will fall within the input range of the modulator 8.

If the maximum value detected by the maximum value detection circuit 20 is MAX, and the maximum value of the input range of the modulator 8 is INMAX, the gain can be determined in the following manner (first method):

$$\text{Gain } G1 \leqq \text{INMAX/MAX} \quad \text{(Eq. 20)}$$

The gain calculation unit 21 updates the gain during a vertical return interval to change the gain value on a frame basis.

In the configuration of the image display apparatus of the present invention, the maximum value of the adjusted image data in the immediately preceding frame is used to calculate gain by which the adjusted image data in the current frame is multiplied.

In such a configuration, an overflow may take place because the values of adjusted image data vary from frame to frame in the strict sense.

To cope with this problem, a circuit design is found preferable in which a limiter to be described later is provided to the output of the multiplier for multiplying the adjusted image data and the gain together so that the output of the multiplier will fall within the input range of the modulator. This overflow processing can considered equivalent to overflow processing using a correlation between adjusted image data (image data) of adjacent frames.

If a frame memory is provided between the maximum value detection circuit and the multiplier, the overflow can be prevented in a configuration without any delay time.

The inventors have also confirmed that gain can be determined by the adapted gain method in another manner described below.

In other words, the maximum values of adjusted image data detected in frames previous to the current frame may be smoothened (averaged) in the frame direction, and the mean value AMAX obtained is given the following equation to determine gain to be provided for the adjusted image data in the current frame (second method):

$$\text{Gain } G1' \leqq \text{INMAX/AMAX} \quad \text{(Eq. 21)}$$

Further, as the third method, the gain G1 may be drawn from Equation 20 based on a frame basis so that the values obtained will be averaged to determine the current gain.

The inventors have confirmed that all the three methods would be advantageous, but the second and third methods are more appropriate than the first method because they have another effect of considerably reducing flicker in a display image (as will be described later using FIGS. 17A, 17B, 18A, 18B, 18C and 19).

The inventors have examined the number of frames to be averaged by the second and third methods, and have found that a desirable image with less flicker can be obtained as a result of averaging 16 to 64 frames.

Further, as the third method, the gain G1 may be drawn from Equation 20 based on a frame basis so that the values obtained will be averaged to determine the current gain.

The inventors have confirmed that all the three methods would be advantageous, but the second and third methods are more appropriate than the first method because they have another effect of considerably reducing flicker in a display image (as will be described later using FIGS. 17A, 17B, 18A, 18B, 18C and 19).

The inventors have examined the number of frames to be averaged by the second and third methods, and have found that a desirable image with less flicker can be obtained as a result of averaging 16 to 64 frames.

Like in the first method, there is a correlation between (adjusted) image data of adjacent frames in the second or third method. Therefore, the probability of occurrence of overflow can be reduced, but not completely prevented.

As for measures taken for this problem, it is further preferable to roughly prevent overflow by any of the above-mentioned methods, and completely prevent overflow by means of a limiter provided to the output of the multiplier.

Figure 15:
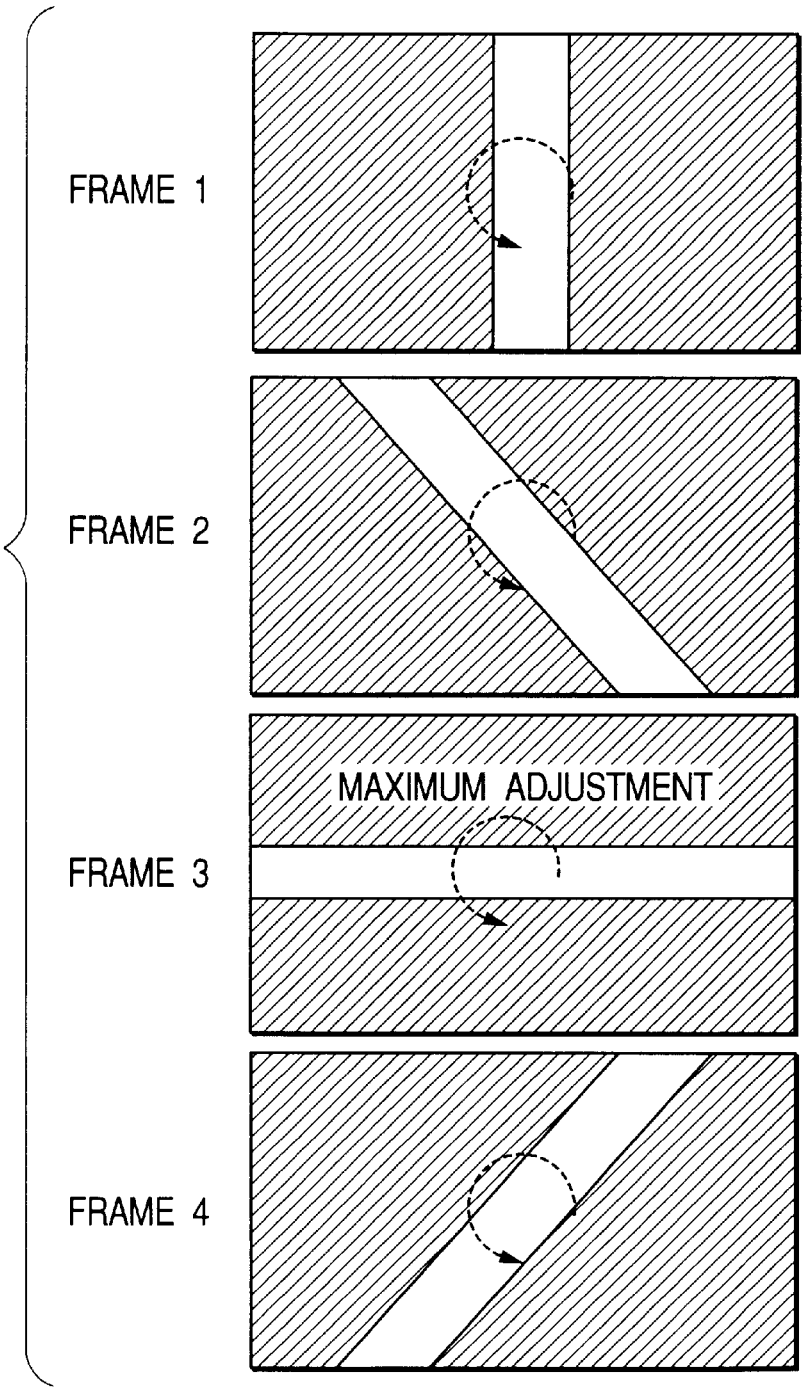
FIG. 15 is an illustration showing examples of consecutive frames.

FIG. 15 is an illustration for explaining flicker by taking as examples the first and second methods.

FIG. 15 shows an example of motion picture in which a white bar rotates counterclockwise against a grey background. When such an image is displayed, adjusted data CD varies in size from frame to frame as the bar rotates.

Figure 16:
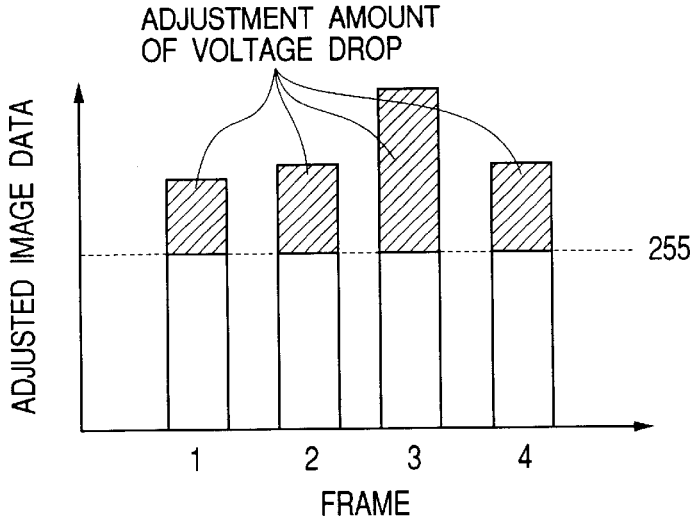
FIG. 16 is a graph showing changes in size of image data in the consecutive frames.

FIG. 16 is a bar chart for explaining adjusted data obtained when a correction or adjustment is made to such motion picture. In FIG. 16, the maximum adjusted image data in each frame is extracted and graphically plotted.

In the bar chart of FIG. 16, hollow bar parts correspond to original image data and textured or gray bar parts correspond to extensions by adjustment.

Figure 17A:
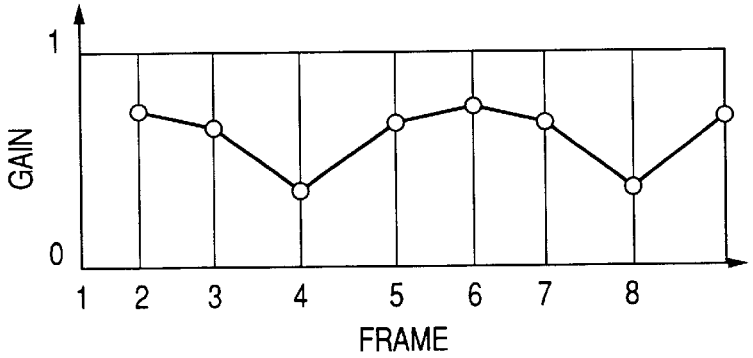
FIGS. 17A and 17B are graphs showing variations in gain in the consecutive frames.
Figure 17B:
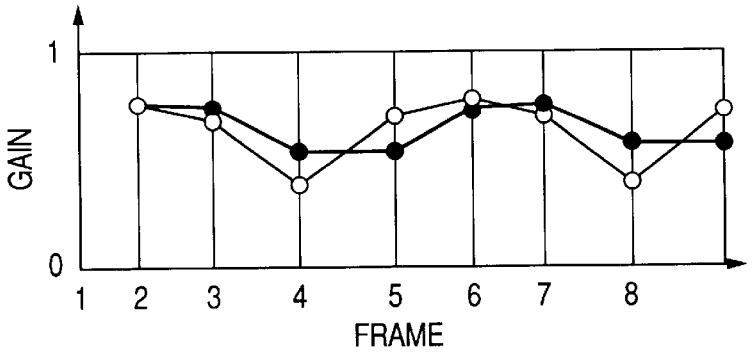

When the motion picture as shown in FIG. 15 is displayed, the maximum values of adjusted image data in consecutive frames vary as shown in FIGS. 17A and 17B.

As shown in FIG. 17A, when gain is set on a frame basis as in Equation 20, since variations in gain between frames become great to make the display image greatly vary in luminance, causing a sense of flicker.

In contrast, when the gain is determined from Equation 21, since the gain is a mean value, variations in gain become small as shown in FIG. 17B to reduce variations in luminance, thus having an excellent effect of reducing the sense of flicker.

In FIG. 17B, one line graph with hollow or white circle marks represents the gain determined from Equation 20 and the other line graph with solidly shaded or black circle marks represents the averaged gain determined from Equation 21.

Although the third method is not discussed here in detail, the inventors have confirmed that since variations in gain and hence the flicker would be reduced by the third method in the same manner as by the second method.

As discussed above, although the gain calculation unit 21 is to average the values of gain for consecutive scenes mentioned above, it is also preferable to smoothly alter the gain after a scene change.

To meet this requirement, the gain calculation unit 21 may be provided with a preset threshold as a scene change threshold Gth. Here, if the gain in the immediately preceding frame calculated from Equation 20 is GB, the gain of the adjusted image data detected by the maximum value detection means 20 and calculated from Equation 20 as the gain in the preceding frame is GN, and an absolute value of difference of GN−GB is ΔG, the absolute value is determined as follows:

$$G\Delta=|GN-GB|$$

In this case, $$\text{if } \Delta G=|GN-GB|>G\text{th, Gain } G1=(GN-GB)\times A+GB\text{, while if } \Delta G=|GN-GB|\leqq G\text{th, Gain } G1=(GN-GB)\times B+GB$$

(where A and B are real numbers that meet a relation of $1\geqq A\geqq B\geqq 0$).

As a result, it is fount preferable to smoothen and determine the gain in the next frame from the above-mentioned calculation.

Especially, it is found preferable to set the values of A and B to the following: A=1 and B=1/16 to 1/64.

It should be noted that judgment of a scene change and calculation of gain are not limited to the above configuration, and another configuration to be described later in the eighth embodiment may be used for these detections.

(Multiplier)

The gain G1 calculated by the gain calculation unit 21 and the adjusted image data Dout as the output of the adder 12 are multiplied by means of the multiplier shown in FIG. 11, and transferred to the limiter as adjusted image data Dmult with the amplitude adjusted.

(Limiter (Limitation means))

Although there is no problem if such gain as not to cause any overflow can be determined in the manner discussed above, it is difficult to determine such gain as to prevent the occurrence of overflow without fail. Therefore, the limiter may be provided for preventing the occurrence of overflow.

The limiter has a preset limit value, and compares the limit value with the output data Dmult inputted to the limiter. When the limit value is smaller than the output data, the limit value is outputted, while when the limit value is larger than the output data, the output data is outputted (note that the output data is denoted as Dlim in FIG. 11).

The adjusted image data Dlim that has been completely confined by the limiter within the input range of the modulator 8 is supplied to the modulator 8 through the sift register and the latch circuit.

(Shift Register and Latch Circuit)

The adjusted image data Dlim outputted from the limiter is inputted into the sift register 5, subjected to serial-parallel conversion from the serial data format to parallel image data ID1–IDN for respective columns of modulation wiring, and outputted to the latch circuit sixth latch circuit 6 latches the data from the sift register 5 in synchronism with the timing signal Dataload just before one horizontal scan interval starts. The outputs of the latch circuit 6 are supplied to the modulator 8 as parallel image data D1–DN.

In the embodiment, each of the image data ID1–IDN and D1–DN is 8-bit image data. The operations of these image data are timed based on the timing control signals TSFT and Dataload from the timing generator 4.

(Details of Modulator)

The parallel image data D1–DN outputted from the latch circuit 6 are supplied to the modulator 8.

Figure 18A:
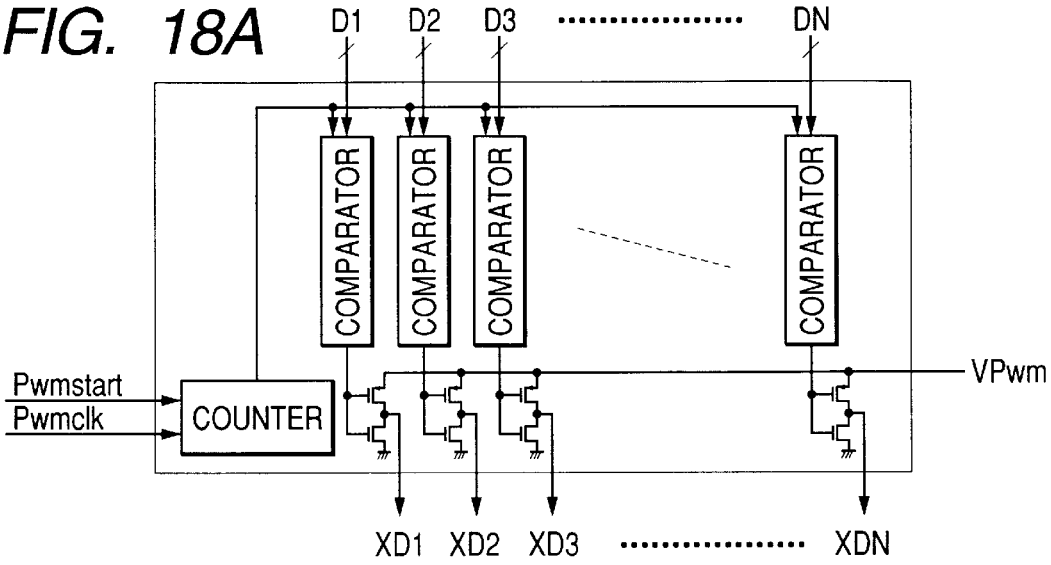
FIGS. 18A, 18B and 18C are diagrams for explaining the structure and operation of a modulator of the image display apparatus.

As shown in FIG. 18A, the modulator 8 is a pulse width modulation circuit (PWM circuit) provided with a PWM counter, and comparators and switches (EFTs in FIG. 18A) for respective columns of modulation wiring.

Figure 18B:
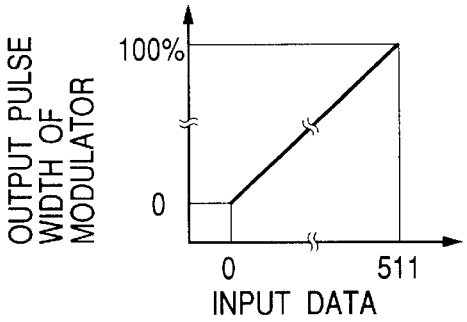

The image data D1–DN and the widths of output pulses from the modulator establish a linear relation as shown in FIG. 18B.

Figure 18C:
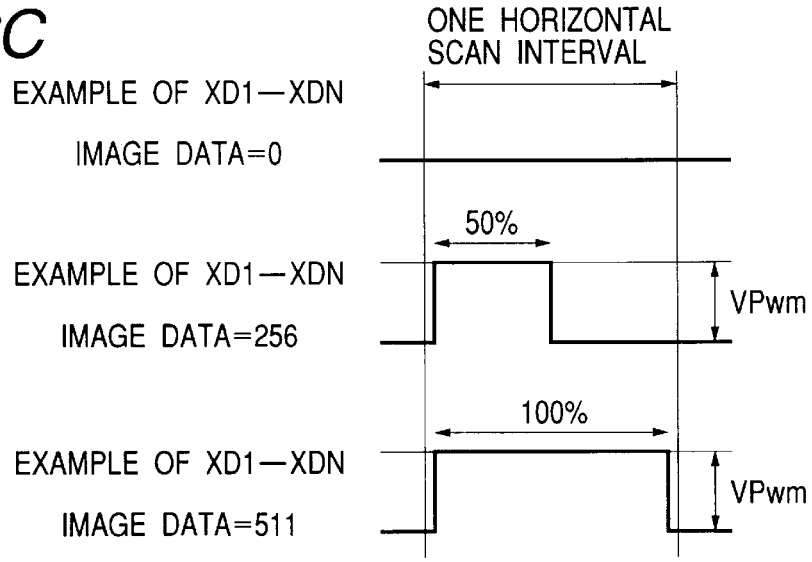

FIG. 18C shows three examples of output waveforms of the modulator.

In FIG. 18C, the waveform shown on the top is a waveform when the size of the input data is 0, the waveform shown in the middle is a waveform when the input data into the modulator is 128, and the waveform on the bottom is a waveform when the input data into the modulator is 255.

It should be noted that in the embodiment the number of bits of the input data D1–DN is 8.

When the size of input data into the modulator is 255, a modulated signal with a pulse width corresponding to one horizontal scan interval is outputted in the above description. To be more specific, very short non-driven periods are given before the pulse rises and after the pulse falls as shown in FIG. 18C, thus allowing for timing delays.

Figure 19:
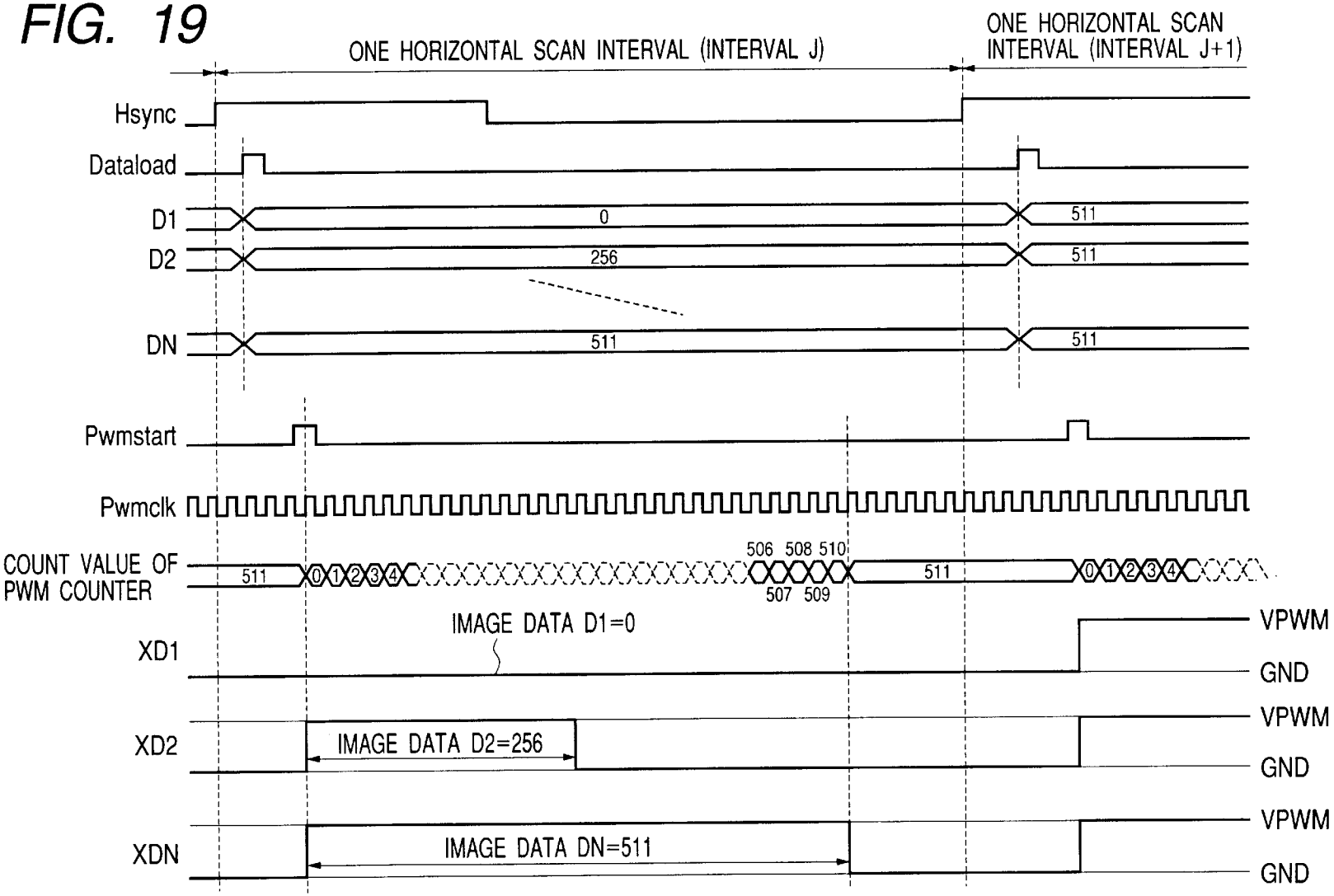
FIG. 19 is a timing chart of the modulator of the image display apparatus.

FIG. 19 is a timing chart showing the operation of the modulator according to the present invention.

In FIG. 19, Hsync denotes the horizontal synchronizing signal, Dataload is the load signal to the latch circuit 6, D1 to DN are the input signals into columns 1 to N of the modulator, Pwmstart is a synchronous clear signal for the PWM counter, and PWmclk is a PWM counter clock. Further, XD to XDN denote outputs of the first to Nth columns of the modulator.

As shown in FIG. 19, once one horizontal scan interval begins, the latch circuit 6 latches image data, and transfers the data to the modulator 8.

The PWM counter starts counting based on Pwmstart and Psmclk as shown, and when the count has reached 255, it stops counting and holds the count value.

The comparator provided for each column compares the count value of the PWM counter with image data in each column, and when the count value of the PWM counter is equal to or larger than the image data, the comparator outputs High, or it outputs Low at other times.

The output of the comparator is connected to the gate of the switch for each column. While the output of the comparator is Low, the upper (Vpwm-side) switch in the drawing is ON and the lower (GND-side) switch is OFF. During this period, the modulation wiring is connected to the voltage Vpwm.

On the other hand, while the output of the comparator is High, the upper switch is OFF and the lower switch is ON.

During this period, the voltage across the modulation wiring is connected to the GND potential.

As a result of the above-mentioned operation of each part, the pulse width-modulated signal outputted from the modulator has such a waveform that the leading edge of each pulse is synchronized as shown by D1, D2, and DN in FIG. 19.

(Adjusted Data Calculation Unit)

Figure 20:
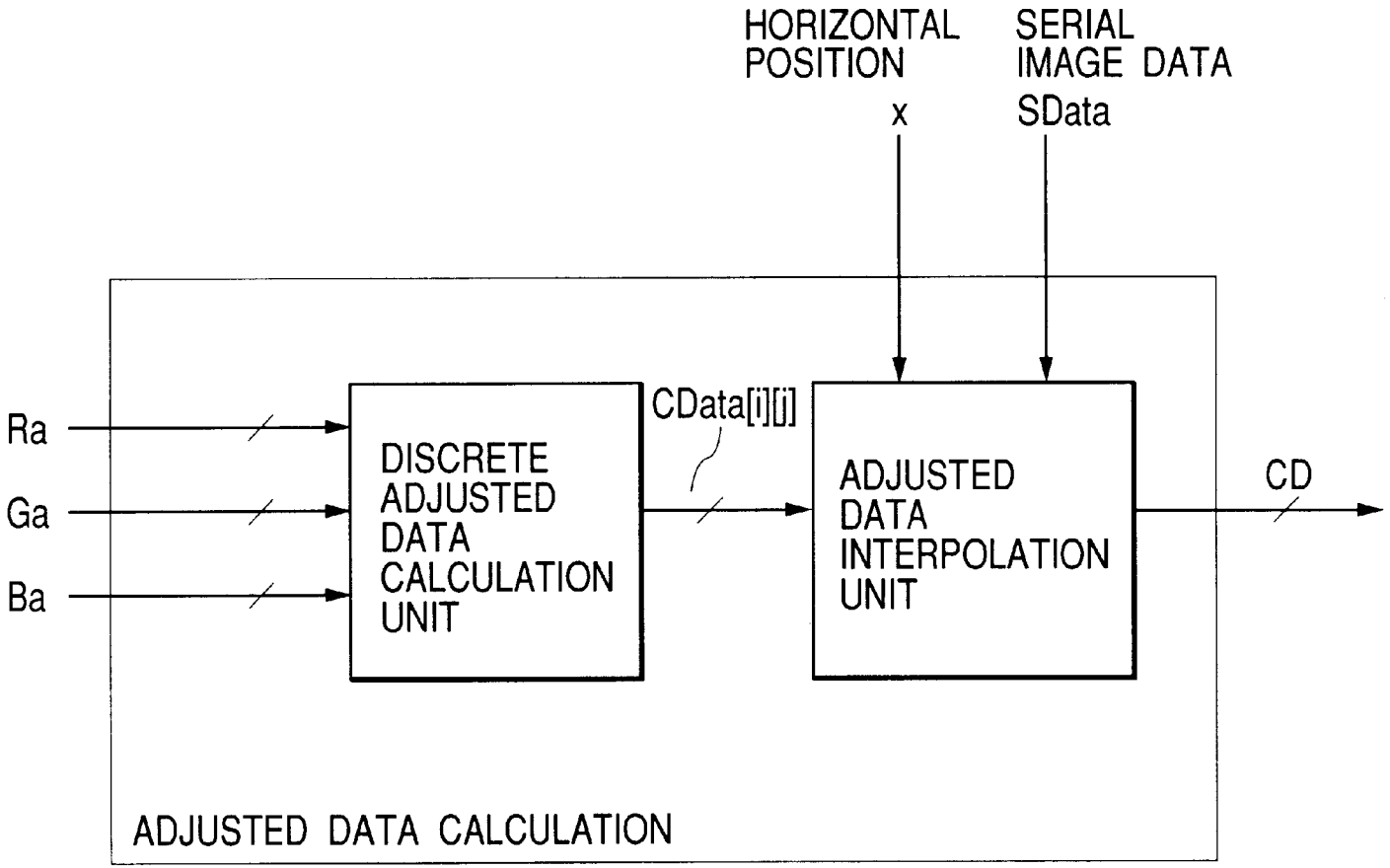
FIG. 20 is a block diagram showing a configuration of an adjusted data calculation unit of the image display apparatus.

The adjusted data calculation unit 14 is a circuit that calculates adjusted data for voltage-drop compensation using the above-mentioned adjusted data calculation method. The adjusted data calculation unit 14 is constituted of two blocks of a discrete adjusted data calculation unit and an adjusted data interpolation unit as shown in FIG. 20.

The discrete adjusted data calculation unit calculates the amount of voltage drop from an input picture signal to discretely calculate adjusted data from the amount of voltage drop. To reduce calculated amounts and the number of hardware components, the discrete adjusted data calculation unit introduces the concept of the above-mentioned degenerate model to calculate adjusted data discretely.

The adjusted data interpolation unit interpolates the adjusted data discretely calculated to calculate adjusted data CD that matches or fits the size of the image data and its horizontal display position x.

(Discrete Adjusted Data Calculation Unit)

Figures 21A, 21B:
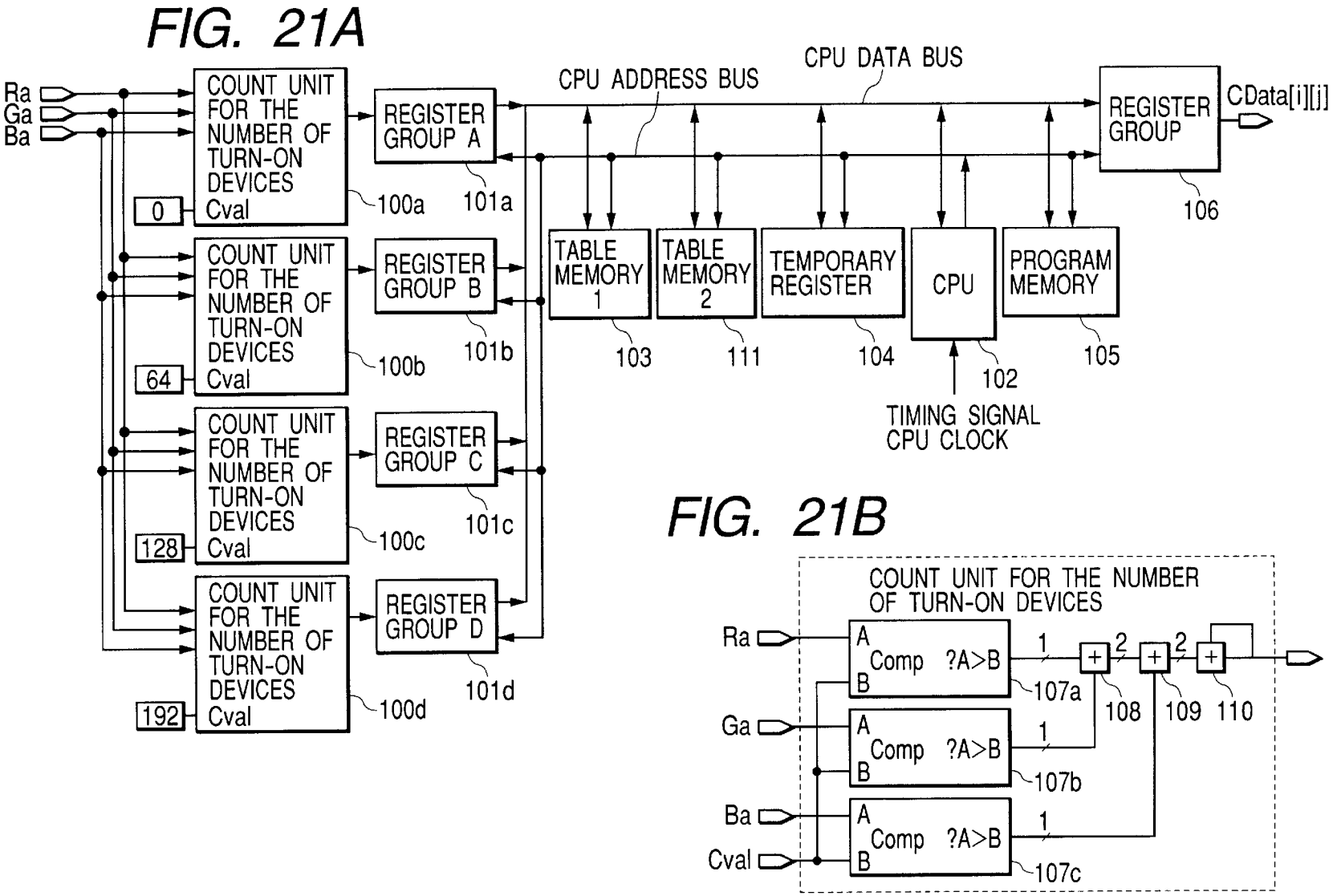
FIGS. 21A and 21B are block diagrams showing a configuration of a discrete adjusted data calculation unit of the image display apparatus.

FIGS. 21A and 21B show configurations of the discrete adjusted data calculation unit for discretely calculating adjusted data according to the present invention.

The discrete adjusted data calculation unit has the following functions: a function as an amount of voltage drop-calculating unit, to be described later, which divides image data into blocks to calculate a statistics value (the number of turn-on devices) on a block basis, and calculates from the statistics value a change of the amount of voltage drop at each node position with respect to time; a function for converting the amount of voltage drop into the emission amount of luminance on a time basis; and a function for integrating calculated emission amounts of luminance in the time direction to calculate the total emission amount of luminance; and a function as means for calculating from the total emission amount of luminance adjusted data at discrete reference points with respect to respective reference values of image data.

As shown in FIG. 21, discrete adjusted data calculation unit includes count units 100*a* to 100*d* for the number of turn-on devices, register groups 101*a* to 101*d* each of which stores the number of turn-on devices in each block at each time point, a CPU 102, and a table memory 103 for storing the parameter aij described in Equation 2 and Equation 3. It also includes a temporary register 104 for temporarily storing calculation results, a program memory 105 in which a program for CPU is stored, a table memory 1eleventhat holds a table in which conversion data for converting the amount of voltage drop into the emission amount of current is described, and a register group 106 for storing calculation results of discrete adjusted data as mentioned above.

Each of the count units 100*a* to 100*d* for the number of turn-on devices is mainly constituted of comparators and adders as shown in FIG. 21B. Picture signals Ra, Ga, and Ba are inputted into the comparators 107*a* to 107*c*, and compared with Cval consecutively.

It should be noted that Cval corresponds to a reference value set for each image data as mentioned above.

Each of the comparators 107*a* to 107*c* compares Cval with image data to output High when the image data is larger or Low when the image data is smaller.

The adders 108 and 109 add the outputs of the comparators, and the adder 110 determines the sum of the outputs on a block basis. The addition result in each block is then stored in each of the register groups 101*a* to 101*d* as the number of turn-on devices in the block.

Values 0, 64, 128, and 192 are inputted, as comparative values Cval for the comparators, to the count units 100*a* to 100*d* for the number of turn-on devices, respectively.

As a result, the count unit 100*a* for the number of turn-on devices counts image data larger in size than 0, and stores the count value in the register group 101*a* on a block basis.

Similarly, the count unit 100*b* for the number of turn-on devices counts image data larger in size than 64, and stores the count value in the register group 101*b* on a block basis.

Similarly, the count unit 100*c* for the number of turn-on devices counts image data larger in size than 128, and stores the count value in the register group 101*c* on a block basis.

Similarly, the count unit 100*d* for the number of turn-on devices counts image data larger in size than 192, and stores the count value in the register group 101*d* on a block basis.

Every time the number of turn-on devices is counted for each block at each time point, the CPU reads out the parameter table aij stored in the table memory 103, calculates the amount of voltage drop according to Equation 2 to Equation 5, and stores the calculation results in the temporary register 104.

In the embodiment, the CPU is provided with a function for product sum calculation so that the calculation of Equation 2 will be smoothly performed.

To solve Equation 2, the calculation results may be held in advance in a memory to eliminate the need for the CPU to perform the product sum calculation.

In other words, when the number of turn-on devices in each block is inputted, the amount of voltage drop at each node with respect to all possible input patterns may be prestored in the memory.

After completion of calculation of the amount of voltage drop, the CPU reads out the amount of voltage drop for each block at each time point from the temporary register 104, refers to the table memory 2 (111) to convert the amount of voltage drop into the emission amount of current, and calculates discrete adjusted data according to Equation 6 to Equation 16.

The discrete adjusted data calculated is then stored in the register group 106.

(Adjusted Data Interpolation Unit)

The adjusted data interpolation unit is means for calculating adjusted data corresponding to the position (horizontal position) and size of image data to be displayed. The adjusted data interpolation unit interpolates adjusted data discretely calculated to calculate the adjusted data corresponding to the position (horizontal position) and size of the image data.

Figure 22:
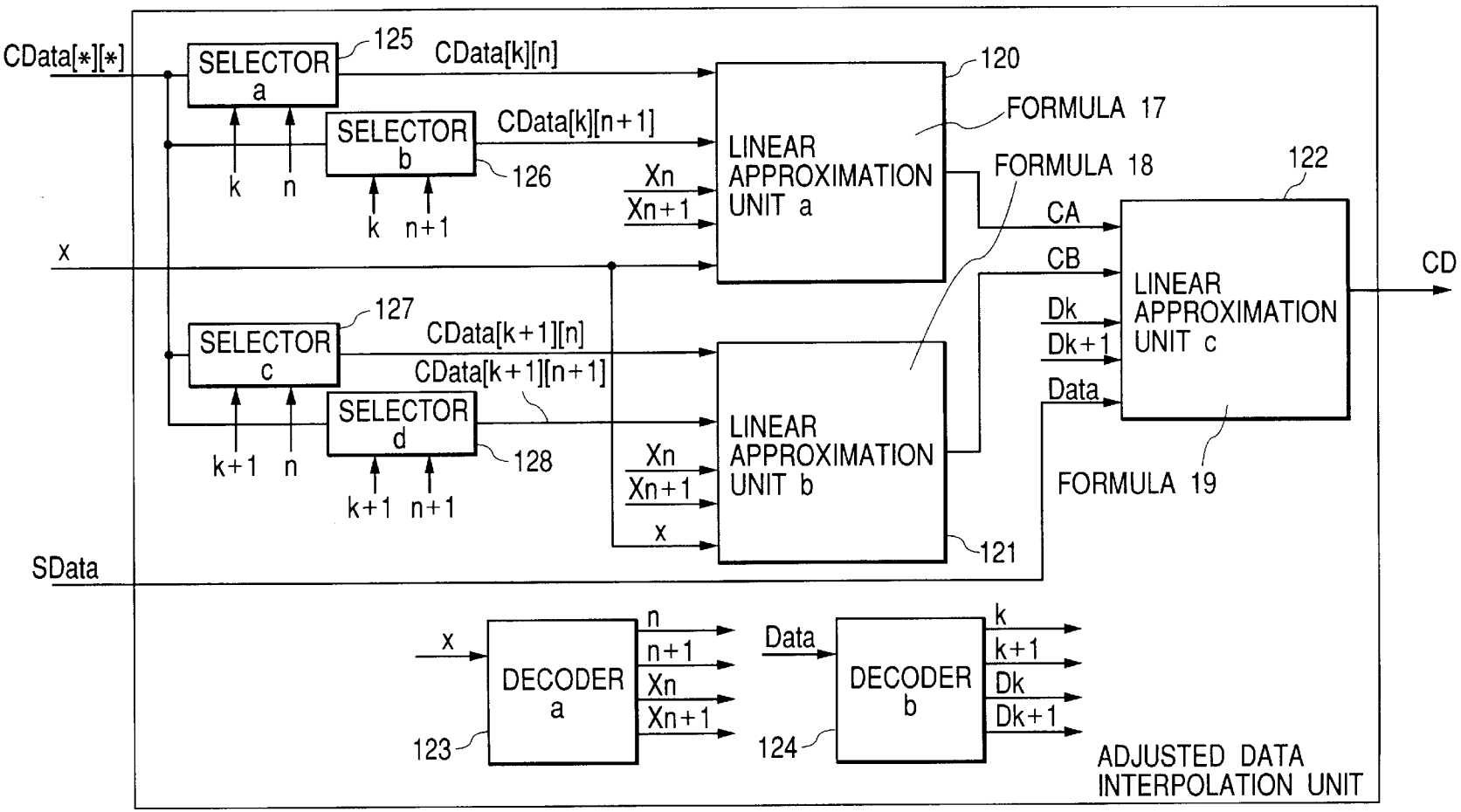
FIG. 22 is a block diagram showing a configuration of an adjusted data interpolation unit.

FIG. 22 is a diagram for explaining the adjusted data interpolation unit.

In FIG. 22, a decoder 123 determines, from the display position (horizontal position) x of the image data, node number n and n+1 of the discrete adjusted data on which interpolation is performed. A decoder 124 determines k and k+1 in Equation 17 to Equation 19 from the size of the image data.

Sectors 125 to 128 select discrete adjusted data and supply the selected data to linear approximation units 120 and 121.

The linear approximation units 120 to 122 are linear approximation units a to c that make linear approximations of Equation 17 to Equation 19, respectively.

Figure 23:
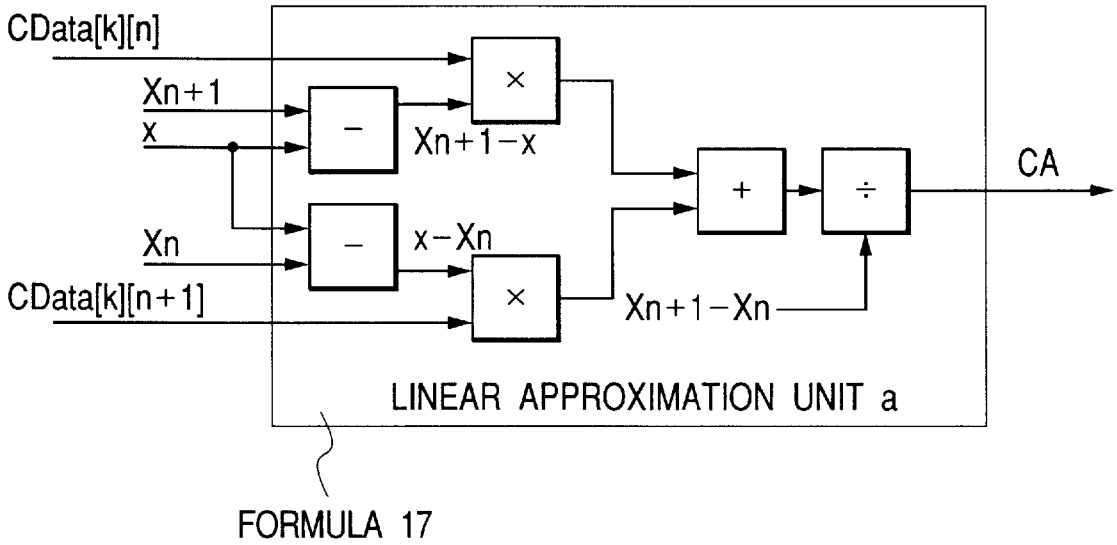
FIG. 23 is a block diagram showing a configuration of a linear approximation unit.

FIG. 23 shows a configuration of the linear approximation unit a. It is apparent from operators in Equation 17 to Equation 19 that the linear approximation unit can be typically constituted of subtracters, multipliers, an adder, and a divider.

It is preferable that the number of columns between nodes at which discrete adjusted data are calculated and/or the interval of a reference value of image data on which the calculation of discrete adjusted data is performed (that is, the time interval during which the amount of voltage drop is calculated) should be set to powers of 2. This setting has the advantage of making the hardware very simple. In other words, if they are set to powers of 2, since Xn+1−Xn takes a power of 2 in the divider, only the bit-shift is needed.

Thus, if Xn+1−Xn always takes a fixed value represented by the power of 2, the addition result from the adder can be outputted merely by performing bit shift by the number of powers of 2, thereby eliminating the need to insert the divider in the configuration.

Setting the interval between nodes at which discrete adjusted data are calculated and/or the interval of image data to powers of 2 also makes it easy to design any other component, which brings many advantages. For example, the decoders 123 and 124 can be designed in a simpler way, calculations performed by the subtracters can be replaced with simple bit operations, and so on.

(Operation Timing of Each Part)

Figure 24B:
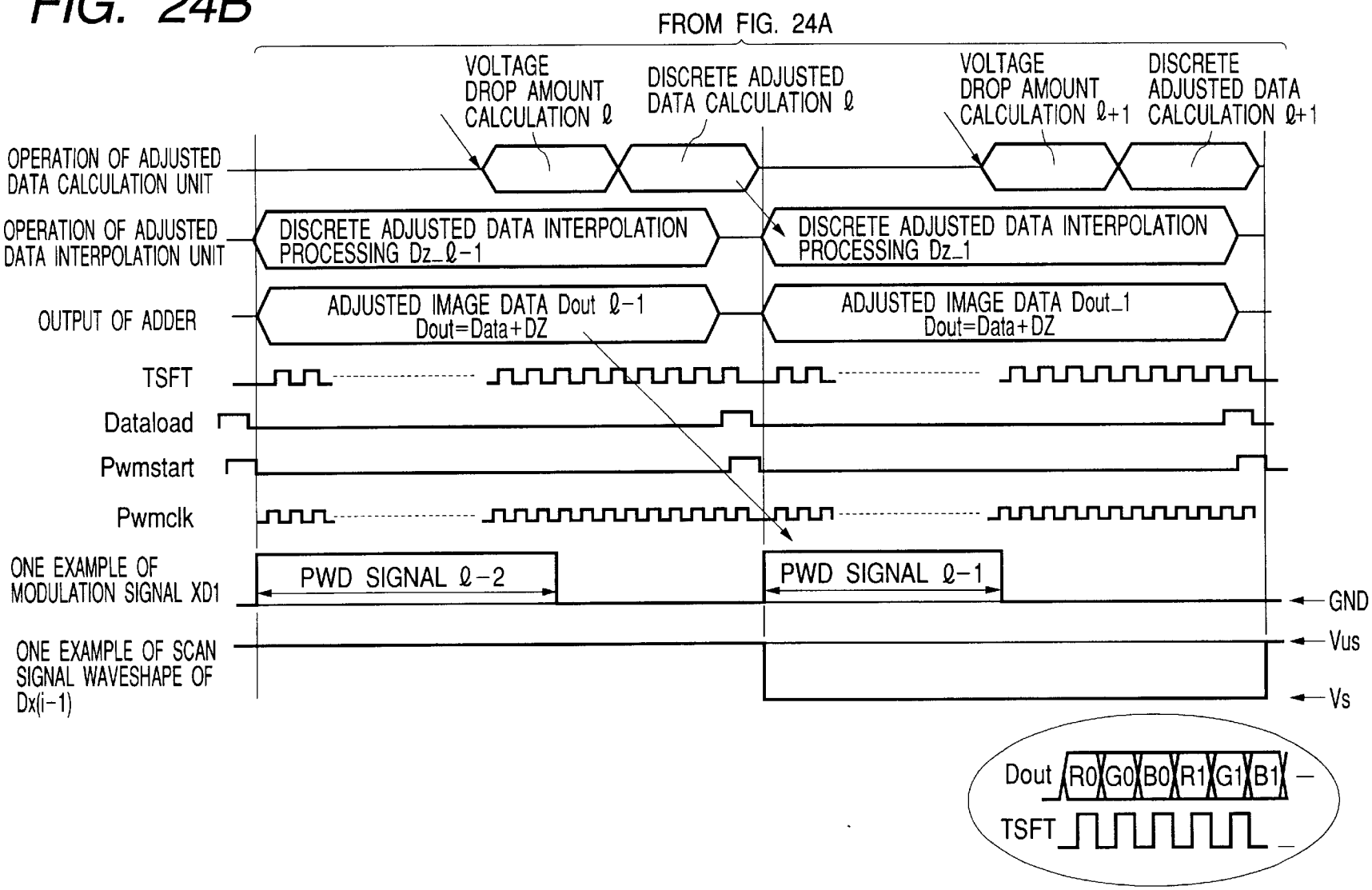
FIG. 24 is comprised of FIGS. 24A and 24B showing a timing chart of the image display apparatus.

FIGS. 24A and 24B are timing charts showing operation timing of each part.

In FIGS. 24A and 24B, Hsync denotes the horizontal synchronizing signal, DotCLK is a clock created from the horizontal synchronizing signal Hsync by a PLL circuit in the timing generator, R, G, and B are digital image data from an input switching circuit, Data is image data after subjected to data alignment conversion, Dlim is the output of the limiter as adjusted image data that has been subjected to voltage drop compensation, TSFT is the shift clock for transferring the adjusted image data Dlim to the shift register 5, Dataload is the load pulse for latching data to the latching circuit 6, Pwmstart is the above-mentioned pulse width modulation starting signal, and modulated signal XD1 is an example of the pulse width-modulated signal to be supplied to the modulation wiring 1.

In operation, once one horizontal scan interval begins, digital image data RGB are transferred from the selector 23. If the image data inputted in the horizontal scan interval are denoted by R_I, G_I, and B_I in FIGS. 24A and 24B, these image data are accumulated in the data alignment conversion unit 9 during the horizontal scan interval I, and outputted as digital image data Data_I at the beginning of the next horizontal scan interval I+1 in alignment with the pixel array on the display panel.

The image data R_I, G_I, and B_I are inputted into the adjusted data calculation unit 14 in the horizontal scan interval I. The adjusted data calculation unit 14 counts the number of turn-on devices as mentioned above, and calculates the amount of voltage drop as soon as the counting is completed.

After calculating the amount of voltage drop, the adjusted data calculation unit 14 calculates discrete adjusted data, and stores the calculation result into the register.

Then, the scan interval goes to I+1, the adjusted data interpolation unit interpolates the discrete adjusted data in synchronism with the output of the image data Data_I in the immediately preceding horizontal scan interval to calculate adjusted data. The adjusted data that has been subjected to interpolation is supplied to the adder 12.

The adder 12 adds the image data Data and the adjusted data CD in sequence, and transfers the adjusted image data Dlim to the shift register 5. The shift register 5 stores and serial-parallel converts the adjusted image data Dlim for one horizontal scan period according to TSFT to output parallel image data ID1 to IDN to the latch circuit 6. The latch circuit 6 latches the parallel image data ID1 to IDN from the shift register 5 in synchronism with the rise time of Dataload, and transfers the latched image data D1 to DN to the pulse width modulator 8.

The pulse width modulator 8 outputs a pulse width-modulated signal with a pulse width corresponding to the latched image data. As a result, the pulse width outputted from the modulator is displayed in the image display apparatus in the embodiment with a delay corresponding to two horizontal scan intervals.

When images are displayed in such an image display apparatus, the amount of voltage drop in the scan wiring that has been the problem in the conventional apparatuses can be compensated for, so that the degradation of the display images resulting from the voltage drop can be improved, thereby displaying excellent images.

Further, the introduction of some approximations makes it easy to properly calculate the amount of adjustment of image data to be compensated for the voltage drop in a very simple hardware configuration.

(Second Embodiment)

In the first embodiment, the maximum value of adjusted image data is detected to calculate such gain that the maximum value will correspond to the maximum value in the input range of the modulator. The adjusted image data is multiplied by the gain to prevent the occurrence of overflow.

In contrast, in the second embodiment, although the maximum value of adjusted image data is detected in the same manner, the size of image data before adjusted is so limited that the maximum value will correspond to the maximum value in the input range of the modulator.

In other words, the gain and image data already inputted are multiplied together to narrow down the amplitude range and hence prevent the occurrence of overflow.

Figure 25:
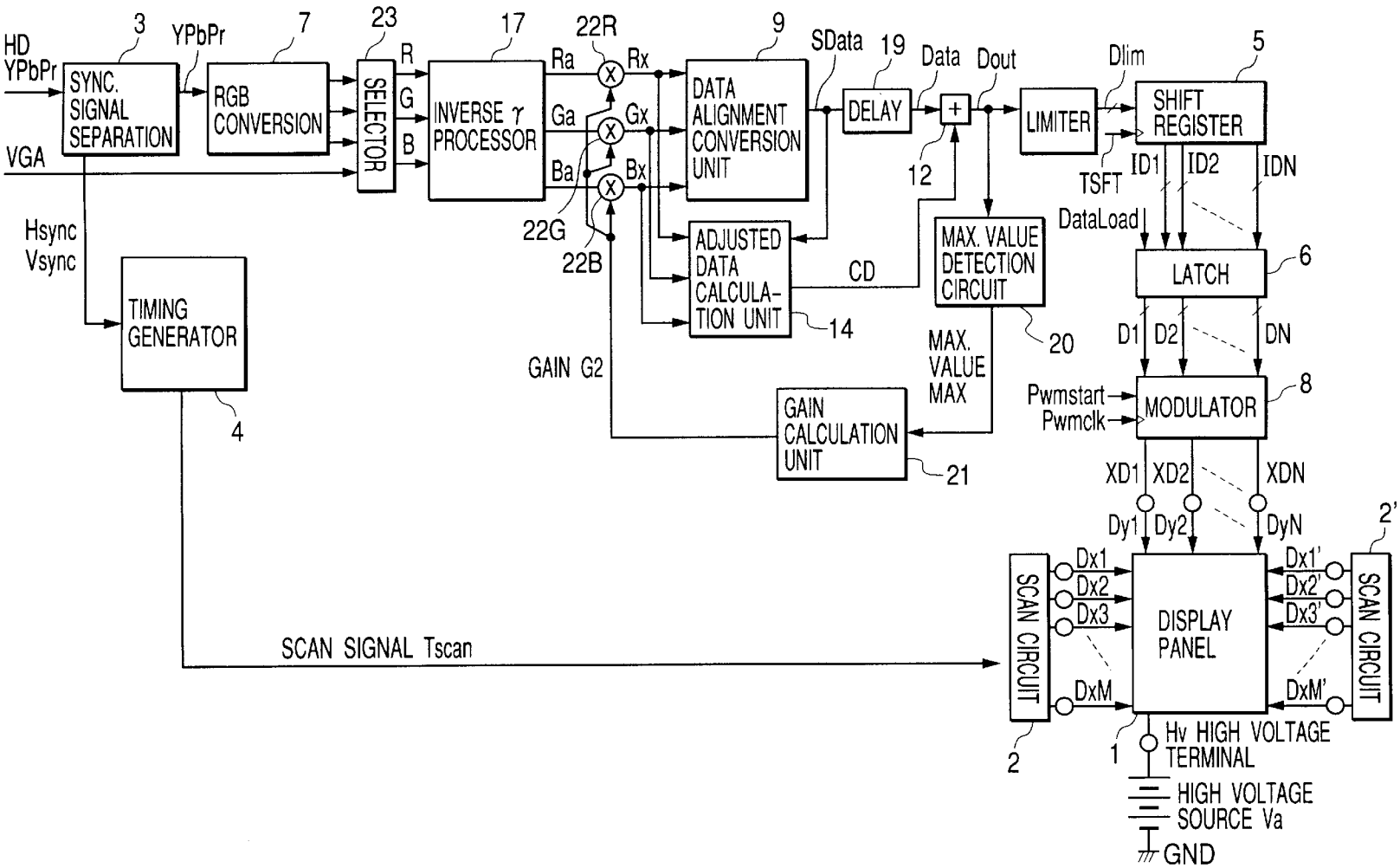
FIG. 25 is a block diagram showing a schematic configuration of an image display apparatus according to a second embodiment of the present invention.

Referring now to FIG. 25, overflow processing according to the embodiment will be described.

Shown in FIG. 25 are multipliers 22R, 22G, and 22B, the data alignment conversion unit 9, the sift register 5 for one line of image data, the latch circuit 6 for one line of image data, the pulse width modulator 8 for outputting a modulation signal to the modulation wiring of the display panel, the adder 12, the adjusted data calculation unit 14, the maximum value detection circuit (unit) 20 for detecting the maximum value of adjusted image data Dout in a frame, and the gain calculation unit 21.

Further, R, G, and B denote RGB parallel input picture data, Ra, Ga, and Ba are RGB parallel picture data that have been subjected to inverse γ conversion, Rx, Gx, and Bx are image data that have been multiplied by gain G2 by means of the multipliers, gain G2 is gain calculated by the gain calculation unit 21, Data is image data parallel-serial converted by the data alignment conversion unit 9, CD is adjusted data calculated by the adjusted data calculation unit 14, Dout is image data (adjusted image data) adjusted by the adder 12 adding the image data Data and the adjusted data CD, Dlim is adjusted image data obtained by the limiter limiting Dout to a value below the upper limit of the input range of the modulator.

(Multipliers 22R, 22G, and 22B)

The multipliers 22R, 22G, and 22B multiply image data Ra, Ga, and Ba by gain G2, where the image data Ra, Ga, and Ba have been subjected to inverse γ conversion.

To be more specific, the multipliers multiply image data by gain G2 according to the gain determined by the gain calculation unit 21, and output image data Rx, Gx, and Bx after multiplied.

The gain G2 is a value calculated by the gain calculation unit 21 and so determined that adjusted image data Dout as a result of the addition of image data Data and adjusted data CD performed by the adder 12, to be described later, will fall within the input range of the modulator 8.

(Maximum Value Detection means (Maximum Value Detection Circuit))

The maximum value detection circuit 20 will be described below.

The maximum value detection circuit 20 according to the present invention is connected to each part as shown in FIG. 25.

The maximum value detection circuit 20 is a circuit for detecting the maximum value from among values of adjusted image data Dout outputted in one frame, and the structure and operation of the maximum value detection circuit 20 is the same as those in the first embodiment. The detected maximum value MAX of adjusted image data is transferred to the gain calculation unit 21.

(Gain Calculation Means (Gain Calculation Unit))

The gain calculation unit 21 is means that refers to the value MAX detected by the maximum value detection circuit 20 to calculate such gain that the adjusted image data Dout will fall within the input range of the modulator 8. Like in the first embodiment, the gain calculation unit 21 according to this embodiment calculates gain for adjusting the amplitude based on the adaptive gain method.

Alternatively, in the configuration of this embodiment (FIG. 25), the gain may be calculated by the fixed gain method.

If the maximum value detected by the maximum value detection circuit 20 is MAX, the maximum value of the input range of the modulator 8 is INMAX, and the gain G2 calculated by the gain calculation unit 21 for the preceding frame is GB, the gain can be determined in the following manner:

$$\text{Gain } G2 \leqq (\text{INMAX}/\text{MAX}) \times GB \qquad \text{(Eq. 22)}$$

The gain calculation unit 21 updates the gain during a vertical return interval to change the gain value on a frame basis.

In the configuration of the image display apparatus according to the embodiment, the maximum value of the adjusted image data in the immediately preceding frame is used to calculate gain by which the adjusted image data in the current frame is multiplied (that is, it uses a correlation between adjusted image data (image data) of adjacent frames to prevent the occurrence of overflow).

In such a configuration, an overflow may take place because the values of adjusted image data vary from frame to frame in the strict sense.

To cope with this problem, a circuit design is found further preferable in which a limiter is provided to the output of the multiplier for multiplying the adjusted image data and the gain together so that the output of the multiplier will fall within the input range of the modulator.

Like in the first embodiment, the inventors have also considered another effect of preventing flicker. For this, atoner determination method may be employed, in which the maximum values of adjusted image data detected in frames previous to the current frame are averaged to obtain a mean value AMAX so that the gain G2 will be determined from the mean value AMAX as follows:

$$\text{Gain } G2 \leqq (\text{INMAX}/\text{AMAX}) \times GB \qquad \text{(Eq. 23)}$$

where GB is the gain G2 calculated by the gain calculation unit for the immediately preceding frame.

As still another method, the gain G2 may be calculated from Equation 22 on a frame basis, and averaged to determine gain for the current frame.

Although the inventors have confirmed that all the three methods would be advantageous for preventing the occurrence of overflow, it is preferable to calculate the gain after the maximum values are averaged in view of allowance for occurrence of flicker as described in the first embodiment.

The inventors have examined the number of frames for which the maximum values of adjusted image data are averaged by the gain calculation method using Equation 23, and have found that it is preferable to average the maximum values of adjusted image data 16 to 64 frames previous to the current frame.

Figure 27:
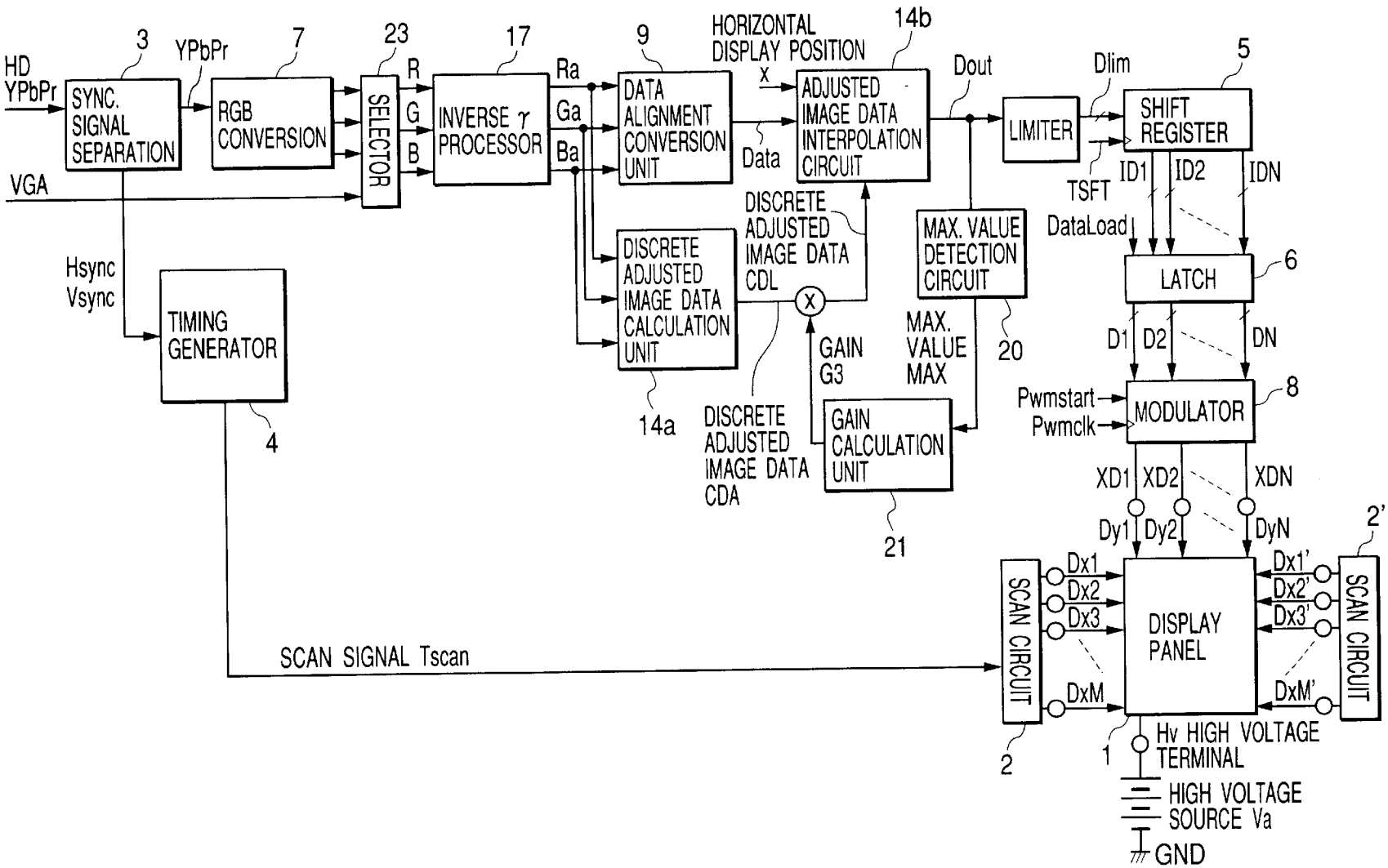
FIG. 27 is a block diagram showing a schematic configuration of an image display apparatus according to a fourth embodiment of the present invention.

Even in this method, it is further preferable to provide a limiter for limiting the output of the adder as shown in FIG. 27 so as to completely prevent the occurrence of overflow.

Like in the first embodiment, a scene change may also be detected to alter the gain calculation method.

(Third Embodiment)

In the first embodiment, reference values of discrete image data are set for input image data, and reference points are set on the row wiring, so that adjusted data is calculated at each reference point for the image data the size of which takes a corresponding reference value.

Further, the adjusted data discretely calculated is interpolated to calculate adjusted data according to the horizontal display position and size of the input image data, so that the adder adds the image data and the adjusted data calculated, thus making a correction to the image data.

Figure 26:
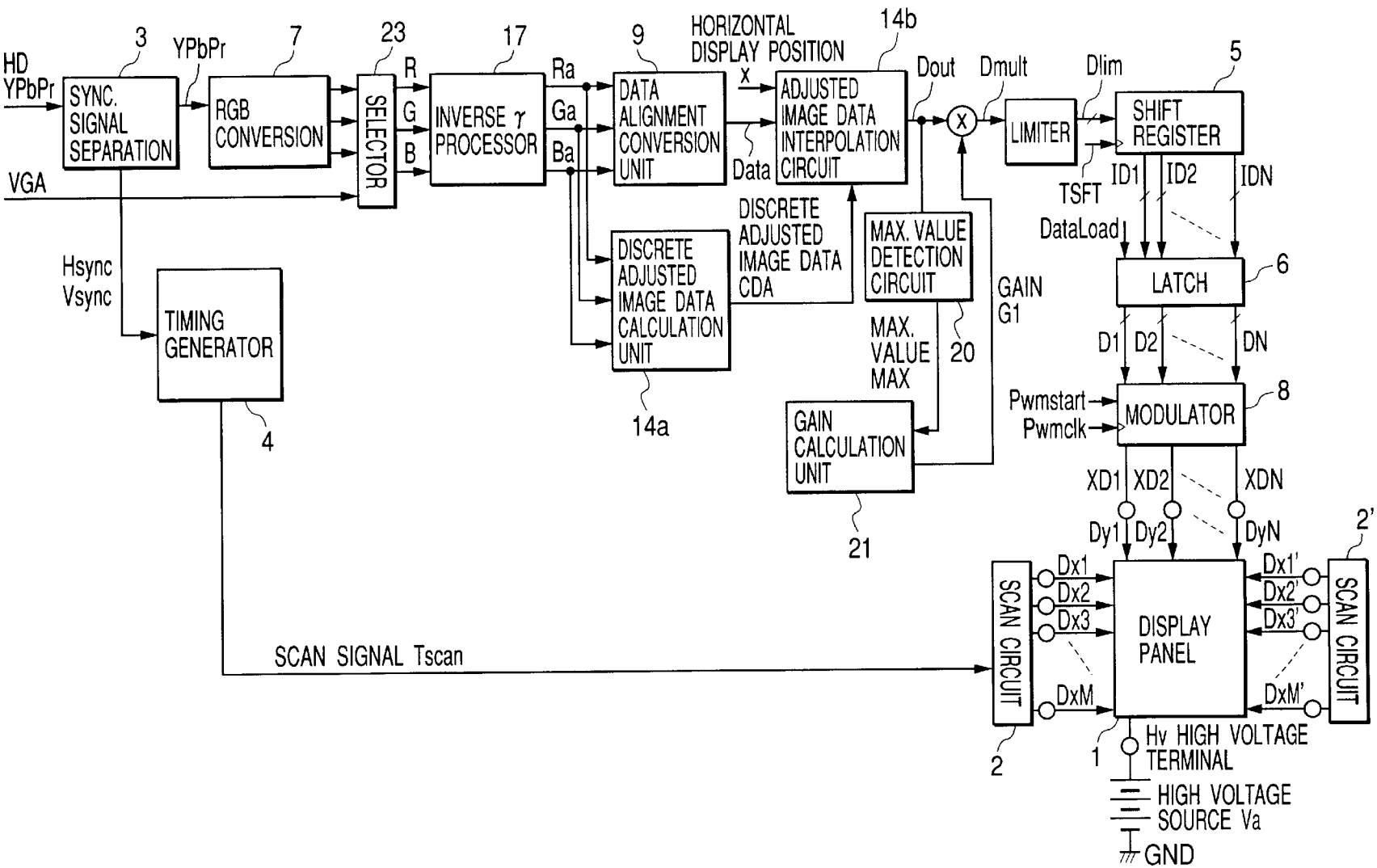
FIG. 26 is a block diagram showing a schematic configuration of an image display apparatus according to a third embodiment of the present invention.

On the other hand, a configuration shown in FIG. 26 can also makes a correction to the image data in the same manner. Referring to FIG. 26, the third embodiment will be described below.

Points in which FIG. 26 differs from FIG. 11 are that the adjusted data calculation unit 14 and the adder 12 are eliminated, and a discrete adjusted image data calculation unit 14*a* and an adjusted image data interpolation circuit 14*b* are newly provided instead.

The following will describe a flow of calculation of adjusted image data in the image display apparatus of FIG. 26.

(1) Discrete adjusted image data CDA (that is, an adjustment result as the sum of the discrete adjusted data and the reference value of the image data) is calculated at each discrete horizontal position for the reference value of the image data (discrete adjusted image data calculation unit).

(2) The adjusted image data discretely calculated is interpolated to calculate adjusted image data according to the size of input image data Data and its horizontal display position x (adjusted image data interpolation circuit).

(3) The maximum value of the adjusted image data thus interpolated is detected (maximum value detection circuit) to calculate such gain G1 that the detected maximum value will fall within the input range of the modulator (gain calculation unit). The gain G1 calculated and the adjusted image data Dout are multiplied together (multiplier), and the amplitude of the adjusted image data is limited by the limiter and inputted to the shift register, the latch circuit, and the modulator in this order.

The calculation of the discrete adjusted image data CDA described in Paragraph (1) can be easily made by modifying the above-mentioned discrete adjusted data calculation method (Equation 6 to Equation 16).

In other words, since the above-mentioned equations 6 to 16 are to calculate discrete adjusted data for each of the image data reference values 0, 64, 128, and 192, the sum of the discrete adjusted data and each of the image data reference values can be set as the discrete adjusted image data CDA.

In such a configuration, adjusted image data obtained by adding image data and adjusted data is calculated at the discrete calculation stage, which eliminates the need to add the image data and the adjusted data after interpolation. Therefore, the adder 12 in FIG. 11 becomes unnecessary.

The adjusted image data interpolation circuit 14*b* can be constituted in the same manner as the adjusted data interpolation unit of FIG. 22 described in the first embodiment.

The above-mentioned configuration is also found preferable to proper compensation for the influence of voltage drop.

In the embodiment, the configuration according to the first embodiment is adopted for preventing the occurrence of overflow, but the present invention is not limited thereto, and the configuration according to the second embodiment can also be adopted.

(Fourth Embodiment)

In the third embodiment, reference values of discrete image data are set for input image data, and reference points are set on the row wiring, so that adjusted image data is calculated at each reference point for the image data the size of which takes a corresponding reference value.

Further, the adjusted image data discretely calculated is interpolated to calculate adjusted image data according to the horizontal display position and size of the input image data.

Further, the adjusted image data Dout calculated is multiplied by gain to adjust the amplitude of the adjusted image data Dout in such a manner that the adjusted amplitude will fall within the input range of the modulator.

The gain is so calculated from Equation twenty-secondat the maximum value of adjusted image data in the immediately preceding frame will correspond to the maximum value of the input range of the modulator.

The gain may also be calculated from Equation 23 for another purpose of preventing a sense of flicker.

On the other hand, a configuration shown in FIG. 27 can also have the same effect. Referring to FIG. 2seventhe fourth embodiment will be described below.

A point in which FIG. 27 differs from FIG. 26 is that the discrete adjusted image data CDA is multiplied by the gain value calculated by the gain calculation unit 21.

Multiplication of gain makes it possible to adjust the amplitude of the discrete adjusted image data CDA and output the same as CDL to the adjusted image data interpolation circuit 14*b*.

The adjusted image data interpolation circuit 14*b* calculates adjusted image data Dout according to the size of the input image data Data and its horizontal display position x on the basis of CDL as the discrete adjusted image data Dout the amplitude of which has been adjusted.

The output Dout of the adjusted image data interpolation circuit 14*b* is an output the amplitude of which has been already adjusted to fall within the input range of the modulator.

In the strict sense, gain G3 by which the discrete adjusted image data is multiplied is determined as follows:

$$\text{Gain } G3 \leqq (\text{INMAX}/\text{AMAX}) \times GB \quad \text{(Eq. 24)}$$

Alternatively, for the purpose of preventing the sense of flicker, gain G3 is determined as follows:

$$\text{Gain } G3 \leqq (\text{INMAX}/\text{AMAX}) \times GB \quad \text{(Eq. 25)}$$

In the above-mentioned equations, the parameters denote the following:

INMAX is the maximum value of the input range of the modulator;

MAX is the maximum value of adjusted image data Dout for each frame;

AMAX is a mean value of the maximum values MAX for foregoing frames; and

GB is gain G3 calculated by the gain calculation unit for the immediately preceding frame.

Thus, the above-mentioned configuration can considerably reduce the frequency of occurrence of overflow, but not completely prevent the occurrence of overflow.

Therefore, even in this configuration, it is preferable to provide a limiter between the adjusted image data interpolation circuit 14*b* and the sift register 5 so as to create adjusted image data Dlim having an amplitude range that matches the input range of the modulator.

Although the limiter is placed in the position shown in FIG. 2seventhe present invention is not limited thereto.

For example, instead of providing the limiter shown in FIG. 27, another limiter may be so provided that the discrete adjusted image data CDL will fall within the input range of the modulator. This configuration can also have the same effect.

(Fifth Embodiment)

In the first embodiment, the fixed gain method and the adaptive gain method are described as methods of determining a gain.

The adaptive gain method is a method in which the maximum value of adjusted image data is detected on a frame basis to adaptively calculate such gain as not to cause overflow.

In the adaptive gain method, since the range is adaptively adjusted for both bright and dark images, the adaptive gain method has the advantage over the fixed gain method that it can make display images brighter. On the other hand, the adaptive gain method has the disadvantage that variations in luminance due to the above-mentioned variations in gain may occur.

The inventors have further examined the circumstances under which variations in luminance occur, and have found that the variations in luminance due to the variations in gain are not so offensive to the eye when television picture is displayed, but it becomes very offensive to the eye when computer-outputted picture is displayed.

For example, a window screen typical of computer-outputted picture is assumed here.

As an example, a white window (R, G, B)=(FFh, FFh, FFh) against a green background (8 bits where (R, G, B)=(0, FFh, 0) is considered. This example is called display pattern 1 below.

In this case, an area in which the maximum adjusted image is found in the frame is the display area of the white window.

Then, when the white window is closed to leave the green background alone (hereinafter, called display pattern 2), the maximum value of adjusted image data is determined by the green background.

In the image display apparatus according to the present invention, since the display pattern 1 is larger in the maximum value of adjusted image data than the display pattern 2, the gain relationship is: "Gain of Display Pattern 1"<"Gain of Display Pattern 2".

Therefore, the area of the green background in the display pattern 1 becomes darker than that in the display pattern 2.

If the display pattern 1 is changed to the display pattern 2 in rapid succession, closing the white window turns the brightness of the green background area up.

Such an uncomfortable feeling caused by the variation in brightness can be lessened by performing the above-mentioned gain averaging processing. However, since picture signals such as computer picture signals having relatively even sizes vary in luminance though the variations are very gentle, the gain averaging processing is not enough in this case.

From this standpoint, the inventors have found that it is preferable to use the fixed gain method for gain calculation when computer picture signals are displayed, and the adaptive gain method for gain calculation when television picture signals are displayed.

Figure 28:
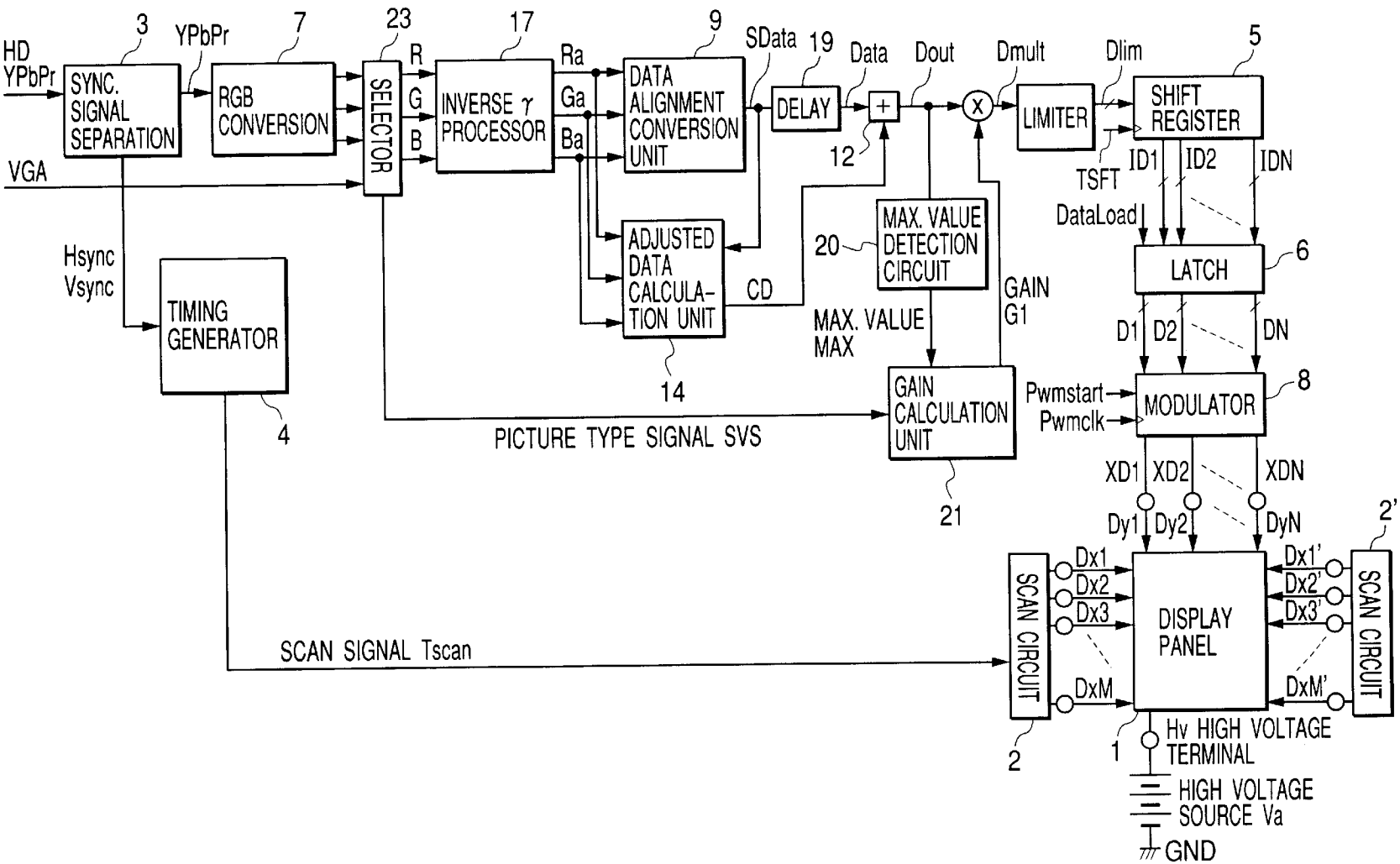
FIG. 28 is a block diagram showing a schematic configuration of an image display apparatus according to a fifth embodiment of the present invention.

FIG. 28 shows a configuration of an image display apparatus according to this embodiment.

A point in which FIG. 28 differs from the entire system diagram (FIG. 11) is that picture type signal SVS for a picture signal selected from the selector 23 is supplied to the gain calculation unit 21.

According to the picture type signal SVS, the gain calculation unit 21 calculates gain G1 by the fixed gain method when the picture signal to be displayed is a computer picture output, and by the adaptive gain method when the picture signal is a television picture signal.

Figure 29:
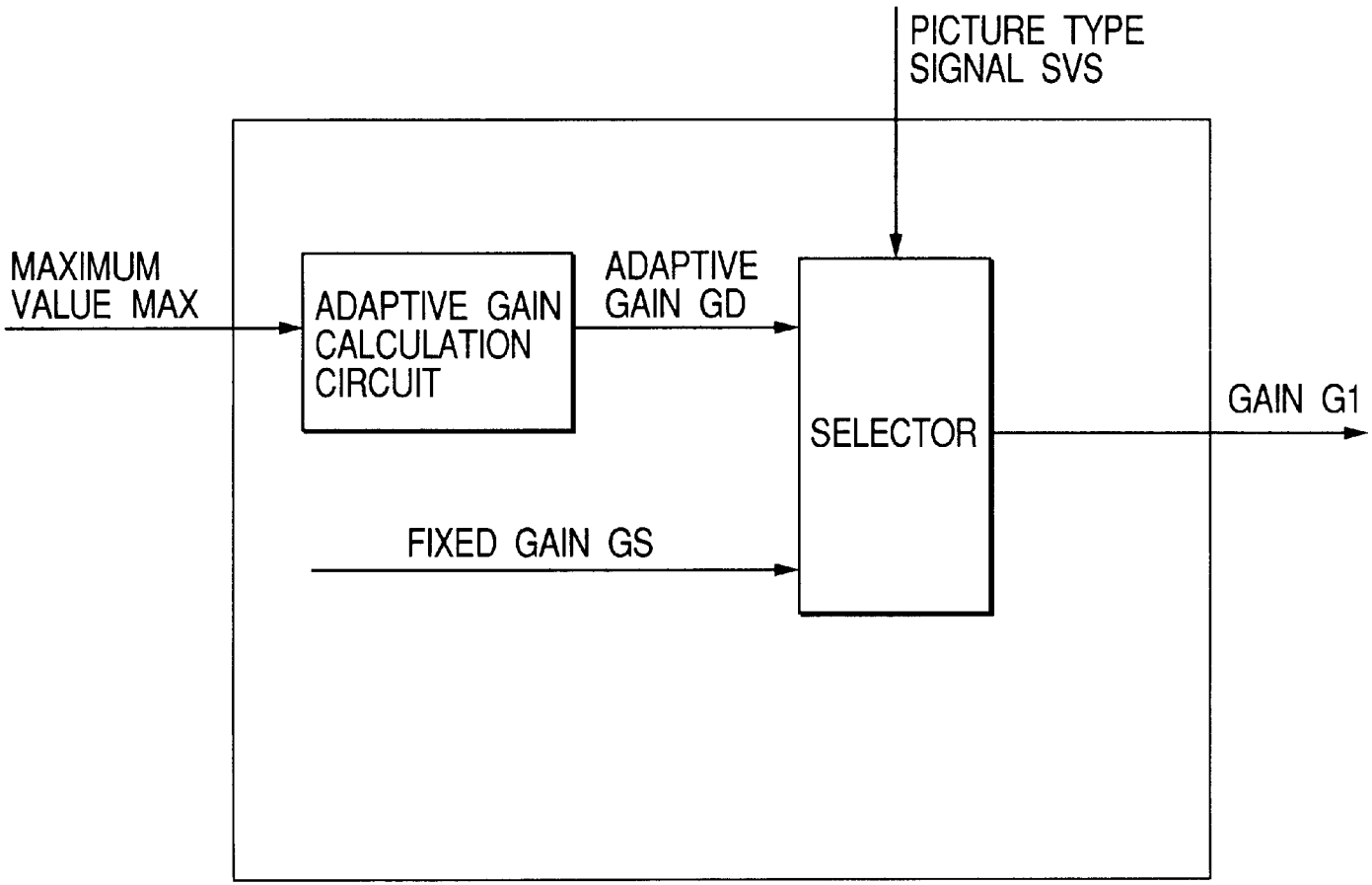
FIG. 29 is a block diagram of a gain calculation unit according to the fifth embodiment of the present invention.

FIG. 29 is a diagram for explaining the gain calculation unit 21 according to this embodiment.

In the gain calculation unit 21, an adaptive gain calculation circuit calculates gain by the adaptive gain method based on the maximum value of the adjusted image data detected by the maximum value detection circuit 20. The gain GD calculated is supplied to the selector.

Gain GS determined by the fixed gain method is also supplied to the selector.

The selector refers to the picture type signal SVS to select as selector output G1 the gain GD by the adaptive gain method when the picture signal to be displayed is a television signal, or the gain GS by the fixed gain method when it is a computer picture signal.

In the embodiment, the fixed gain method is used to calculate gain when a computer picture signal is to be displayed, while the adaptive gain method is used to calculate gain when a television picture signal is to be displayed. Alternatively, an interface such as a remote control may be so provided that the user can set either of modes at user's discretion.

Further, an input terminal for computer picture and an input terminal for television picture may be provided for automatically changing modes based on which picture is now being displayed.

Furthermore, modes for selecting display quality of the image display apparatus may be provided such as to select the adaptive gain method when priority is given to peak luminance to display bright picture, and select the fixed gain method when priority is given to the fidelity of picture rather than peak luminance.

Thus, when television picture signals are displayed, gain is calculated by the adaptive gain method, while when computer picture signals are displayed, gain is calculated by the fixed gain method. This configuration makes them possible to display appropriate picture without sense of discomfort even when computer picture signals are displayed, as well as display bright picture when television picture signals are displayed.

In the embodiment, the configuration according to the first embodiment is adopted as shown in FIG. 28 for preventing the occurrence of overflow, but the present invention is not limited thereto.

In other words, the configuration shown in the second embodiment (FIG. 25) in which the amplitude range of input image data is adjusted can also have the same effect.

Further, the configuration shown in the fourth embodiment (FIG. 27) in which the amplitude range of discrete adjusted image data is adjusted can have the same effect.

(Sixth Embodiment)

In the fifth embodiment, gain is determined by the fixed gain method when computer picture signals are displayed, and by the adaptive gain method when television picture signals are displayed (FIG. 29).

In the sixth embodiment, the gain calculation unit 21 in FIG. 29 is constituted as shown in FIG. 30A. This configuration is found further preferable.

In FIG. 30A, an adaptive gain calculation circuit calculates adaptive gain GD by referring the maximum value MAX of adjusted image data from the maximum value detection circuit 20. The gain GD calculated is inputted into a limiter.

The limiter is a circuit for limiting the gain GD according to a limit value outputted from a limiter register and outputting the same as gain G1.

It should be noted that plural limit values are stored in the limiter register.

Based on the picture type signal SVS, and a dynamic mode-low power mode changeover signal SMODE, it is determined which limit value should selectively outputted from among the plural limit values.

In the embodiment, the following relationship among limit values is found preferable:

Dynamic Mode>Low power Mode>Computer Mode.

FIG. 30B shows a limiter input-output characteristic to the limit values determined such above.

As shown in FIG. 30B, since the limit value of the limiter is set to a very large value in the dynamic mode, the output of the limiter becomes equivalent to the adaptive gain GD.

On the other hand, the output of the limiter in the low power mode is such that it becomes equivalent to the adaptive gain GD in a range in which the adaptive gain GD takes on small values, and is limited by the limiter as the gain increases. Thus, in the low power mode, gain is calculated by the adaptive gain method when the input image data is bright, and by the fixed gain method when the input image data is dark. This mode is found preferable for displaying an image faithfully without variation in luminance when the image is dark.

Further, in the computer mode, the limiter selects such a value that the output of the limiter becomes the limit value in the computer mode. This mode is found preferable for displaying an appropriate image without sense of discomfort as mentioned above.

In the embodiment, the limiter limits the gain GD after calculated by the adaptive gain method, but the present invention is not limited thereto. For example, minimum value control means may be provided for determining the minimum value with respect to the maximum value of adjusted image data as the input into the adaptive gain calculation circuit. This configuration results in the same effect.

Further, in the embodiment, any of the configurations according to the first embodiment (FIG. 11), the second embodiment (FIG. 25), and the fourth embodiment (FIG. 27) can be suitably adopted for adjusting the amplitude range of adjusted image data.

(Seventh Embodiment)

In the first embodiment, the adjusted image data is multiplied by a gain value to limit the amplitude range so that overflow of adjusted image data will be prevented.

It is also mentioned in the first embodiment that the upper limit of the amplitude range of the adjusted image data the amplitude of which has been adjusted is limited by the upper limit value of the modulator so that the amplitude range will be completely limited.

Such a perfect limitation is not always necessary for proper correction while preventing the occurrence of overflow. It is preferable even to limit the upper limit of the amplitude range of adjusted image data by the input upper limit value of the modulator simply without multiplying the adjusted image data by gain.

Further, it is mentioned in the second embodiment, as the configuration for preventing the occurrence of overflow of adjusted image data, that image data before subjected to correction is multiplied by gain to limit the amplitude range. Then, adjusted image data is calculated for the image data multiplied by the gain to calculate such gain that the upper limit value of the amplitude of the adjusted image data corresponds to the input upper limit of the modulator.

On the other hand, another configuration for making a proper correction while preventing the occurrence of overflow can be considered suitable, in which image data before subjected to correction is limited so that adjusted image data will be calculated for the image data limited while adjusting the limit value of the limiter to such a value that the adjusted image data calculated will not overflow the input range of the modulator.

(Eighth Embodiment)

Figure 31:
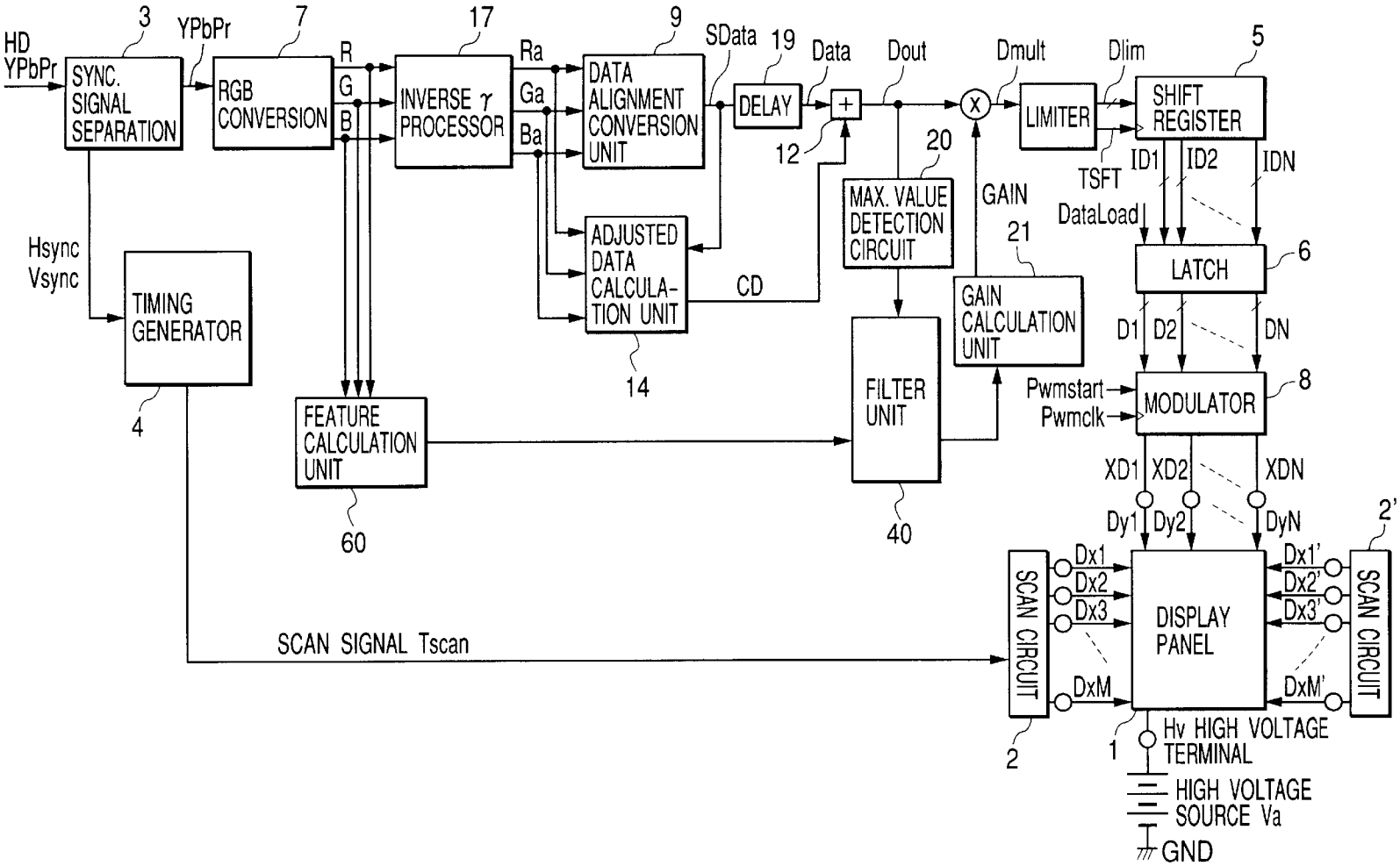
FIG. 31 is a block diagram showing a schematic configuration of an image display apparatus according to an eighth embodiment of the present invention.

In this embodiment, the overflow processing described in the first embodiment is improved. FIG. 31 is a block diagram showing a schematic configuration of an image display apparatus according to the eighth embodiment.

It should be noted that the improvement in the overflow processing should not be limited to the first embodiment, and it is applicable to any other embodiment.

In the embodiment, the occurrence of overflow is prevented in a configuration including the following components. The maximum value detection circuit 20 detects the maximum value of adjusted image data on a frame basis. A filter unit 40 takes in the maximum value of the adjusted image data in each frame outputted from the maximum value detection circuit 20, and cuts off a high-frequency range (that is, it suppresses a significant change of the maximum value between frames). The gain calculation unit 21 calculates such a gain value that the output of the adder 12 that has received the output of the filter unit 40 will fall within the input range of the modulator. The multiplier multiplies the output of the adder by the gain calculated to calculate gain on a frame basis.

In such a configuration, a feature calculation unit 60 to be described below is provided as means for detecting a change of scenes of display images.

It can be found preferable that the filter be operated for proper display in a manner mentioned below based on the judgment result from the feature calculation unit (scene change judgment unit) 60.

(Feature Calculation Unit (Scene Change Judgment Unit))

The feature calculation unit 60 according to the embodiment is connected to each part as shown in FIG. 31.

The feature calculation unit 60 is means for calculating an average luminance level or average picture level (APL) of image data for one frame and calculating a difference between frames to determine an absolute value of the difference.

The average picture level (APL) calculation circuit can be constituted of an adder, a register, and the like. The average picture level (APL) calculation circuit adds a value stored in the register to image data sequentially transferred, and stores the added value in the register again. Then it adds image data sequentially inputted.

If the register value is reset to 0 at the beginning of each frame, the added value of the image data for the frame (that is, a value proportional to the mean value since the number of pixels in one frame is fixed) will be determined at the end of the frame. The determined value is the average picture level (APL). In the embodiment, the maximum value of the average picture level (APL) is 255.

Next, the difference in the average picture level (APL) between frames is calculated, and then the absolute value is calculated.

After that, the feature calculation unit 60 outputs the absolute value of the difference between two average picture levels of adjacent frames.

(Filter unit)

As shown in FIG. 31, the filter unit 40 according to the embodiment takes in the output of the maximum value detection circuit 20 and the output of the feature calculation unit 60, and performs processing to be described later to output the same to the gain calculation unit 21.

Figure 34:
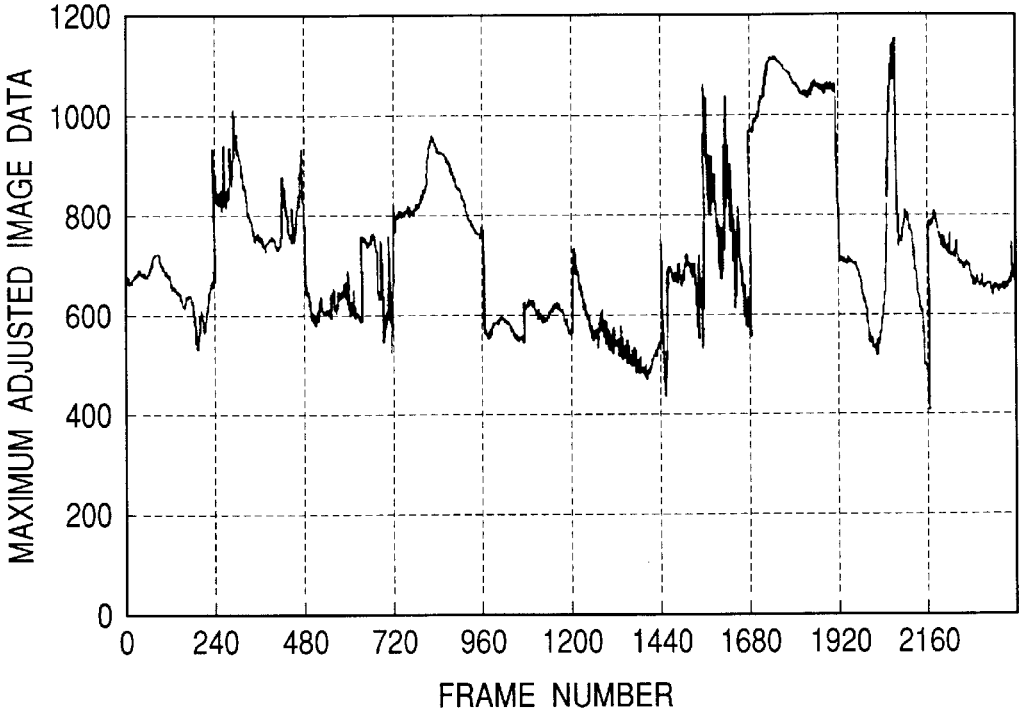
FIG. 34 is a graph showing changes of maximum adjusted image data for certain motion picture described in the eighth embodiment of the present invention.

FIG. 34 shows a detailed configuration of the filter unit 40.

Figure 32:
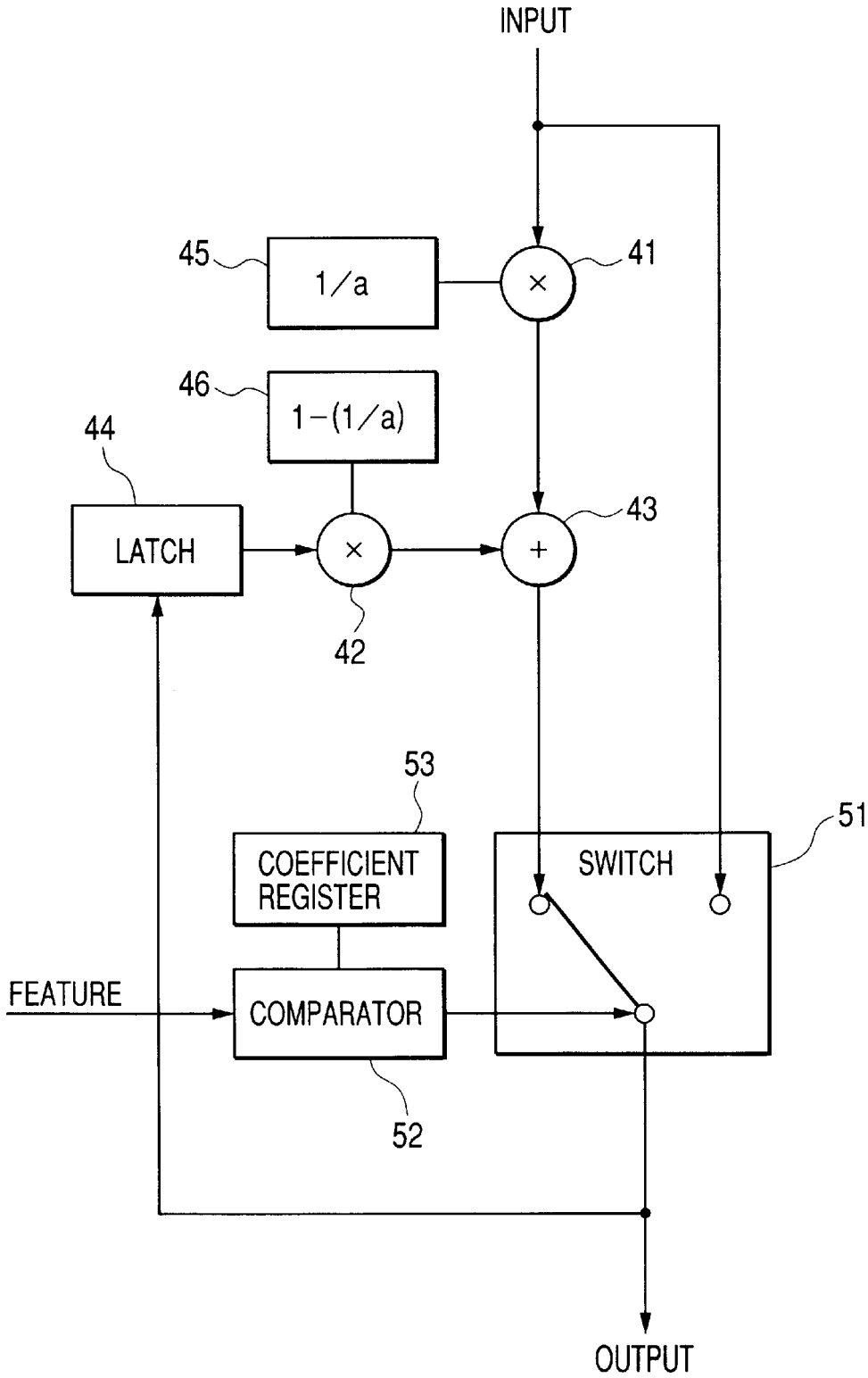
FIG. 32 is a block diagram showing a configuration of a filter unit according to the eighth embodiment of the present invention.

As shown in FIG. 32, the filter unit 40 includes multipliers 41 and 42, an adder 43, a latch circuit 44 corresponding to a delay device of a digital filter, coefficient registers 45, 46, and 53, a switch 51, and a comparator 52.

The operation of the filter unit 40 in such a configuration will be described below.

(1) When the output (the absolute value of the difference in APL between frames) of the feature calculation unit 60 inputted into the comparator 52 is equal to or smaller than the value of the coefficient register 53, the output of the adder 43 is selected by the output of the comparator 52 as the output of the switch 51. Then the output of the adder 43 is outputted as the output of the filter unit 40 as well as the output to the latch circuit 44.

In this case, the coefficient registers 45 and 4sixth multipliers 41 and 42, the adder 43, and the latch circuit 44 constitute a recursive digital filter.

In other words, the multiplier 41 multiplies the maximum value of the current adjusted image data by a coefficient of 1/a stored in the coefficient register 45.

On the other hand, the latch circuit 44 holds the output of the filter unit 40 obtained in the immediately preceding frame, and the multiplier 42 multiplies the output by a coefficient of (1−1/a) stored in the coefficient register 46.

Then the adder 43 adds these two multiplication results.

The inventors has realized a low-pass filter using a=64 in the above-mentioned filter unit.

The coefficient registers 45 and 46 may take any value other than the above-mentioned values as long as a low-pass filter can be formed. When the above-mentioned values are used, if the natural number a of the multiplication coefficients handled at the multipliers 41 and 42 is set to the n-th power of 2 (where n is a natural number), an equivalent calculation can be made by bit sift and subtraction without hardware, so that the size of the circuit can be reduced.

(2) When the output (the absolute value of the difference in APL between frames) of the feature calculation unit 60 inputted into the comparator 52 is larger than the value of the coefficient register 53 (as will be described later, when it is judged that the scene is changed), the input into the filter unit 40 is selected by the output of the comparator 52 as the output of the switch 51. Then the input into the filter unit 40 is outputted as the output of the filter unit 40 as well as the output to the latch circuit 44.

In other words, the filter unit 40 takes in the maximum value of the adjusted image data and outputs the same as it is.

Then the contents of the latch circuit 44 are replaced with the maximum value of the adjusted image data.

The filter unit 40 operates as mentioned above.

(Another Example of Filter Unit)

Figure 33:
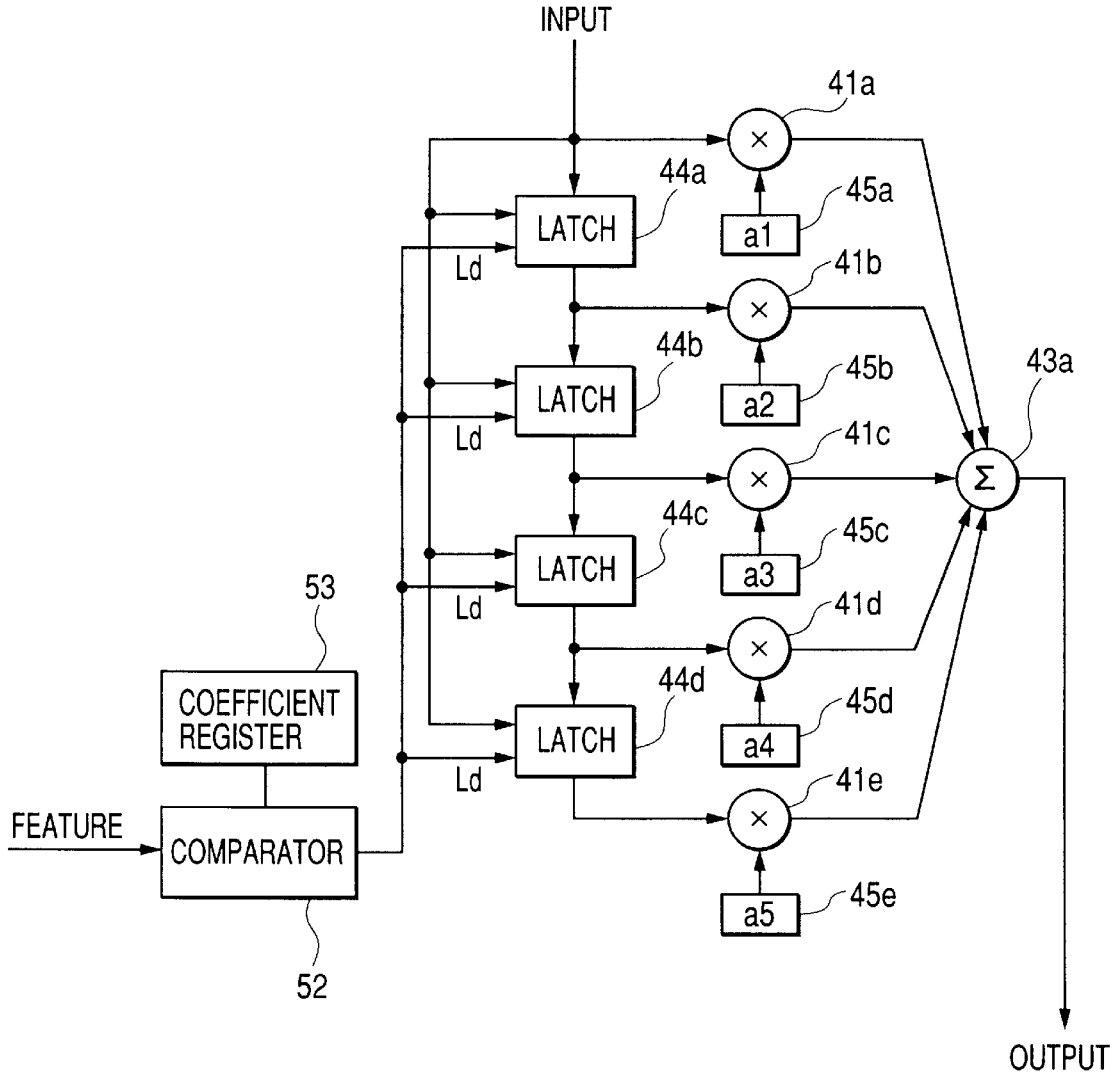
FIG. 33 is a block diagram showing another configuration of the filter unit according to the eighth embodiment of the present invention.

FIG. 33 shows another example of the filter unit 40.

As shown in FIG. 33, the filter unit 40 includes multipliers 41*a*, 41*b*, 41*c*, 41*d*, and 41*e*, an adder 43*a*, latch circuits 44*a*, 44*b*, 44*c*, and 44*d* corresponding to delay devices of a digital filter, coefficient registers 45*a*, 45*b*, 45*c*, 45*d*, 45*e*, and 53, and the comparator 52.

In FIG. 33, the operation of the filter unit 40 as another example will be described.

(1) When the output (the absolute value of the difference in APL between frames) of the feature calculation unit 60 inputted into the comparator 52 is equal to or smaller than the value of the coefficient register 53, the comparator 52 has no output. In this case, the multipliers 41*a*, 41*b*, 41*c*, 41*d*, and 41*e*, the coefficient registers 45*a*, 45*b*, 45*c*, 45*d*, and 45*e*, the adder 43*a*, and the latch circuits 44*a*, 44*b*, 44*c*, and 44*d* constitute a nonrecursive digital filter.

For purposes of illustration, although a filter with fewer delay devices (with fewer taps in number) is shown as an example, a filter with about 16 to 128 taps, preferably with about 30 to 90 taps is found visually appropriate. Like the recursive digital filter described in FIG. 32, the digital filter in FIG. 33 also uses low-pass characteristics as the values of the coefficient registers 45*a*, 45*b*, 45*c*, 45*d*, and 45*e*.

(2) When the output (the absolute value of the difference in APL between frames) of the feature calculation unit 60 inputted into the comparator 52 is larger than the value of the coefficient register 53 (as will be described later, when it is judged that the scene is changed), the comparator 52 outputs a load pulse (Ld) to the latch circuits 44*a*, 44*b*, 44*c*, and 44*d* as delay devices of the digital filter.

Then, the contents of the latch circuits 44*a*, 44*b*, 44*c*, and 44*d* are replaced with the data inputted. Then, the filter unit 40 takes in the maximum value of the adjusted image data, and outputs the same as it is.

Thus, the filter unit 40 operates in a manner equivalent to the digital filter unit shown in FIG. 32 (in which a selection is so made that the sum of the coefficient registers 45*a*, 45*b*, 45*c*, 45*d*, and 45*e* becomes 1).

(Gain Calculation Means (Gain Calculation Unit))

The gain calculation unit 21 is means for calculating such a gain value that the adjusted image data Dout will fall within the input range of the modulator.

In the embodiment, if the output of the filter unit 40 is MAX' and the constant is Kf1, gain is properly calculated as follows:

$$\text{Gain } G = Kf1 \times \text{INMAX}/\text{MAX}',$$

where $0.7 \leqq Kf1 < 1.3$.

Even when the above equation causes some overflow, if the gain is set slightly larger than normal for a natural picture, since bright picture can be displayed, the image will come out looking beautiful from a subjective point of view.

In the embodiment, the inventors have determined the constant as Kf1=1 so that an excellent image can be obtained.

In the embodiment, the gain value is changed on a frame basis as well.

Since the filter for suppressing variations in gain on a frame basis is provided in this embodiment, an overflow may take place in the strict sense.

To cope with this problem, a limiter is provided to the output of the multiplier for multiplying the adjusted image data and the gain together, and the circuit is so designed that the output of the multiplier will fall within the input range of the modulator.

(Operation of Overflow Processing)

(1) Reduction of Flicker

When overflow proceeding is performed, luminance can be turned up on a frame basis as mentioned above.

If no filter unit 40 is provided, such a configuration may cause a sense of interference (flicker) as will be mentioned below.

Suppose that such an image that the lower half is the sea and the upper half is the sky with water ripples being glittering in the sun is taken as an easy-to-understand example.

In this case, the maximum value of the adjusted image data finely varies in the area in which the waves are glittering in the sun. If gain is determined on a frame basis as mentioned above, since the gain varies finely from frame to frame, the brightness of the image, especially of the sky after subjected to overflow processing will vary finely according to the fine variations in gain between frames, which causes the sense of interference (flicker).

In the overflow processing, the configuration according to the embodiment has the filter unit 40 remove a high-frequency range to absorb the fine variations of the maximum adjusted image data.

Therefore, the variations in gain is made moderate even in such an image that the maximum value of the adjusted image data finely varies, thus turning the brightness up without sense of interference.

As mentioned above, the low-pass filter is used to absorb the fine variations so as to eliminate the sense of interference (flicker). However, when the cut-off frequency is too low, variations in gain that need to be tracked are also eliminated.

The inventors have confirmed that it is preferable to use a low-pass filter with a=128, a=64, a=32, or a=16 in the above-mentioned recursive filter unit of FIG. 32. Especially, the low-pass filter with a=16 is found optimal as a result of subjective evaluation. On the other hand, about 16 to 128 taps, especially 30 to 90 taps are found suitable for the nonrecursive filter unit shown in FIG. 33 from a subjective point of view.

Figure 35:
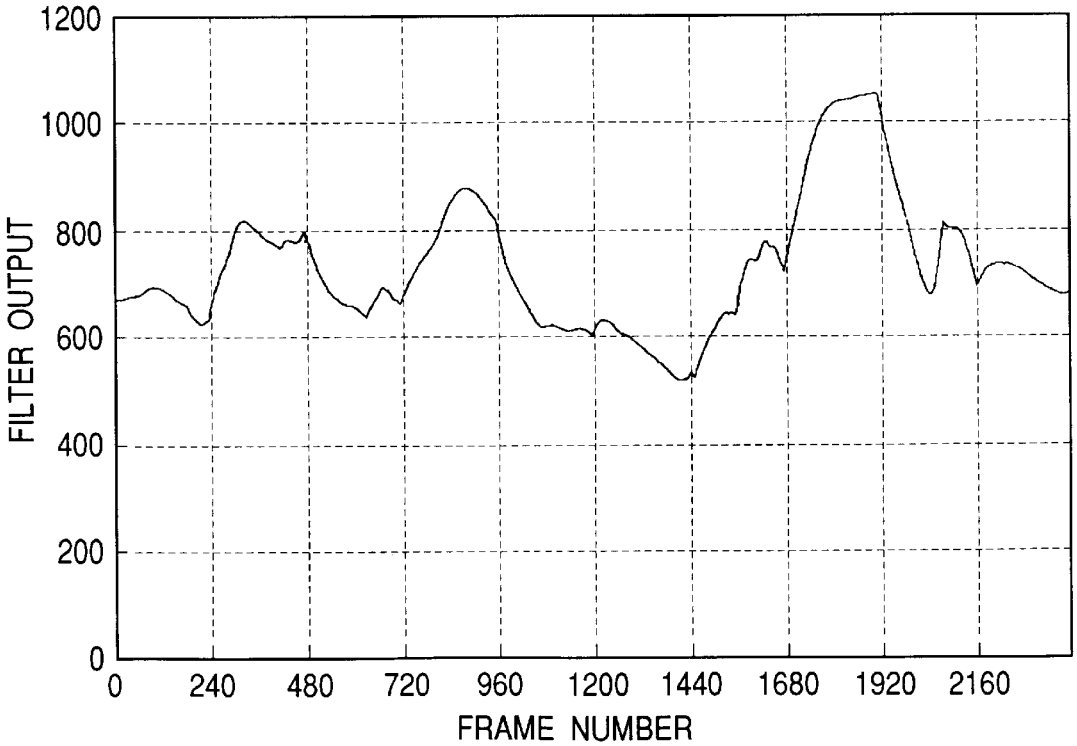
FIG. 35 is a graph showing a frame number-to-filter output characteristic described in the eighth embodiment of the present invention.

FIG. 34 is a line graph showing a frame number-to-maximum value (maximum adjusted image data) characteristic of adjusted image data of actual image data. FIG. 35 is a line graph showing a frame number-to-filter output characteristic of the same image when the recursive filter with a=64 of FIG. 34 is used as the filter unit 40 according to the present invention. A comparison between both graphs shows that fine variations in gain are moderated in the latter. For the sake of simplicity, it is assumed in FIG. 3seventhat the coefficient register 53 sets a large value (for example, the absolute value is about 255) and no scene change takes place.

(2) Alleviation of Sense of Discomfort due to Scene Change

The sense of interference (flicker) can be eliminated from the above-mentioned image. However, if the image changes from one scene to another (scene change), a sense of interference may be given to the viewer.

Suppose that a bright scene such as the white sands changes to a dark scene such as the night sky.

Since the image data is large in the scene of the white sands, and the adjusted image data has a large value as mentioned above, the gain has a small value.

On the other hand, the image data just after the scene change to the dark scene such as the night sky is small in value. Therefore, the adjusted image data is also small in value as mentioned above (with a large gain value) . However, since the adjusted image data is filtered by the low-pass filter in the filter unit 40, the value of the output of the filter unit 40 becomes larger than the current maximum adjusted image data to make the gain smaller.

The gain gradually increases as time passes.

Therefore, the image is very dark just after the scene change to the dark scene such as the night sky, and grows light in a few seconds, which makes the viewer feel uncomfortable.

To eliminate such a sense of discomfort, the low-pass filter of the above-mentioned filter unit 40 in the embodiment is characterized as follows: When the maximum value of the output (the absolute value of the difference in APL between frames) of the feature calculation unit 60 is larger than the value of the coefficient register 53, the maximum adjusted image data inputted into the filter unit 40 is outputted as it is, and the contents of the latch circuit 44 are replaced with the maximum adjusted image data.

It is found preferable that when the maximum value of the output (the absolute value of the difference in APL between frames) of the feature calculation unit 60 is 255 (the maximum value of APL is 255), the coefficient register 53 takes on values from 20 to 5, and optimally it takes 10.

In other words, when the difference in APL between frames is 10 or more, it is considered that a scene change has taken place, and the contents of the delay device of the low-pass filter are replaced with the input data, thereby improving the trackability of gain.

Figure 36:
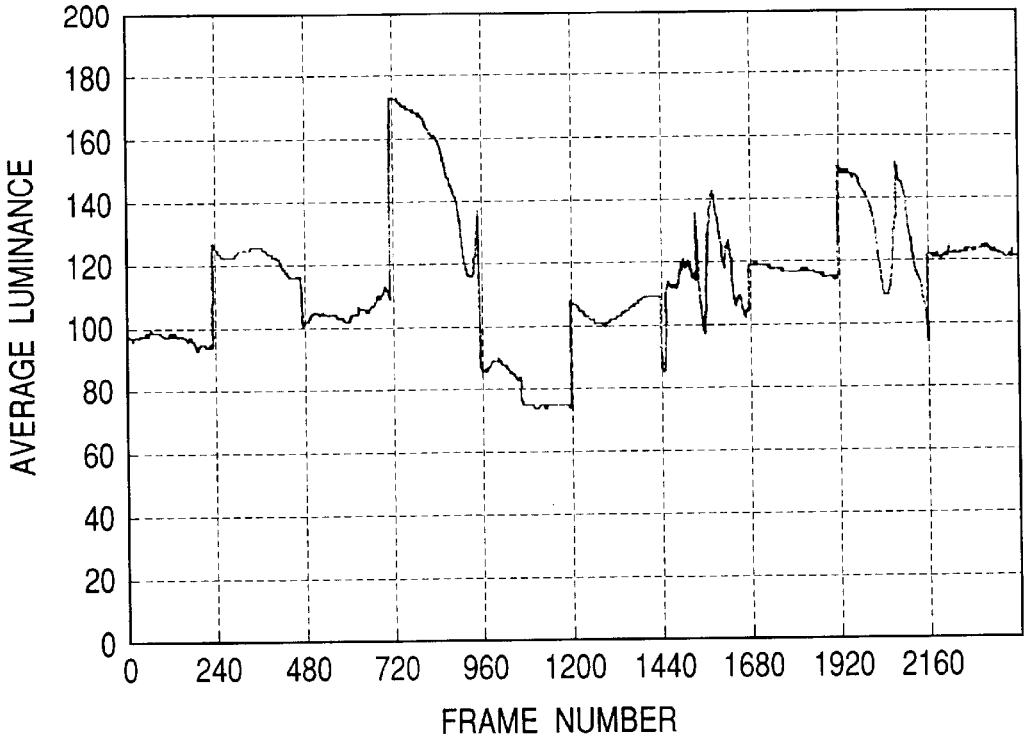
FIG. 36 is a graph showing a frame number-to-average picture level (APL) characteristic described in the eighth embodiment of the present invention.
Figure 37:
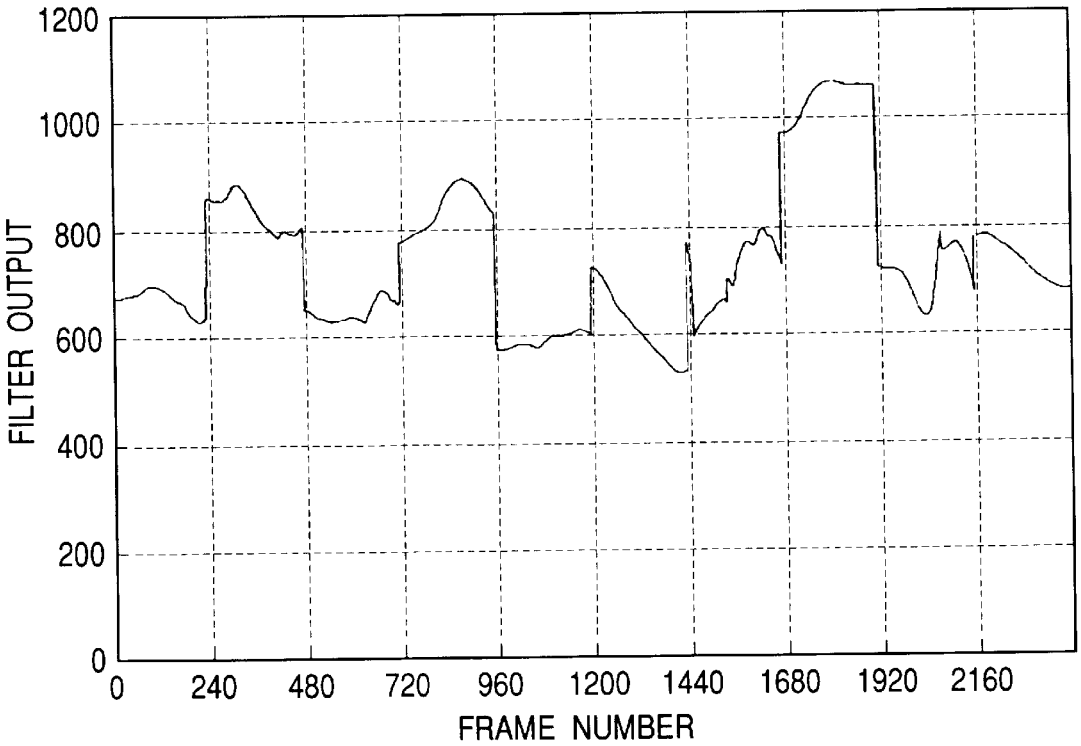
FIG. 37 is a graph showing a scene-changed frame number-to-filter output characteristic described in the eighth embodiment of the present invention.

FIG. 36 shows a line graph of a frame number-to-APL value characteristic of the image shown in FIG. 34. FIG. 37 shows a line graph of a frame number-to-filter output characteristic when the filter unit 40 is the recursive filter with a=64 shown in FIG. 32, and the value of the coefficient register 53 is 10. In both graphs, the input image is such motion picture that scenes change every 240 frames. It is apparent from FIG. 3seventhat the output of the filter unit varies with good trackability every time the scene changes, thus further preventing flicker.

The actual display image is also good without flick or sense of interference and sense of discomfort at each scene change.

Although in the embodiment the input image data before subjected to inverse γ conversion is inputted into the feature calculation unit 60, the output of the inverse γ processor may be inputted into the feature calculation unit 60 to calculate the difference between frames in the average picture level (APL). In this case, the same effect can be obtained.

(Ninth Embodiment)

Figure 38:
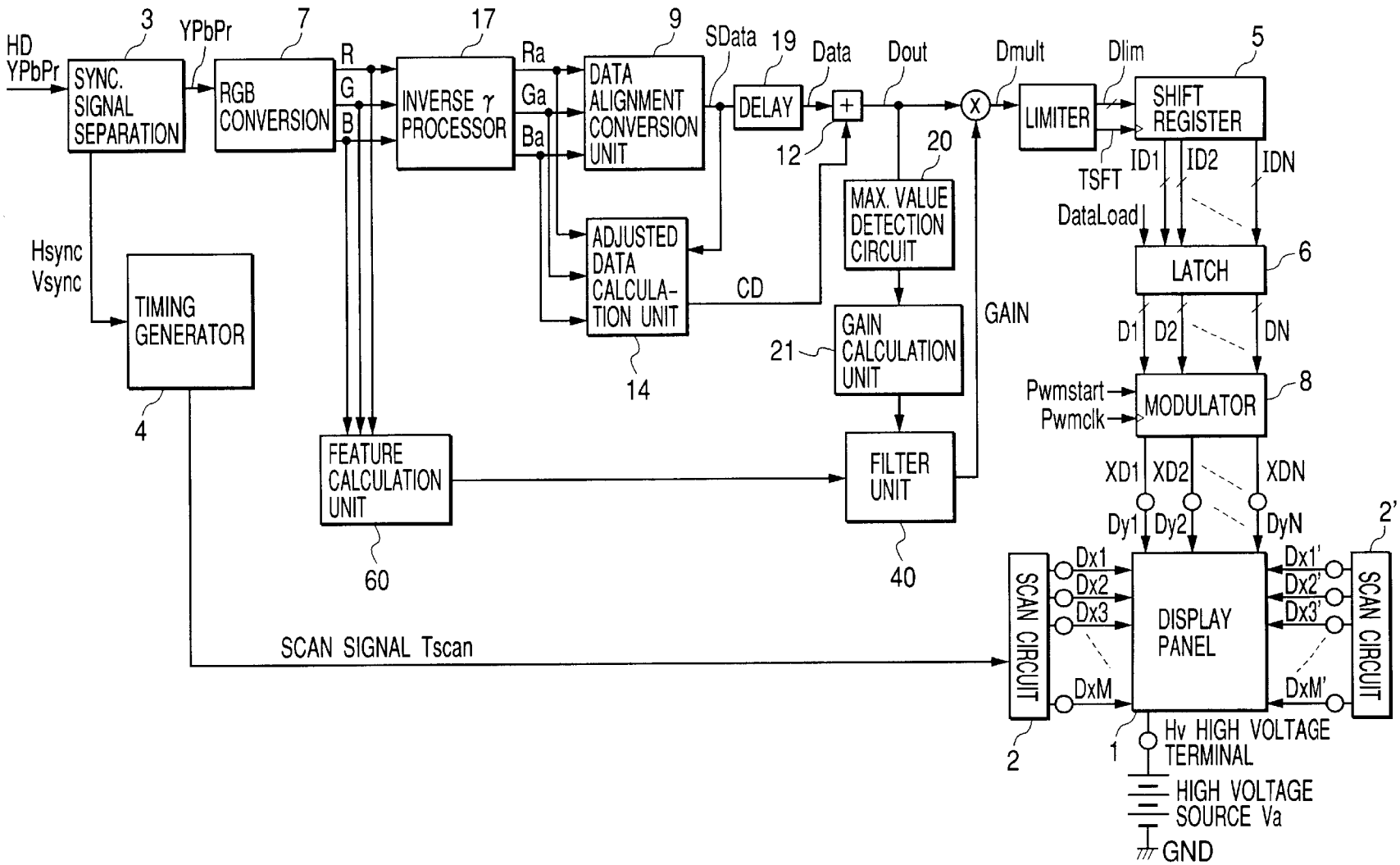
FIG. 38 is a block diagram showing a schematic configuration of an image display apparatus according to a ninth embodiment of the present invention.

FIG. 38 shows a configuration of the ninth embodiment of the present invention.

In the eighth embodiment, the filter unit 40 is provided to the output of the maximum value detection circuit 20 so that gain will be calculated for the output value of the filter unit 40. On the other hand, this embodiment is such that gain is calculated at the gain calculation unit 21 from the output of the maximum value detection circuit 20, and the filter unit 40 is provided to the gain calculated.

In other words, the filter unit 40 controls or limits the variations in gain. The other components and the structure of the filter unit 40 are the same as those in the eighth embodiment. In this embodiment, proper adjusted image data can be displayed.

(Tenth Embodiment)

Figure 39:
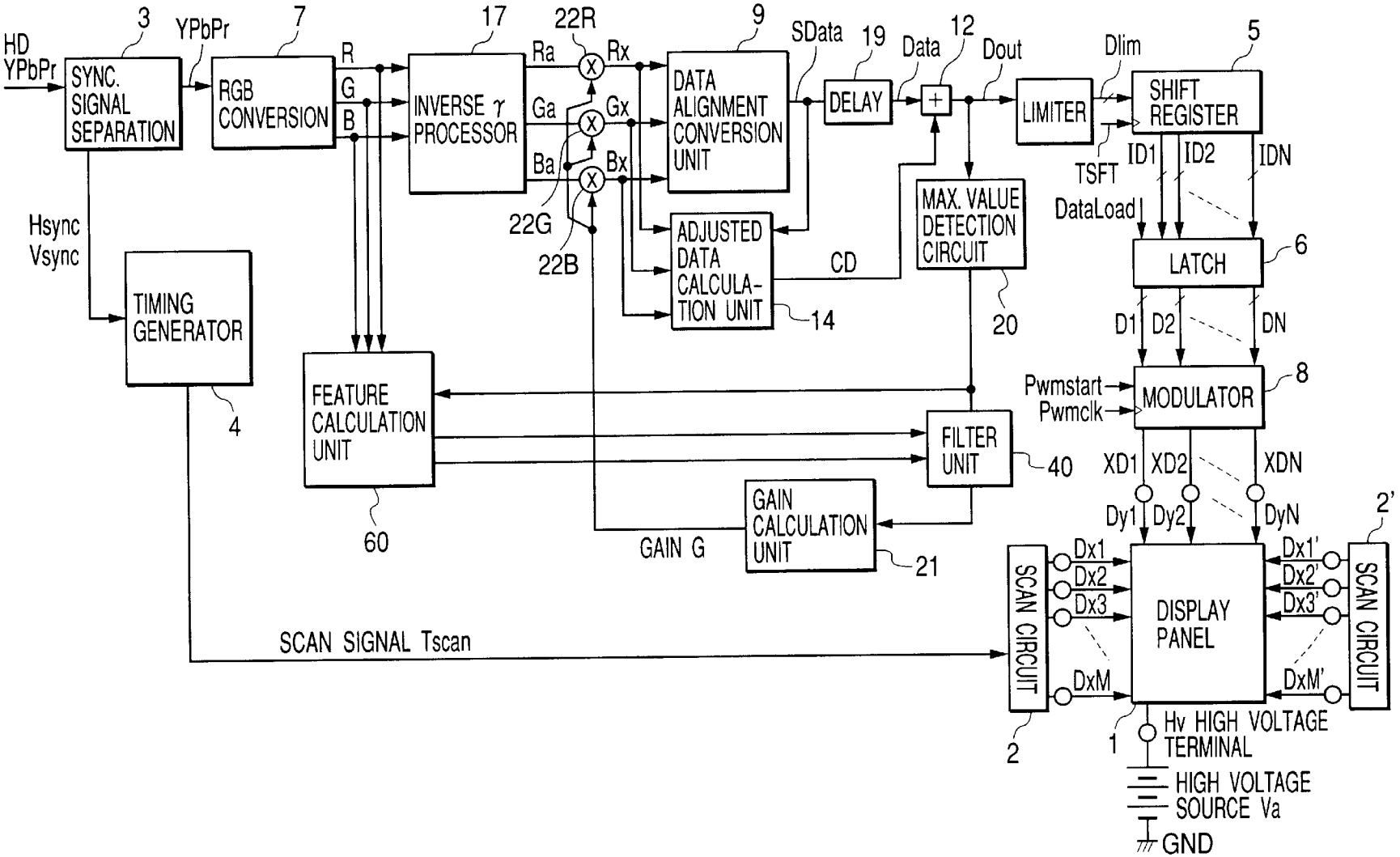
FIG. 39 is a block diagram showing a schematic configuration of an image display apparatus according to a tenth embodiment of the present invention.

In the tenth embodiment, circuit connections are made as shown in FIG. 39. In this configuration, the feature calculation unit 60 calculates both the absolute value of the difference between frames in APL of input image data detected on a frame basis, and the absolute value of the difference between frames in the maximum value MAX of the adjusted image data.

Figure 40:
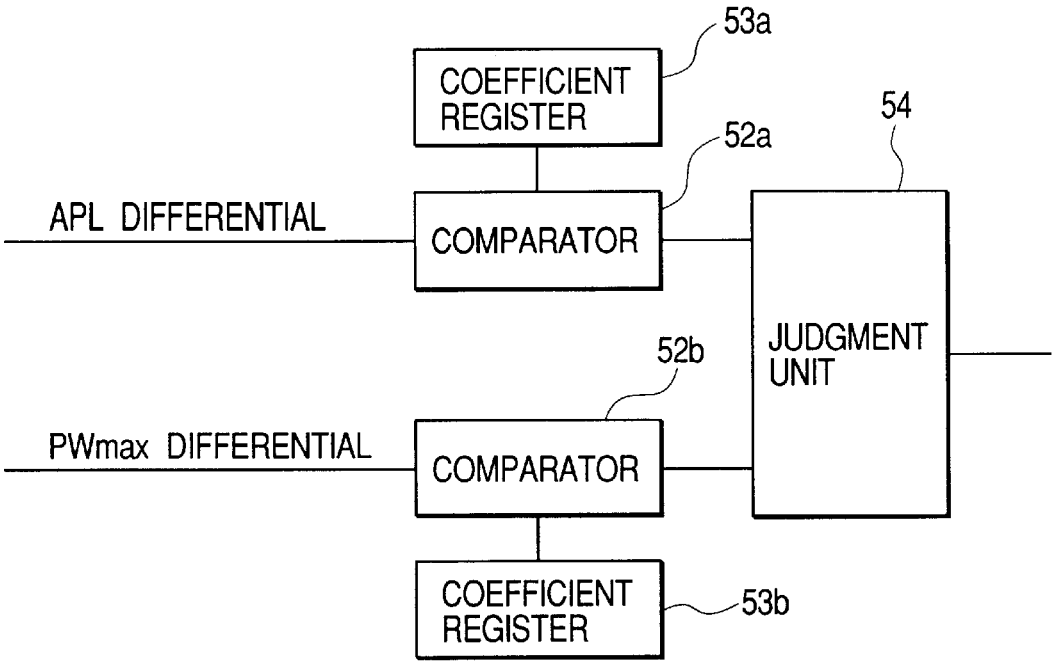
FIG. 40 is a block diagram showing a configuration of a filter unit according to the tenth embodiment of the present invention.

Further, as shown in FIG. 40, the filter unit 40 includes a comparator 52*a* and a coefficient register 53*a* for judging the absolute value in APL between frames, a comparator 52*b* and a coefficient register 53*b* for judging the absolute value in MAX between frames, and a judgment unit 5fourthat refers to two judgment results. In the embodiment, the judgment unit 54 is an OR circuit. The other components are the same as those in the above-mentioned embodiments.

Suppose that only the difference in APL between frames is handled as a feature. If a scene change is made from a screen on which a solid white strip crossing one-third of the area of a black image plane (MAX is large) is displayed to a screen on which an overall solid monochrome plane is displayed (MAX is small), since both APL values are the same, no scene change is judged. This makes the viewer feel uncomfortable for a few seconds. In contrast, since in the embodiment the difference in MAX between frames is also judged, the scene change is judged, thereby obtaining proper display images.

Like in the above-mentioned embodiments, the absolute value in APL between frames may be calculated from the output of the inverse γ processor. In this case, the same effect can be obtained.

(Eleventh Embodiment)

The image display apparatuses according to the present invention are described above based on the several embodiments.

All the above-mentioned embodiments have the following common problem that is caused depending on the quality of input images:

When a correction or adjustment is made to input image data accompanied with noise, since the adjusted image data calculated as a result of the correction is also accompanied with noise, gain fluctuates with noise on a frame basis, and flicker may take place in the display image.

The inventors have studied the occurrence of flicker, and have found the following portions of images in which flicker often occurs:

1) the periphery of an image produced at broadcast station;
2) the periphery of an image created using a scaler or the like; and
3) the periphery of an output image of an I/P converter that converts an interlace signal to a progressive signal, especially picture data in some horizontal scan lines on the top and bottom of the image.

The images 1) to 3) are just examples, but it is apparent from these examples that noise would occur with a high frequency at specific positions, that is, on the periphery of an image. The noise that occurs makes gain vary, and such variations in gain give the display image a sense of interference.

The problem in the images 1) to 3) is caused with a high frequency in such a case where the original image has been subjected to conversion. This is because when the original image is subjected to filter operation to create a new image, the periphery (especially the edge) of the image has to be processed in such bad condition that there is no original image at the input of the filter that performs filter operation. Since processing for image portions without data brings different results, values of image data on the periphery (especially the edge) of the image are often degraded (thereby causing noise).

Especially, since the output image 3) of the I/P converter deviates by one horizontal line from the original image that has been subjected to filter operation while being divided into odd-number and even-number fields, values of the image data in the upper and lower horizontal lines of the image vary every other field of the original image, that is, every other frame after subjected to I/P conversion.

In the case of the image 3), if the adjusted image data derived to compensate for noise is detected as the maximum value at the maximum value detection circuit 20, the noise will vary on a frame-by-frame basis to make gain fluctuate on a frame-by-frame basis, resulting in occurrence of flicker in the display image.

Figure 43:
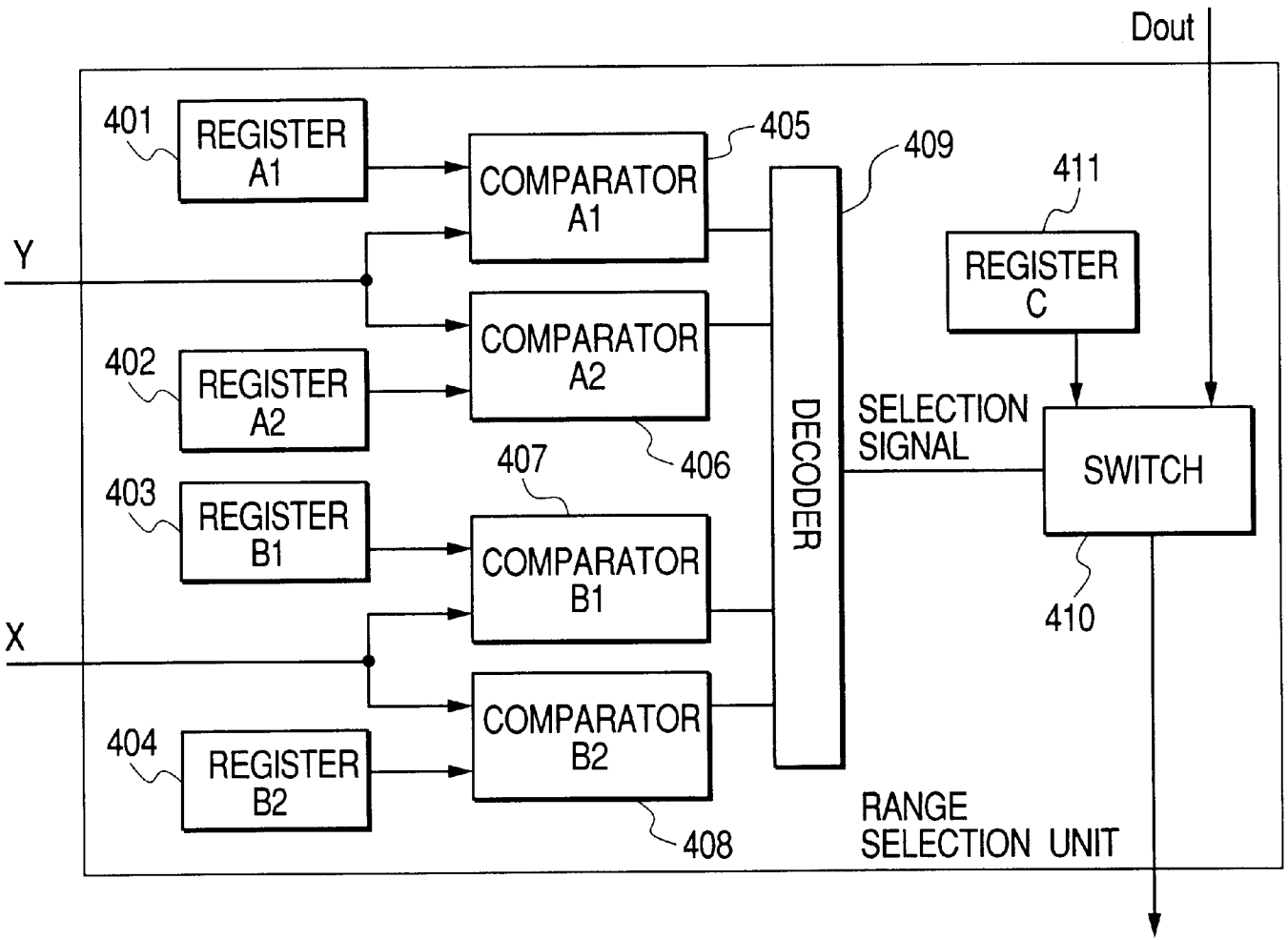
FIG. 43 is a block diagram showing a configuration of a range selection unit according to the eleventh embodiment of the present invention.

FIG. 43 shows a line graph of output from the maximum value detection circuit 20 when an output image from the I/P converter for converting an interlace signal to a progressive signal has been corrected or adjusted in such a state that no range selection unit 400 of the present invention to be described later is provided.

In this case, the maximum adjusted image data calculated from consecutive pieces of input image data varies significantly every other frame. It means that gain varies significantly every other frame, and such variations manifest themselves as flicker in the output image.

As mentioned above, the noise that causes the flicker may occur on the periphery (especially the edge) of the image when the original image is subjected to filter operation to create a new image.

Figure 42:
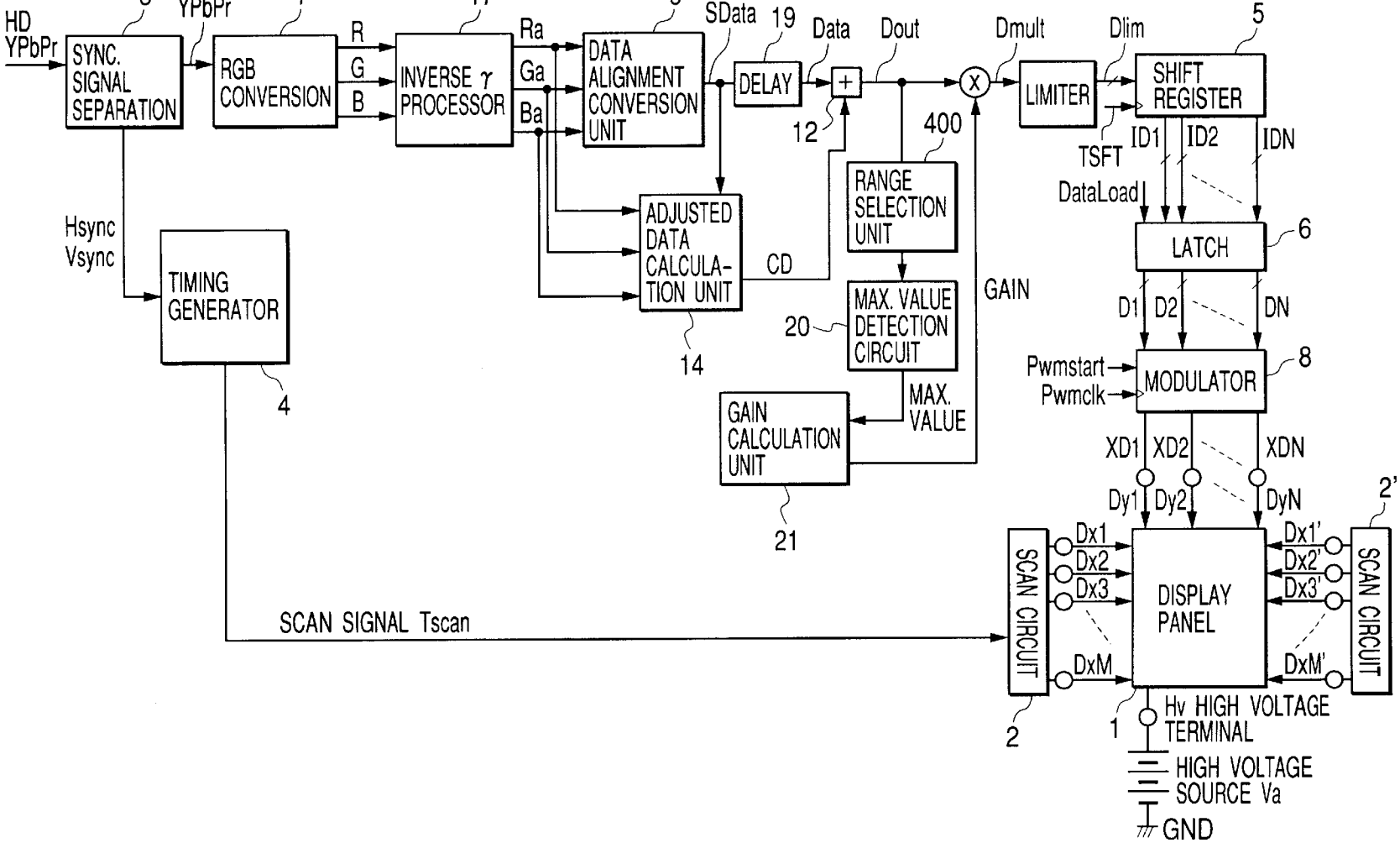
FIG. 42 is a block diagram showing a schematic configuration of an image display apparatus according to the eleventh embodiment of the present invention.

From this standpoint, the inventors have provided a range selection unit 400 to be described below. In FIG. 42, the reference numeral 400 designates a range selection unit and 20 is the maximum value detection circuit.

It should be noted that although in this embodiment the configuration of the first embodiment is taken by way of example to describe the overflow processing, any other embodiment can be adopted.

The range selection unit 400 may be constituted as shown in FIG. 43 in which the reference numerals 401, 402, 403, and 404 designate registers A1, A2, B1, and B2; the reference numerals 405, 406, 407, and 408 are comparators A1, A2, B1, and B2; 409 is a decoder, 410 is a switch, and 411 is a register C.

The register A1 (401) holds the minimum value in the vertical range of adjusted image data from which the maximum value is to be detected. The comparator A1 (405) compares the minimum value with an input value Y as vertical position information on Dout, and when Y is larger, it produces a selection signal.

On the other hand, the register A2 (402) holds the maximum value in the vertical range of the adjusted image data from which the maximum value is to be detected. The comparator A2 (406) compares the maximum value with the input value Y as the vertical position information on Dout, and when Y is smaller, it produces a selection signal.

The register B and comparator B constitute a selection unit for the-horizontal position, and have the same structure as the register A and comparator A.

The decoder 409 constituted of an AND circuit and the like produces from these selection signals a selection signal when adjusted image data Dout within the detection range is inputted into the switch as Dout. Assuming that 0 is stored in the register C (411), the switch 410 passes Dout through when the selection signal is produced, while it outputs 0 when the selection signal is not produced.

Specifically, the range from which the maximum value of the adjusted image data is to be detected is selected as such a range that the above-mentioned noise can be eliminated and the features of the display image can be taken in. For example, it is preferable that adjusted image data for one to one-tenth of the total rows of wiring from the upper and lower ends of the display area should be excluded from the detection range so that the adjusted image data for the other rows in the middle will be selected.

Assuming that the output image 3) of the I/P converter is inputted into the wiring with 768 rows in total, the selection unit has only to set 0 for outputs of the image corresponding to several upper and lower horizontal lines (ranging from 1 to 10).

Figure 41:
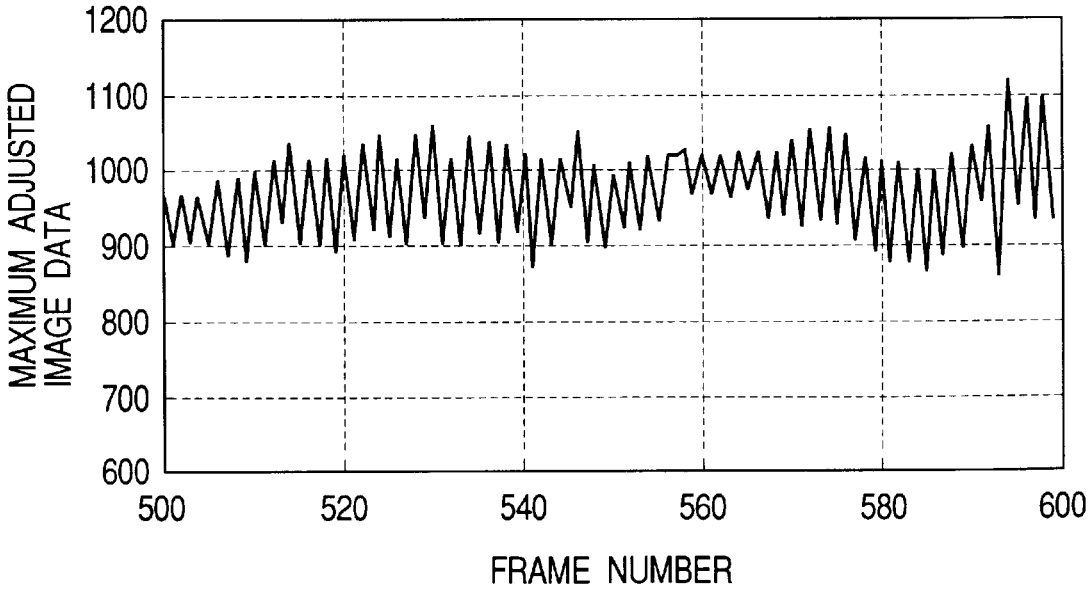
FIG. 41 is a graph showing changes of maximum adjusted image data for motion picture with noise described in an eleventh embodiment of the present invention.
Figure 44:
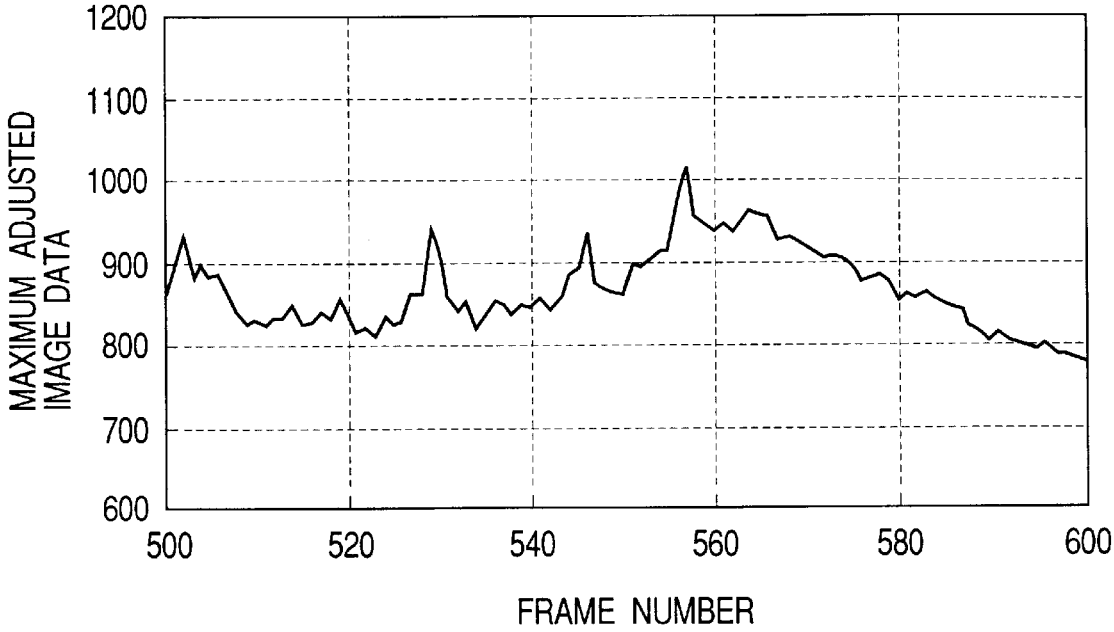
FIG. 44 is a graph showing changes of maximum adjusted image data when the noise part is ignored described in the eleventh embodiment of the present invention.

FIG. 44 is a line graph showing output from the maximum value detection circuit 20 when the image data shown in FIG. 41 is inputted through the range selection unit 400.

It is apparent from FIG. 4fourthat significant changes of the maximum value (that is, variations in gain) on a frame-by-frame basis disappear, and hence flick is prevented from occurring in the display image.

Figure 45:
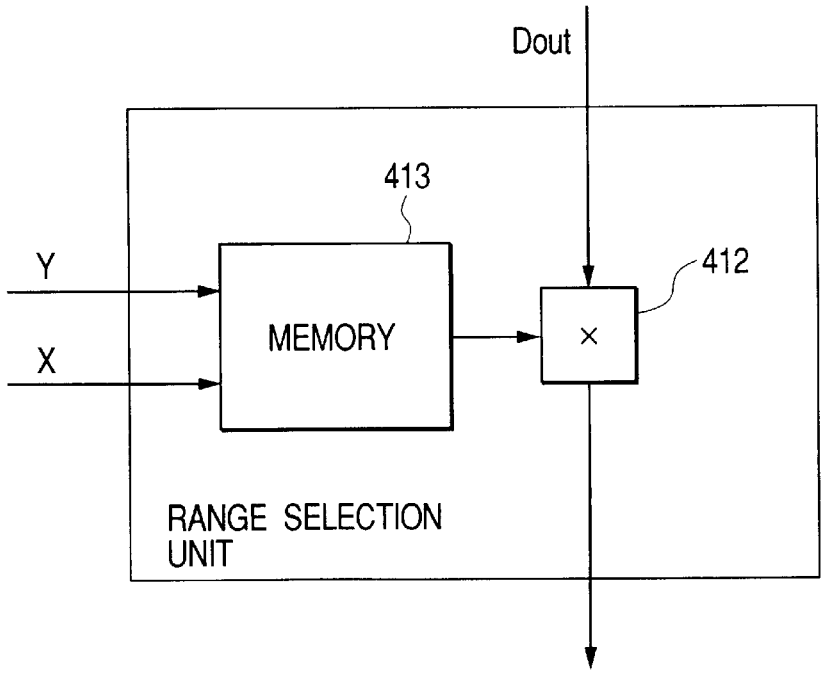
FIG. 45 is a block diagram showing another configuration of the range selection unit according to the eleventh embodiment of the present invention.
Figure 46:
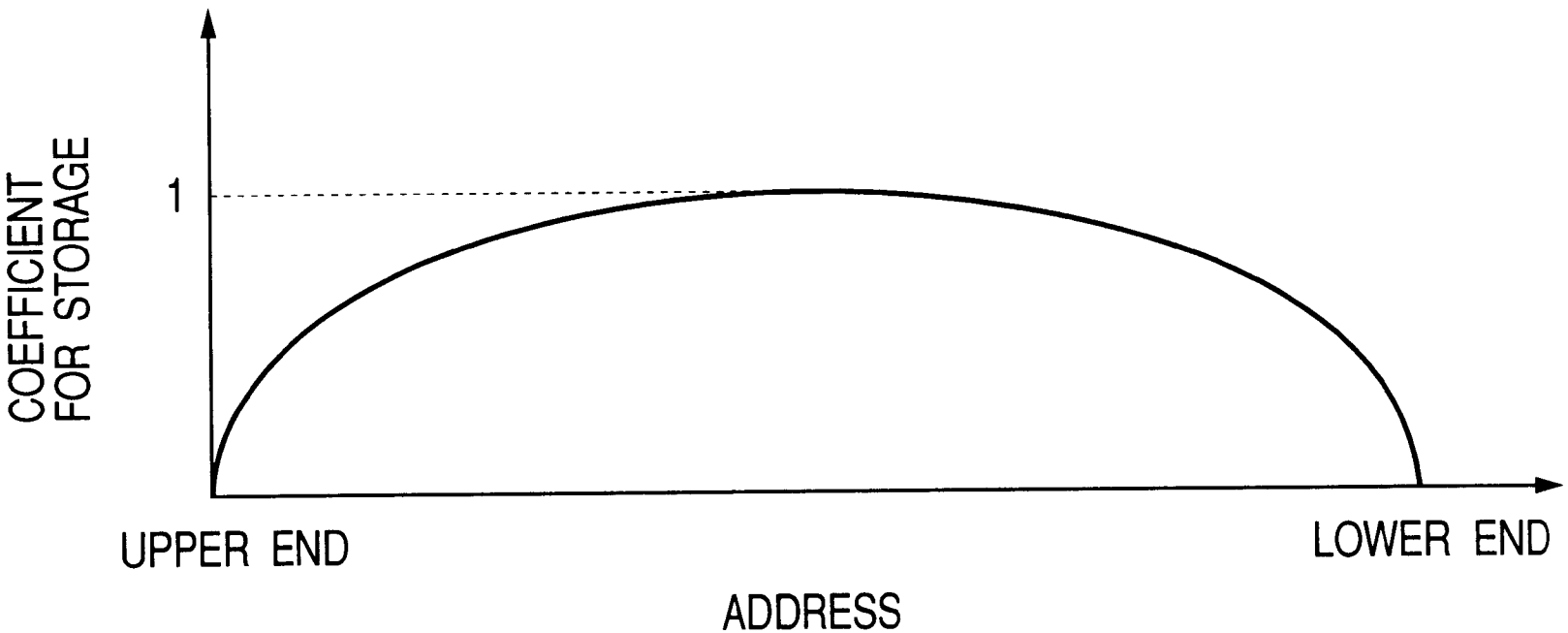
FIG. 46 is a graph showing a weight characteristic of the range selection unit according to the eleventh embodiment of the present invention.

As a modification, the range selection unit 400 may be constituted as shown in FIG. 45. In this case, the same effect can be obtained. In FIG. 4fifthe reference numerals 412 and 413 designate a multiplier and a memory respectively. The memory 413 stores weights, by which values of adjusted image data not to be detected as the maximum value will be made smaller, together with the positions of the adjusted image data as addresses. The multiplier 412 multiplies adjusted image data sequentially inputted and outputs from the memory 413 together, and outputs the multiplication results one by one. For example, if adjusted image data near the upper and lower ends should not be detected, such weights that a smooth convex curve with 0 at the upper and lower ends and 1 at the center will be plotted may be stored in the memory 413.

Although there are many images with noise created in apparatuses other than the image display apparatus of the present invention such as images that have been subjected to I/P conversion, the above-mentioned configuration makes it possible to properly reduce changes of the maximum adjusted image data due to the noise, that is, variations in gain.

(Twelfth Embodiment)

In the twelfth embodiment of the present invention, the range selection unit 400 is provided to the output of the adjusted data calculation unit 14 as shown in FIG. 4seventhis configuration has the same effect as that of the above-mentioned embodiment.

In FIG. 4seventhe reference numeral 14 designates the adjusted data calculation unit 14 and 400 is the range selection unit. In this configuration, the range selection unit 400 performs processing for deselecting certain adjusted data or assigning weights to the input data so that the adjusted data will not be added to input data located at positions from which no maximum value should be detected, or the adjusted data will be assigned weights to make the values small. The other components are the same as those in the eleventh embodiment. In such a configuration, proper adjusted image data can be displayed.

(Thirteenth Embodiment)

Figure 48:
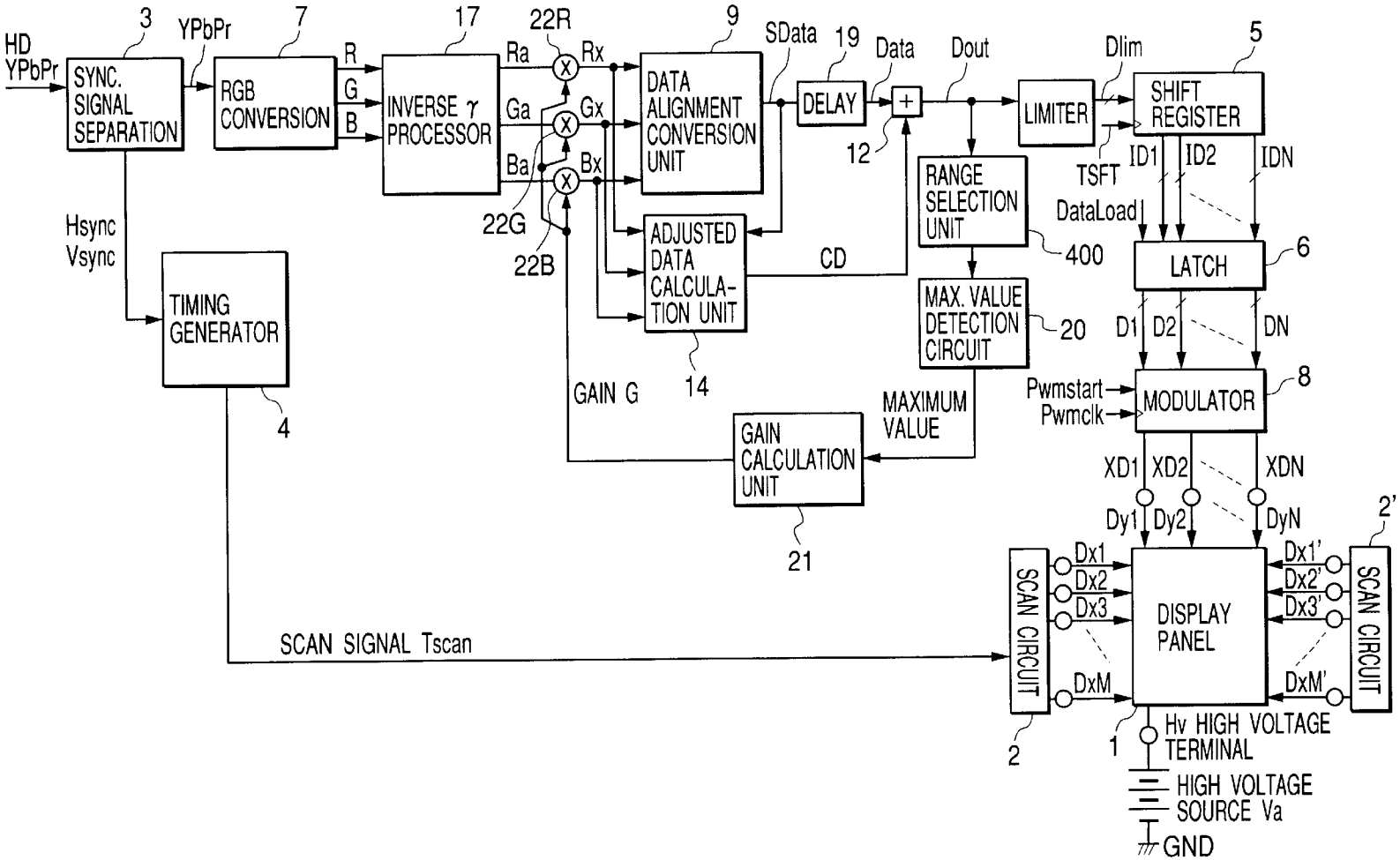
FIG. 48 is a block diagram showing a schematic configuration of an image display apparatus according to a thirteenth embodiment of the present invention.

As the thirteenth embodiment of the present invention, a configuration shown in FIG. 48 will be described. In FIG. 48, the reference numeral 20 designates the maximum value detection circuit, 21 is the gain calculation unit, 22R, 22G, and 22B are multipliers. The gain calculated by the gain calculation unit 21 is fed back to the outputs Ra, Ga, and Ba from the inverse γ processor 17 so that the outputs Ra, Ga, and Ba will be multiplied by the gain at the multipliers 22R, 22G, and 22B, respectively. In other words, data before subjected to correction or adjustment is reduced in advance in size so that the value of the data will fall within the input range limited by the modulator 8. The other components are the same as those in the eleventh and twelfth embodiments. In such a configuration, proper adjusted image data can also be displayed.

(Fourteenth Embodiment)

Figure 49:
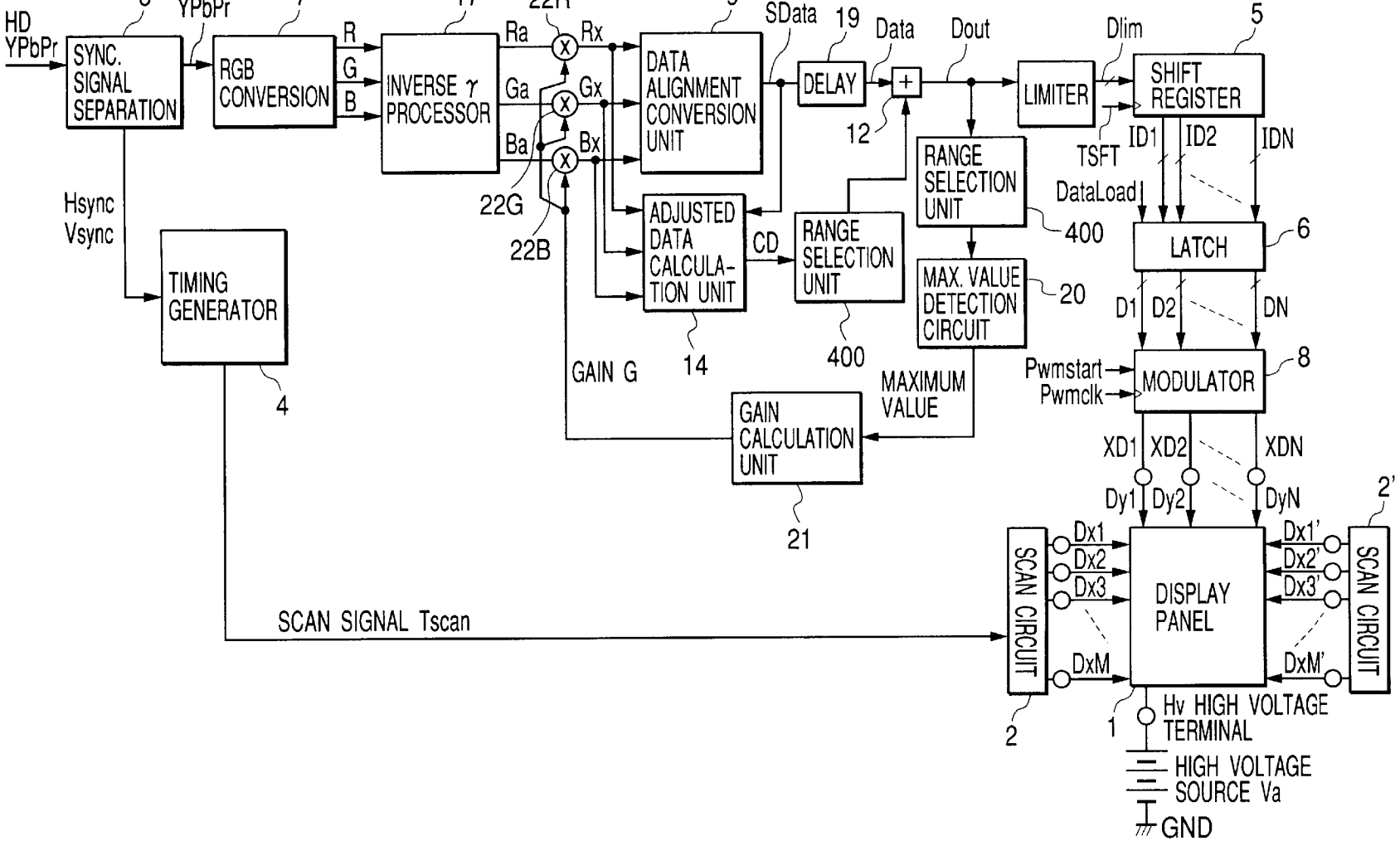
FIG. 49 is a block diagram showing a schematic configuration of an image display apparatus according to a fourteenth embodiment of the present invention.

As the fourteenth embodiment of the present invention, a configuration shown in FIG. 49 will be described. This embodiment combines the twelfth embodiment with the thirteenth embodiment. In other words, the range selection unit 400 is connected as in the twelfth embodiment, while the gain calculated by the gain calculation unit 21 is fed back to the outputs Ra, Ga, and Ba from the inverse γ processor 17 so that the outputs Ra, Ga, and Ba will be multiplied by the gain at the multipliers 22R, 22G, and 22B as in the thirteenth embodiment. The other components are the same as those in the eleventh to thirteenth embodiments. In such a configuration, proper adjusted image data can also displayed.

(Fifteenth Embodiment)

The inventors have found that images might cause the following problems in the overflow processing described above.

The problems will be described by taking as an example the overflow processing in the first embodiment. It should be noted that the overflow processing according to this embodiment could be adopted in the embodiments other than the first embodiment.

Suppose that the number of input bits into the modulator is 8, and the number of bits of the adjusted image data Dout is 9. In this case, if the maximum value of adjusted image data in a certain frame, that is, the output of the maximum value detection circuit is equal to or larger than 255, since gain is one time or less, any image degradation caused by multiplying the adjusted image data Dout by one-fold or less gain will hardly be recognized.

However, when a dark image across the entire screen like a nightscape is inputted, the maximum value of adjusted image data in the corresponding frame becomes small. For example, if the value of the adjusted image data is 2fifthe gain value is about 10 (255/25). Then, if the adjusted image data Dout is multiplied by the gain value, the following problems will arise:

First, the dark image is displayed too bright, and second, the display resolution becomes rough because of multiplication by the gain to make its pseudo-outline too shape. These problems remarkably reduce the quality of the display image. In other words, if the value of gain is large, the above-mentioned problems will arise.

Figure 50:
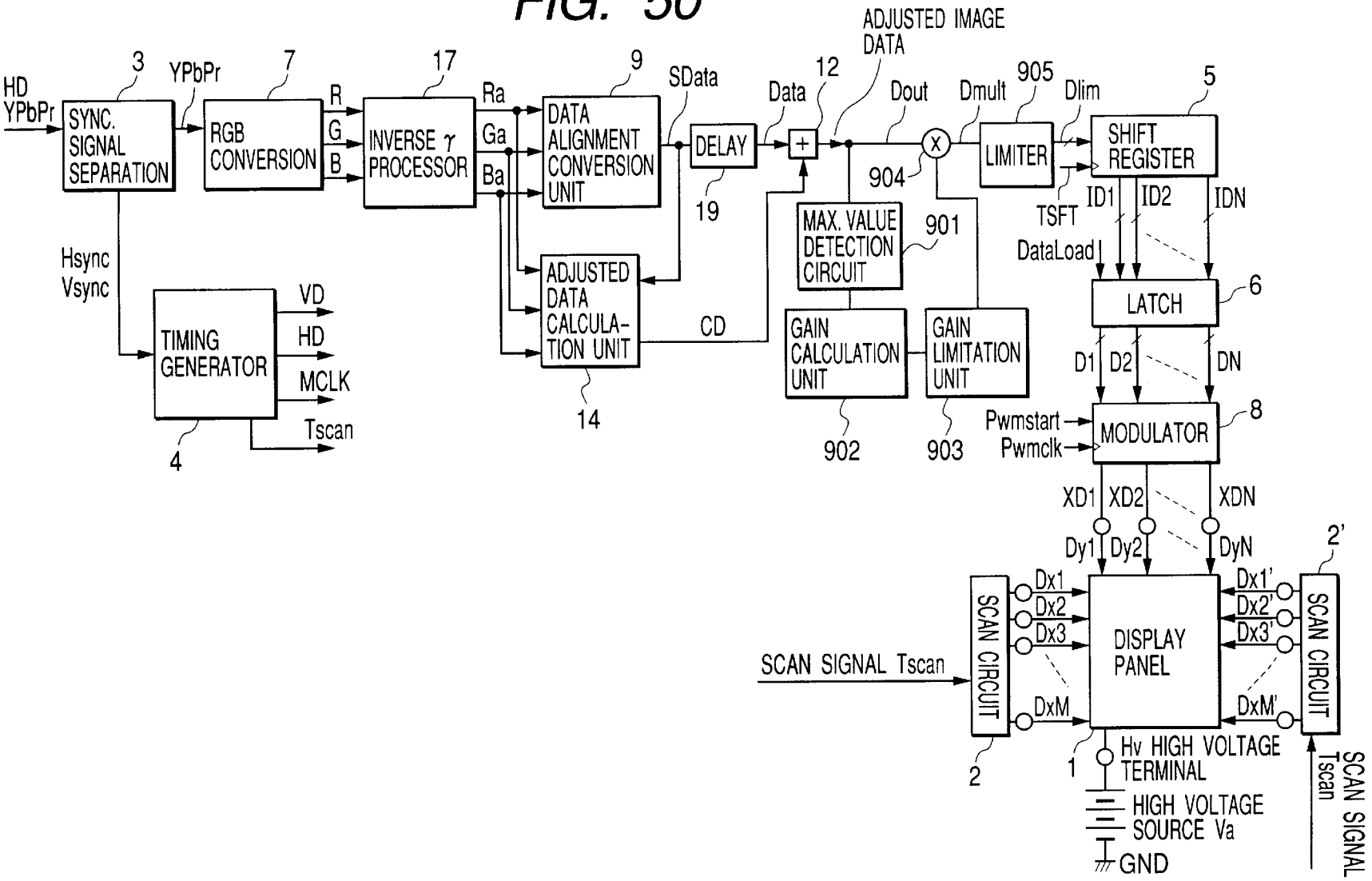
FIG. 50 is a block diagram showing a schematic configuration of an image display apparatus according to a fifteenth embodiment of the present invention.

FIG. 50 is a block diagram showing a schematic configuration of an image display apparatus according to the fifteenth embodiment of the present invention.

This embodiment prevents the degradation of display images mentioned above by the provision of the following components. In other words, there are provided a maximum value detection circuit 901 for detecting the maximum value of adjusted image data on a frame basis as will be mentioned later, a gain calculation unit 902 for calculating gain in such a manner that the output of the adder (adjusted image data) will fall within the input range of the modulator, a gain limitation unit 903 for limiting the maximum value of the gain calculated by the gain calculation unit, and a multiplier 904 for multiplying the output of the gain limitation unit and the adjusted image data together. This configuration makes them possible to control the gain not to be unnecessarily large for an input image that is dark on the whole, and control the gain to prevent occurrence of overflow in a light input image.

(Maximum Value Detection Means (Maximum Value Detection Circuit))

In the embodiment, the maximum value detection circuit 901 is connected to each part as shown in FIG. 50.

The maximum value detection circuit 901 is means for detecting the maximum value of adjusted image data Dout for one-frame. The detected maximum value of the adjusted image data is transferred to the gain calculation unit 902.

(Gain Calculation Means (Gain Calculation Unit))

The gain calculation unit 902 is means for calculating such gain that the adjusted image data Dout will fall within the input range of the modulator.

The gain may be determined according to Equation 20 or 21 described in the first embodiment.

Further, the gain is updated during a vertical return interval to change its value on a frame basis.

Like in the first embodiment, a limiter 905 to be described later may also be provided to the output of the multiplier for multiplying the adjusted image data and the gain together.

(Gain Limitation Unit)

In FIG. 50, the gain limitation unit 903 limits the maximum value of the gain calculated by the gain calculation unit 902, and outputs the limited value to the multiplier 904.

Figure 51:
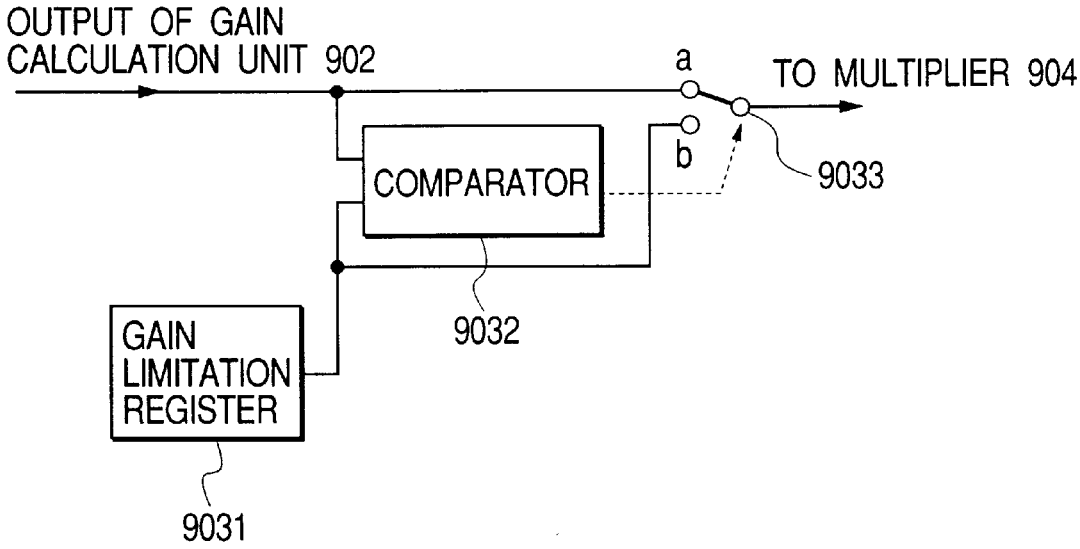
FIG. 51 is a block diagram showing a first configuration of a gain limitation unit according to the fifteenth embodiment of the present invention.

The gain limitation unit 903 is a limiter circuit (also called a gain limiter) and its specific configuration is shown in FIG. 51.

The output of the gain calculation unit 902 is inputted to one input of a comparator 9032 and one contact a of a switch 9033. On the other hand, the output of a gain limitation register 9031 is connected to the other input of the comparator 9032 and the other contact b of the switch 9033.

The maximum gain value is prestored in the gain limitation register 9031. The comparator 9032 compares the maximum gain value with the gain calculated by the gain calculation unit 902. When the gain calculated by the gain calculation unit 902 is larger than the maximum gain value stored in the register 9031, the contact b of the switch 9033 is selected, and the maximum gain value stored in the register 9031 is outputted.

On the other hand, when the gain calculated by the gain calculation unit 902 is smaller than the maximum gain value stored in the gain limitation register 9031, the contact a of the switch 9033 is selected, and the gain calculated by the gain calculation unit 902 is outputted.

The maximum gain value stored in the gain limitation register 9031 preferably takes on values from 0.5 to 2, and further preferably it is 1.

Figure 52:
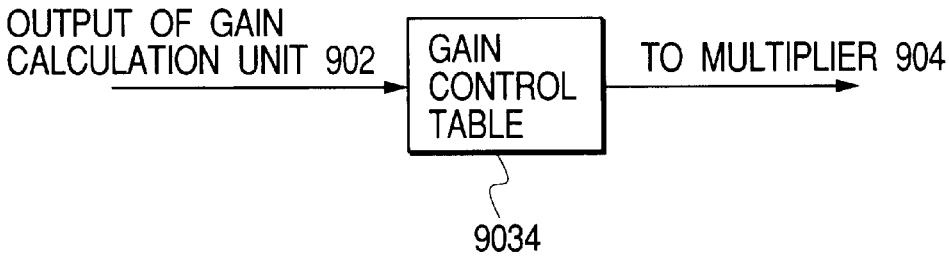
FIG. 52 is a block diagram showing a second configuration of a gain limitation unit according to the fifteenth embodiment of the present invention.

The inventors have confirmed that another configuration as shown in FIG. 52 may be used for limiting gain instead of the configuration using the above-mentioned gain limitation unit 903.

In FIG. 52, a gain control table 9034 is a memory (also called a gain table memory) in which gain limited characteristics are prestored.

The address line of the gain control table (gain table memory) 9034 is connected to the output of the gain calculation unit 902, while the data line of the gain control table (gain table memory) 9034 is connected to the multiplier 904.

Figure 53A:
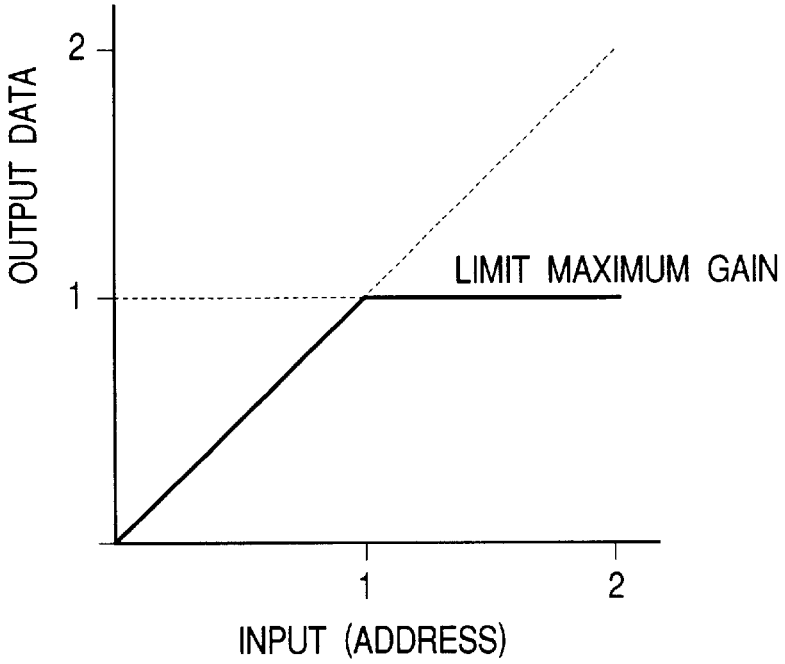
FIGS. 53A and 53B are graphs showing a gain limit characteristic of a gain limitation table according to the fifteenth embodiment of the present invention.

As a gain limited characteristic, for example, a characteristic shown in FIG. 53A is stored in the gain control table 9034 to realize the characteristic of the gain limitation unit 903 shown in FIG. 51 (in this example, the maximum gain value is 1, but it may preferably take on values from 0.5 to 2).

Figure 53B:
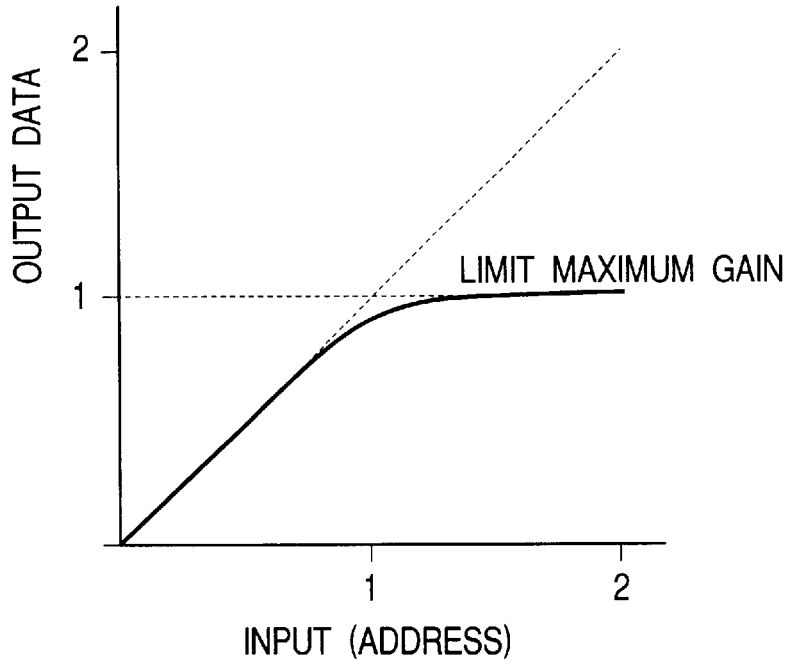

Then, the gain limited characteristic is controlled to smoothly plot a characteristic shown in FIG. 53B, thereby displaying the image properly (in this example, the maximum gain value is 1, but it may preferably take on values from 0.5 to 2).

In the embodiment, the gain calculation unit 902 and the gain limitation unit 903 are collectively called the limited gain calculation unit.

In the limited gain calculation unit, the gain calculation unit 902 takes in the maximum value of adjusted image data Dout (maximum adjusted image data) determined for one frame by means of the maximum value detection circuit 901 to calculate gain to be so multiplied that the adjusted image data Dout will fall within the input range of the modulator.

Then the gain limitation unit 903 limits the maximum gain value calculated by the gain calculation unit 902, and outputs the limited gain to the multiplier 904.

The limited gain calculation unit may be of the following configuration to obtain the same effect.

In this alternative configuration, the limited gain calculation unit is provided with means (a maximum value of adjusted image limitation unit, not shown) for limiting the minimum value (for setting the lower limit of the minimum value) for the maximum adjusted image data determined for one frame by means of the maximum value detection circuit 901.

The maximum value of adjusted image limitation unit is not shown here because it has almost the same configuration as the above-mentioned gain limitation unit 903.

The use of the image display apparatus according to this embodiment makes it possible to compensate a normal image for the influence of voltage drop on the scan wiring, and hence turn the brightness of the display image up. On the other hand, when an image having low average brightness is inputted, the image display apparatus can preferably prevent the dark image from being displayed too bright or the display resolution from becoming rough because of multiplication by the gain to make its pseudo-outline too shape.

(Sixteenth Embodiment)

The inventors have further examined the above-mentioned overflow processing and have confirmed that a feature calculation unit (scene change judgment unit) can perform the following processing to make a more precise judgment.

(Feature Calculation Unit (Scene Change Judgment Unit))

Figure 54:
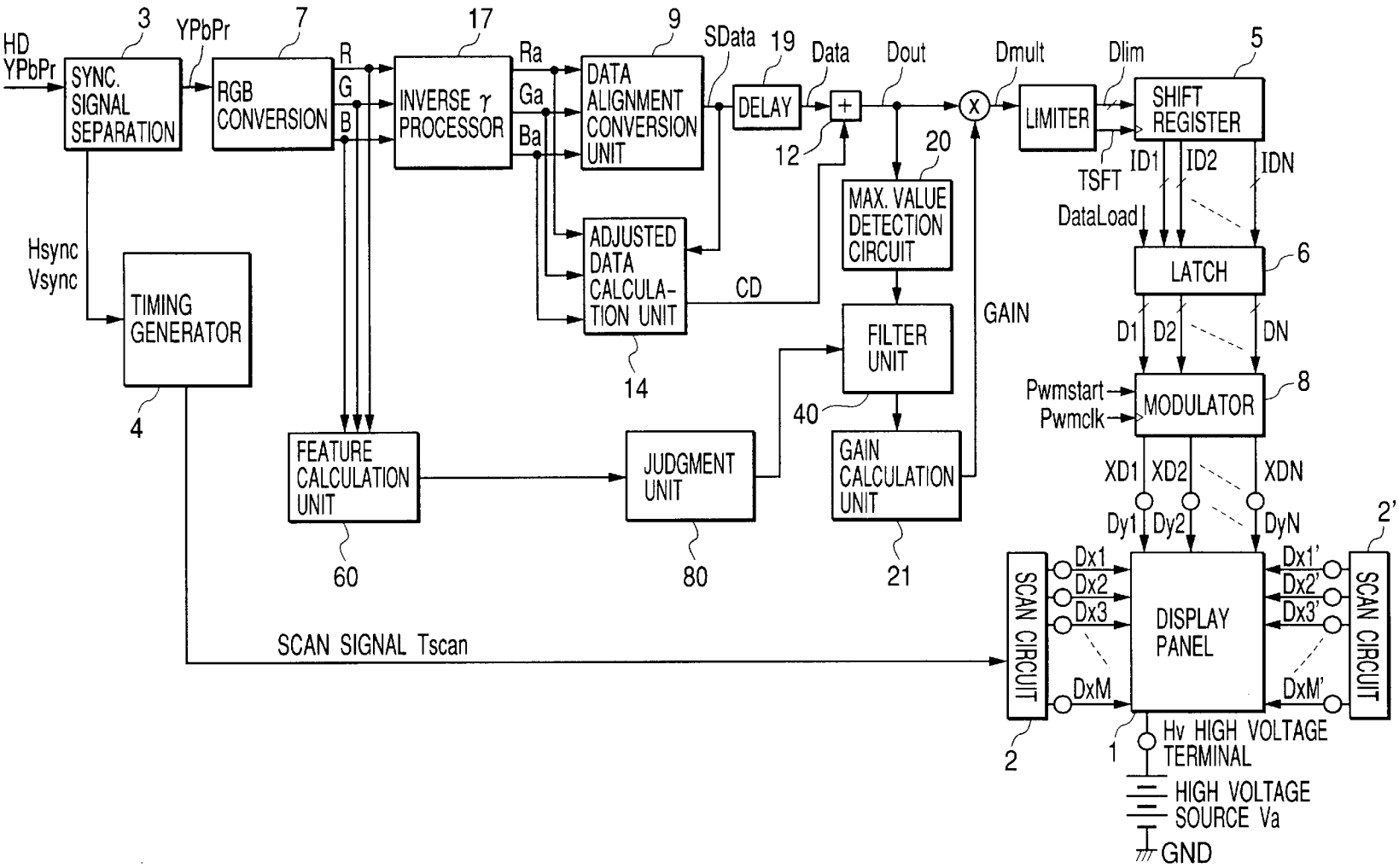
FIG. 54 is a block diagram showing a schematic configuration of an image display apparatus according to a sixteenth embodiment of the present invention.

A feature calculation unit 60 of this embodiment is connected to each part as shown in FIG. 54.

Figure 55:
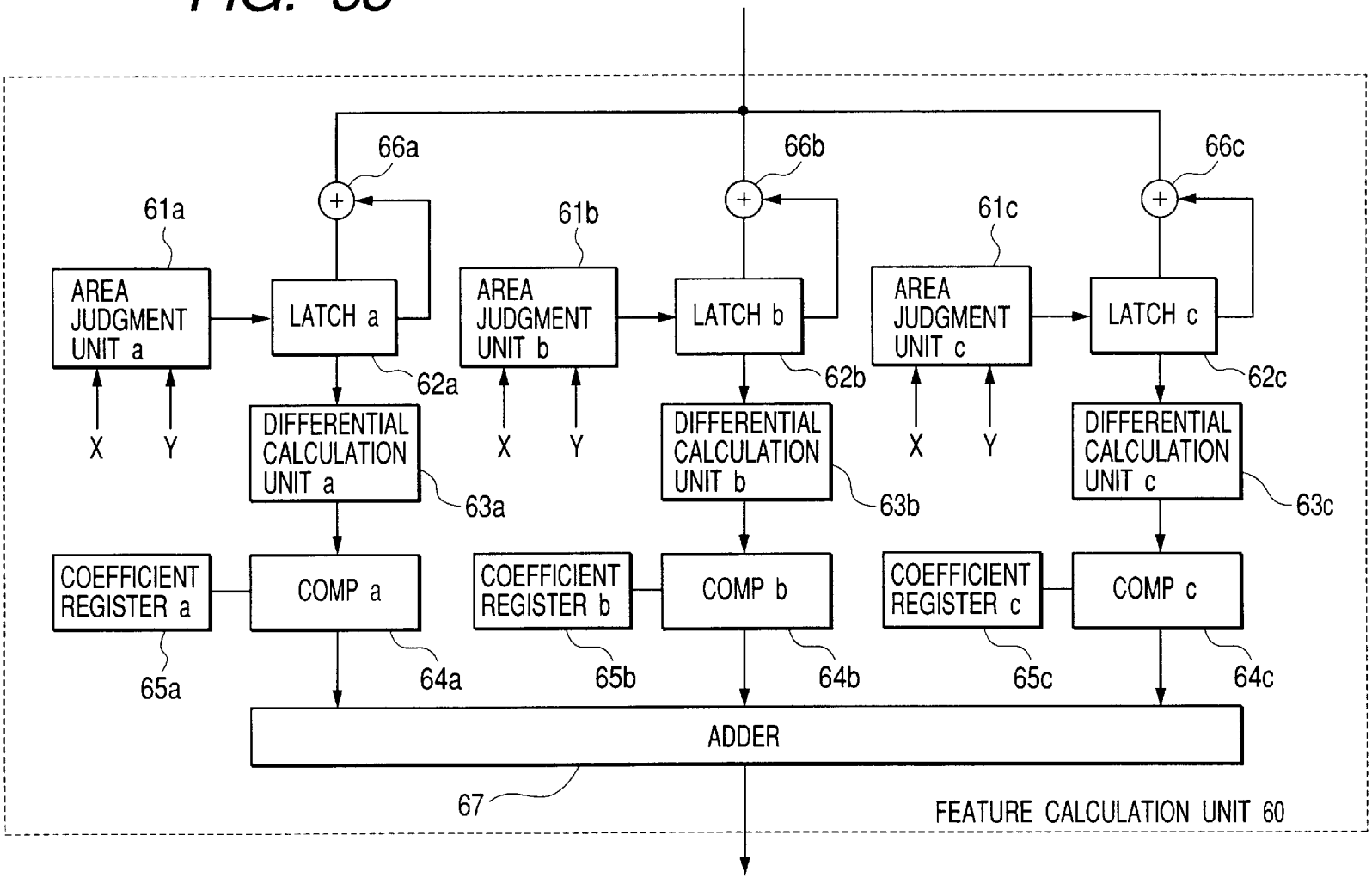
FIG. 55 is a block diagram showing a configuration of a feature calculation unit according to the sixteenth embodiment of the present invention.

The feature calculation unit 60 shown in FIG. 55 is means for calculating a partial average picture level (L_APL) of image data in each area one a frame basis, calculating an absolute value of a difference between frames, and adding results of comparison between the calculation results of respective areas with respectively predetermined values.

In the embodiment, three areas are selected as the predetermined areas.

In FIG. 5fifthe reference numerals 61*a*, 61*b*, and 61*c* designate area judgment units a, b, and c; 62*a*, 62*b*, and 62*c* are latches; 63*a*, 63*b*, and 63*c* are difference calculation units a, b, and c; 64*a*, 64*b*, and 64*c* are comparators a, b, and c; 65*a*, 65*b*, and 65*c* are coefficient registers a, b, and c; and 66*a*, 66*b*, 66*c*, and 67 are adders.

The adders 66*a*, 66*b*, and 66*c* add image data sequentially inputted to values stored in the latches 62*a*, 62*b*, and 62*c*, respectively, and store the added values back into the latches 62*a*, 62*b*, and 62*c*. Thus the image data sequentially inputted are added.

The area judgment units 61*a*, 61*b*, and 61*c* compare position information on the input image data with predetermined area information respectively stored therein, and if they accord with each other, the area judgment units 61*a*, 61*b*, and 61*c* output an enable signal to the latches 62*a*, 62*b*, and 62*c*, respectively.

If the value of each of the latches 62*a*, 62*b*, and 62*c* is reset to 0 at the beginning of each frame, the added value of the image data for the frame (that is, a value proportional to the mean value since the number of pixels in each area in one frame is fixed) will be determined at the end of the frame. The determined value is the average picture level (APL) in each area.

Next, each of the difference calculation units 63*a*, 63*b*, and 63*c* calculates the difference in the average picture level (APL) between frames on an area basis, and then calculates the absolute value.

Then, each of the comparators 64*a*, 64*b*, and 64*c* compares the absolute value in each area with a predetermined value stored in each of the coefficient registers 65*a*, 65*b*, and 65*c*. When the absolute value is larger than the predetermined value, it is considered that a scene change has partially taken place in the area, and 1 is outputted. On the other hand, when the absolute value in each area is smaller than the predetermined value, 0 is outputted.

Then, the adder 67 adds the outputs of the comparators 64*a*, 64*b*, and 64*c* to output the addition result as the output of the feature calculation unit 60. As the number of areas in which a scene change is judged increases, the output of the feature calculation unit 60 takes a larger value.

(Judgment Unit)

As shown in FIG. 54, a judgment unit 80 of the embodiment takes in the output of the feature calculation unit 60, compares the output with a predetermined value, and outputs the comparison result to a filter unit 40 to be described later.

Figure 56:
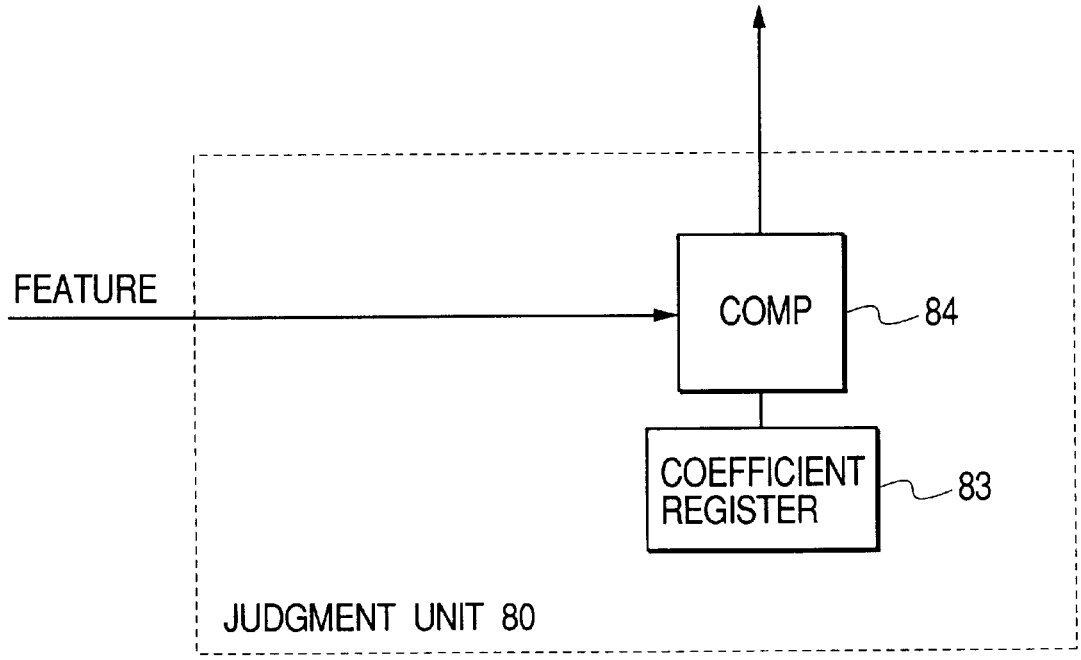
FIG. 56 is a block diagram showing a configuration of a judgment unit according to the sixteenth embodiment of the present invention.

In FIG. 56 in which a configuration of the judgment unit 80 is shown, the reference numerals 83 and 84 are a coefficient register and a comparator respectively.

The comparator 84 compares the output from the feature calculation unit 60 with a predetermined value stored in the coefficient register 83. When the input value is larger than the predetermined value, the comparator 84 judges that a scene change has taken place, and outputs High.

In the above configuration, the adder 67 provided in the feature calculation unit 60 may be composed of AND circuits or OR circuits in combination. In this case, the judgment unit 80 becomes unnecessary, though the AND circuits or OR circuits need to be combined in a complicated configuration.

(Judgment of Scene Change)

As mentioned above, although the scene change judgment can change the output of the filter unit 40 to eliminate the sense of discomfort, if the scene change is judged from changes between frames in the average picture level (APL) of the entire screen, an error in detecting a scene change may occur.

Specifically, such an error occurs when a white-letter telop comes out in the lower part of the screen against the same background image. In this case, the white-letter telop turns up the average picture level (APL) of the entire screen, and since it causes a scene change to be erroneously judged, the screen is darkened abruptly immediately after the telop comes out.

To prevent this phenomenon, the embodiment is such that the screen is horizontally divided into three areas as predetermined areas stored and used in the feature calculation unit 60 so that the feature calculation unit 60 will calculate a partial average picture level (L_APL) in each area.

According to this configuration, only the partial average picture level (L_APL) corresponding to the area in the lowest part of the screen changes when the telop comes out, and the output of the adder 67 (that is, the output of the feature calculation unit) becomes 1. Therefore, 2 is stored as the value of the coefficient register 83*a*, thereby preventing occurrence of an error in detecting a scene change.

If the maximum value of the difference detection units 63*a*, 63*b*, and 63*c* is 25fifthe value actually stored in each of the coefficient registers 65*a*, 65*b*, and 65*c* will take on values from 5 to 20, and optimally it takes 10.

The above-mentioned configuration can prevent occurrence of an error in detecting a scene change, so that a sense of interference by flicker or sense of discomfort that is given to the viewer at the time of scene change can be eliminated properly.

For the sake of simplicity, the above example describes the configuration for eliminating the sense of discomfort due to the lateral telop. As for a scene in which a telop comes out vertically, a division of the screen into lateral areas is found effective. In actual situations, it is found effective that areas vertically and laterally subdivided by position information are adopted for eliminating the sense of discomfort caused by a combination of the lateral and vertical telops. In this case, each area is not necessarily independent.

The output of the inverse γ processor may be inputted into the feature calculation unit 60 so that a judgment will be made based on the difference between frames in the partial average picture level (L_APL) of each area. In this case, the same effect can be obtained.

Alternatively, adjusted image data may be inputted into the feature calculation unit 60 so that a judgment will be made based on the difference between frames in the partial average picture level (L_APL) of each area. In this case, the same effect can also be obtained.

Figure 57:
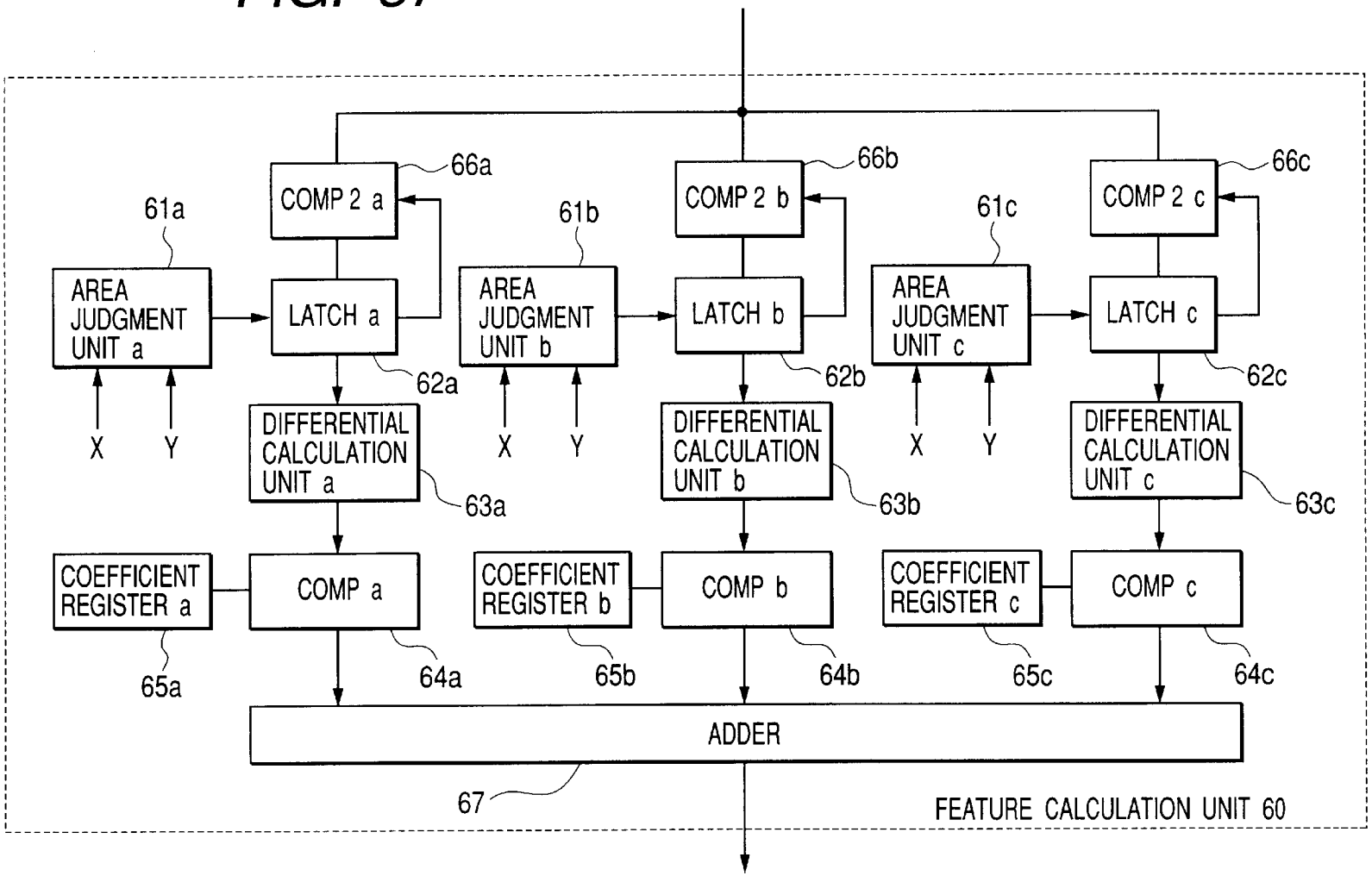
FIG. 57 is a block diagram showing another configuration of the feature calculation unit according to the sixteenth embodiment of the present invention.

Further, the feature calculation unit 60 may be constituted as shown in FIG. 57, in which adjusted image data is inputted into the feature calculation unit 60 so that a judgment will be made based on the difference between frames in the partial maximum value of each area. This configuration also has the same effect.

In FIG. 57, the reference numerals 61*a*, 61*b*, and 61*c* designate area judgment units a, b, and c; 62*a*, 62*b*, and 62*c* are latches a, b, and c; 64*a*, 64*b*, 64*c*, and 66*a*, 66*b*, 66*c* are comparators; 65*a*, 65*b*, and 65*c* are coefficient registers a, b, and c; and 67 is an adder.

The comparators 66*a*, 66*b*, and 66*c* compare values stored in the latches 62*a*, 62*b*, and 62*c* with adjusted image data sequentially inputted respectively, and stores larger values back into the registers 62*a*, 62*b*, and 62*c*. Thus the image data sequentially inputted are compared.

The area judgment units 61*a*, 61*b*, and 61*c* compare position information on the input adjusted image data with predetermined area information respectively stored therein, and if they accord with each other, the area judgment units 61*a*, 61*b*, and 61*c* output an enable signal to the latches 62*a*, 62*b*, and 62*c*, respectively. If the value of each of the latches 62*a*, 62*b*, and 62*c* is reset to 0 at the beginning of each frame, the partial maximum value of adjusted image data in the frame will be determined for each predetermined area at the end of the frame.

Next, each of the difference calculation units 63*a*, 63*b*, and 63*c* calculates the difference in the partial maximum value for each determined area, and then calculates the absolute value.

Then, each of the comparators 64*a*, 64*b*, and 64*c* compares the absolute value in each area with a predetermined value stored in each of the coefficient registers 65*a*, 65*b*, and 65*c*. When the absolute value is larger than the predetermined value, it is considered that a scene change has taken place in the predetermined area, and 1 is outputted. On the other hand, when the absolute value in each area is smaller than the predetermined value, 0 is outputted.

Then, the adder 67 adds the outputs of the comparators 64*a*, 64*b*, and 64*c* to output the addition result as the output of the feature calculation unit 60. As the number of areas in which a scene change is judged increases, the output of the feature calculation unit 60 takes a larger value.

The feature calculation unit 60 may be constituted such that an address for storing a value calculated for each area is allocated as memory so that the CPU will use the address to make a judgment or calculation. In this case, the same effect can be obtained.

As discussed above, this embodiment can reduce a sense of interference (flicker) that may occur in the overflow processing for voltage drop compensation or a sense of discomfort that may be given to the viewer at the time of scene change, thereby improving image quality.

(Seventeenth Embodiment)

The inventors further examined the overflow processing mentioned above, and have confirmed that the following processing for calculating gain is found further preferable.

Taking as an example the overflow processing shown in the first embodiment, the following ratings of gain G by which adjusted image data is multiplied in the overflow processing are found:

A. Use of a value equal to or smaller than that of gain G calculated so as not to overflow varies luminance in proportion to the gain G. In other words, the smaller the value of gain G, the lower the luminance, which makes the levels of gray much worse.

B. Use of a value larger than that of gain G calculated so as not to overflow increases luminance according to the value of gain G. In this case, if the value of gain G is large, the above-mentioned limiter 905 may not be able to display an image faithfully.

In further examining cases where the adjusted image data Dout is multiplied by gain G to display an image, subjective rating of a display image could vary depending on the external environment, especially the intensity of illumination in a place where the image is displayed.

In other words, the following are found:

C. When the intensity of illumination in a place where the image is displayed is low (when the viewer watches the screen in a dark room), subjective rating of the display image is improved by compensating for picture degradation due to the influence on the scan wiring, rather than by displaying the image on the screen with an increased intensity of illumination (that is, by turning luminance of the screen up).

D. When the intensity of illumination in a place where the image is displayed is high (when the viewer watches the screen in a bright room), subjective rating of the display image is improved by displaying the image on the screen with an increased intensity of illumination (that is, by turning luminance of the screen up), rather than by compensating for picture degradation due to the influence on the scan wiring.

Although a reference value used here is not uniquely determined, the optimum value can be determined as the reference value in consideration of various facts such as features of the image display apparatus, user's preferences, and its utilization area. For example, the reference value may be considered to be the intensity of illumination in an environment in which the image display apparatus is used most frequently.

From such configurational and subjectively evaluative points of view, the inventors have provided the following configuration for multiplying adjusted image data by gain to display an image so that a proper display image can be obtained.

FIG. 58 is a block diagram showing a schematic configuration of an image display apparatus according to the seventeenth embodiment.

In addition to the above-mentioned basic configuration of the present invention, this configuration includes an external environment input unit 906, and a KGAIN table (conversion unit) 907 for converting the output of the external environment input unit 906 to KGAIN. Further, the gain calculation unit 902 calculates gain G from the output of the maximum value detection circuit 901 and the KGAIN in a manner described later. The multiplier then multiplies the output of the adjusted image data by the gain calculated on a frame basis to calculate input data into the modulator, thereby obtaining a proper display image.

The details will be described below.

(Maximum Value Detection Means (Maximum Value Detection Circuit))

The maximum value detection circuit of the embodiment is connected to each part as shown in FIG. 58.

The maximum value detection circuit 901 is means for detecting the maximum value of adjusted image data Dout for one frame.

The detected maximum value of the adjusted image data (maximum adjusted image data) is transferred to the gain calculation unit 902.

(Gain Calculation Means (Gain Calculation Unit))

The gain calculation unit 902 is means for calculating a multiplier factor (gain G) by which the adjusted image data Dout is multiplied. The following is an example of an actual expression used in the gain calculation unit 902:

If the maximum value of output data outputted from the adder and detected by the maximum value detection circuit is MAX, the maximum value of the input range of the modulator is INMAX, and the output of the KGAIN table (conversion) to be described later is KGAIN, the gain can be determined by $$\text{Gain } G \leqq \text{KGAIN} \times (\text{INMAX}/\text{MAX}) \quad \text{(Eq. 26)}$$

When the gain G is determined by this method, if the value of KGAIN is set larger than 1, the gain G can be relatively high to turn luminance of the display image up.

The gain G determined by the gain calculation unit 902 is updated during a vertical return interval to change the value on a frame basis.

If KGAIN is larger than 1, the output of the multiplier 904 will contain more data that exceed the maximum value of the input range of the modulator 8, Then, if such adjusted image data is multiplied by KGAIN in a manner described later, the adjusted image data Dmult will overflow.

In the image display apparatus of the embodiment, the maximum value of adjusted image data in the immediately preceding frame is used to calculate gain by which the adjusted image data in the current frame is multiplied.

Therefore, an overflow may take place in the strict sense because the values of adjusted image data vary from frame to frame.

To cope with the above-mentioned two causes of overflow, a limiter 905 is provided to the adjusted image data multiplied by KGAIN (the output of the multiplier), and the circuit is so designed that the output of the multiplier 904 will fall within the input range of the modulator 8.

It is clear from the result C. of the subjective evaluation that when the environment in which the display apparatus is placed is dark, KGAIN is set equal to 1 so that the display image will be high in fidelity (low in luminance instead).

On the other hand, from the result D. of the subjective evaluation, when the environment in which the display apparatus is placed is bright, KGAIN is set to a value in a range between 1 and 2 so that the display image will be high in luminance (low in fidelity instead).

The value of KGAIN is set as mentioned above so that a subjectively proper image can be displayed.

A specific method for creating KGAIN will be described later.

(Multiplier)

The multiplier 904 of FIG. 58 multiplies the adjusted image data Dout and the output of the gain calculation unit 902 together, and transfers the multiplied value to the limiter 905 as adjusted image data Dmult. The multiplier 904 may be constituted of a so-called logic circuit, or in such a configuration that the multiplied result is stored in a table memory (ROM or RAM), so that when two parameters to be multiplied together is inputted at the memory address, the multiplied result is outputted from the data.

Since the limiter 905 to which the output of the multiplier 904 is connected may be constituted of a table memory, the multiplier 904 and the limiter 905 can be combined into a single table memory.

In this case, only the data for limiting the multiplied result may be described as contents to be stored in the table memory.

The following will describe preferable limiter characteristics.

(Limiter)

Although the gain G is determined as mentioned above, an overflow may often take place as mentioned above. Therefore, a limiter is so provided that the modulator will not overflow.

The limiter 905 has a preset limit value, and compares the limit value with the output data Dmult inputted to the limiter 905. When the limit value is smaller than the output data Dmult, the limit value is outputted, while when the limit value is larger than the output data, the output data is outputted (note that the output data is denoted as Dlim in FIG. 58).

Figure 59A:
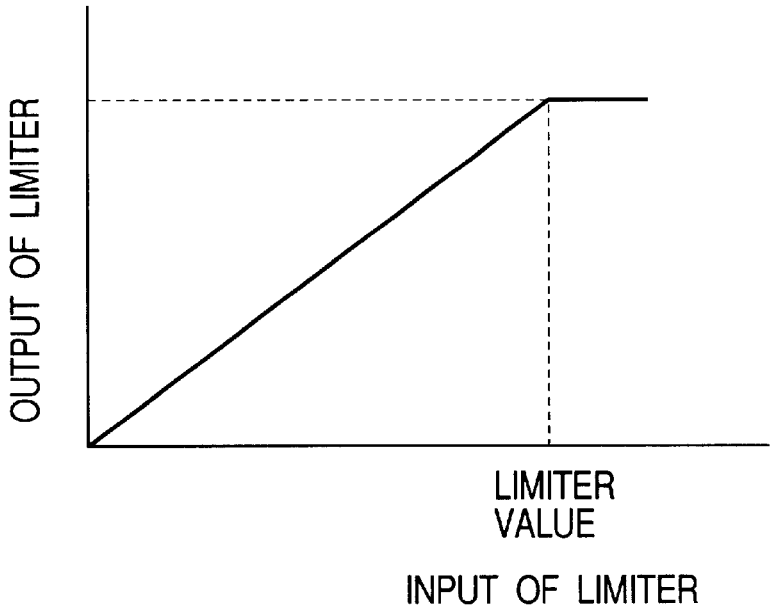
FIGS. 59A and 59B are graphs showing a characteristic of a limiter unit according to the seventeenth embodiment of the present invention.
Figure 59B:
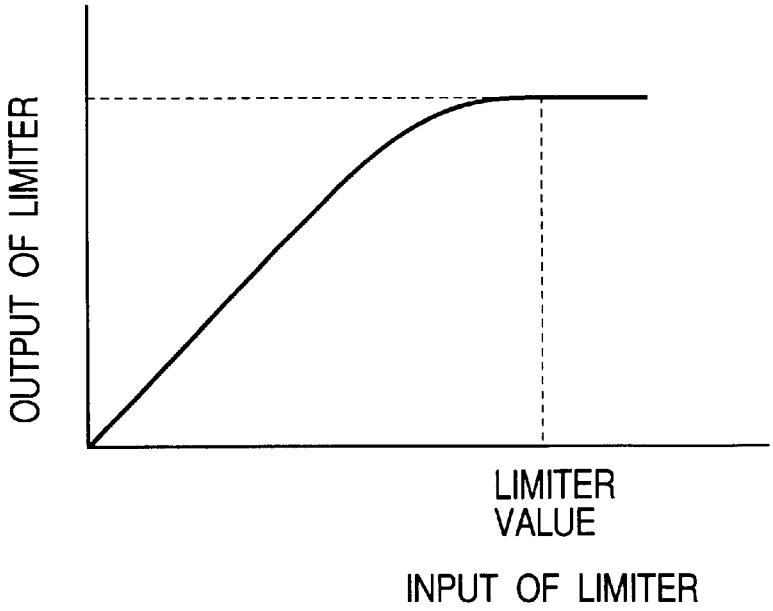

The limiter 905 may have a characteristic that plots a direct line with a fixed gradient to the maximum value as shown in FIG. 59A, or a characteristic like a saturation characteristic that plots a saturation curve saturated at the point of the maximum value as shown in FIG. 59B. The limiter having the characteristic of FIG. 59A can be realized by a comparator, while the limiter having the characteristic of FIG. 59B can be realized by a table memory or the like.

The adjusted image data that has been completed limited by the limiter 905 within the input range of the modulator 8 is supplied to the modulator 8 through the sift register 5 and the latch circuit 6.

(External Environment Input Unit)

The external environment input unit 906 may be mainly composed of a sensor such as a CdS light-receiving device or photo diode, and placed near the display panel. The external environment input unit 906 converts to an electric signal the intensity of illumination in the environment in which the display apparatus is placed, and an analog-digital converter further converts the electric signal to a digital signal to be outputted.

The external environment input unit 906 includes a low-pass filter, not shown, designed to vary the output slowly according to the time variations in the environment (the intensity of illumination). This configuration can further improve the display image.

(User Input Unit)

A user input unit 908 can be realized by a switch or the like that allows the user to select desired one of conversion characteristics stored in a KGAIN table to be described later. Of course, the user input unit 908 may also realized by any other means such as a remote control.

(KGAIN Table)

Figure 60:
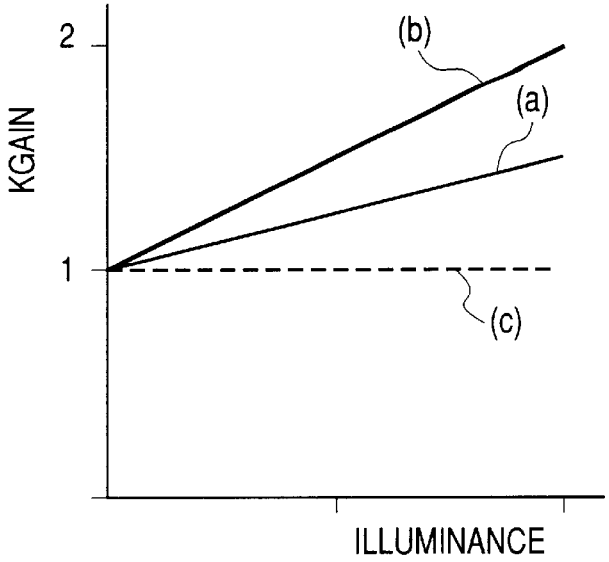
FIG. 60 is a graph showing an example of a characteristic of a KGAIN table according to the seventeenth embodiment of the present invention.

The KGAIN table 907 is means for converting the output of the external environment input unit to KGAIN. KGAIN is a table such as to output 1 in a dark environment or 1.5 in a bright environment as shown in FIG. 60. The KGAIN table 907 is composed of a memory in which the above-mentioned characteristics are prestored.

The user can also select any one of characteristics (a), (b), and (c) shown in FIG. 60 to suit user's preference. This function can be realized by connecting the output of the user input unit to the upper address of the memory constituting the KGAIN table 907 and changing banks.

The characteristic (a) in FIG. 60 is an example in which KGAIN is converted to 1 in a dark environment and 1.5 in a bright environment.

In this case, as will be described later, when the external environment is dark, gain G is so calculated that the adjusted image data Dmult will be displayed without overflow. This makes it possible to display the image faithfully.

When the external environment is bright, gain G is set higher to turn display luminance up. If the external environment is bright, since the adjusted image data Dmult overflows from the modulator 8, the limiter 905 limits the output of the multiplier 904. As a result, the display luminance is turned up, but the fidelity is made worse instead.

Use of such a KGAIN table makes it possible to display a subjectively proper image as shown in the above-mentioned subjective ratings (C. and D.).

The characteristic (b) of FIG. 60 is an example in which KGAIN is converted to 1 in a dark environment and 2 in a bright environment. In this case, since when the external environment is bright, the value of KGAIN is set larger than that of the characteristic (a) of FIG. 60, an image brighter, though lower in fidelity, than that of (a) in FIG. 60 can be displayed. The user selects a proper conversion table through the user input unit according to the kind of the input image to be displayed.

The characteristic (c) of FIG. 60 is an example in which KGAIN is fixed to 1. In this case, since KGAIN is fixed to 1 regardless of the brightness of the external environment, the adjusted image data Dmult can be displayed without overflow. This characteristic may be selected when the user wants to display the image faithful to the input image.

The inventors have further studied and found that the KGAIN table 907 could have the following characteristics to bring about proper results.

Figure 61:
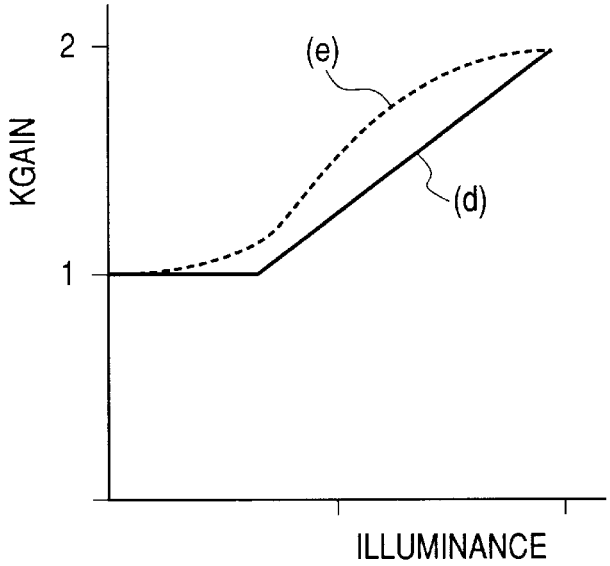
FIG. 61 is a graph showing an example of a characteristic of a KGAIN table according to the seventeenth embodiment of the present invention.

For example, indicated with (d) in FIG. 61 is an example in which KGAIN=1 that ranges from low to medium intensities of illumination. In this case, even when the external environment is brightish, a faithful image can be displayed. On the other hand, if the KGAIN table has a characteristic (e) as shown in FIG. 61 which varis KGAIN smoothly with respect to the intensity of external illumination. In this case, even when the intensity of external illumination varies, the sense of discomfort given to the viewer who views the image display panel is reduced.

Figure 62:
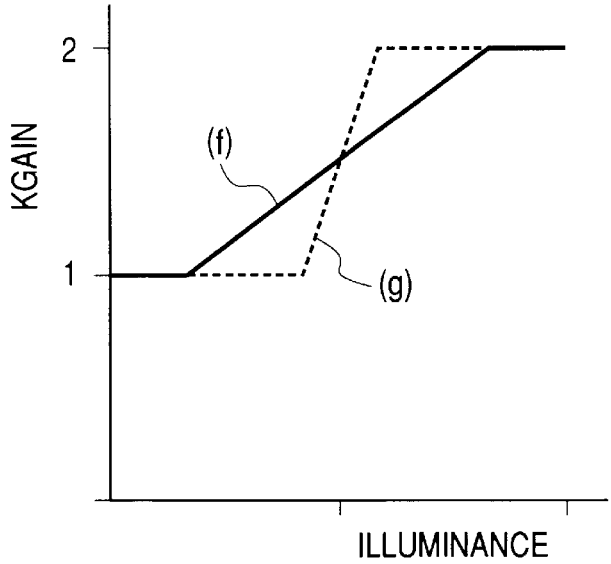
FIG. 62 is a graph showing an example of a characteristic of a KGAIN table according to the seventeenth embodiment of the present invention.
Figure 63:
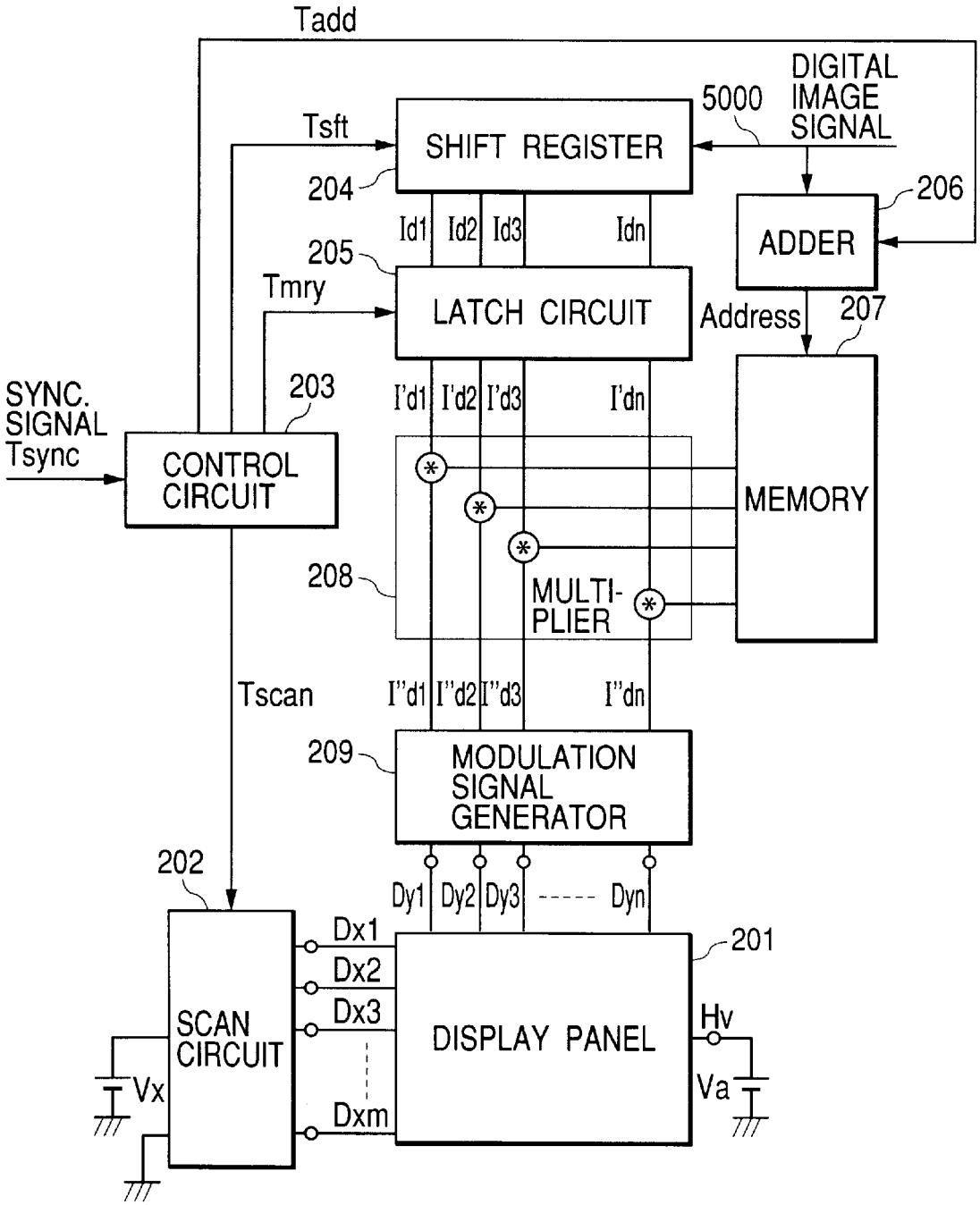
FIG. 63 is a block diagram showing a schematic configuration of a conventional image display apparatus.

Further, characteristic curves shown with (f) and (g) in FIG. 62 are also found effective.

Since the above-mentioned characteristics can be selected by the output of the user input unit, a proper image can be displayed according to user's preferences, the kind of the input image, or the like.

In the embodiment, the external environment input means is provided for inputting external environment information (intensity of illumination), and the conversion unit (KGAIN table) converts the value to KGAIN to obtain a KGAIN characteristic.

Then, the gain calculation unit calculates gain G by which the adjusted image data or input image data is multiplied. In this configuration, when the intensity of illumination in a place in which the image is displayed is lower than a reference value (when the viewer watches the screen in a dark room), picture degradation due to the influence on the scan wiring is accurately compensated for without turning display luminance up (rather than making the display screen brighter) . On the other hand, when the intensity of illumination in a place in which the image is displayed is higher than the reference value (when the viewer watches the screen in a bright room), picture degradation due to the influence on the scan wiring is accurately compensated for to turn display luminance up (to make the display screen brighter), thereby obtaining subjectively proper display image.

As described above and according to the present invention, the image display apparatus can properly improve the degradation of display images due to the influence of voltage drop on the scan wiring that has been the problem in the conventional.

Further, some approximations are introduced, so that adjusted image data in which the influence of voltage drop has been compensated for can be calculated properly in a simple manner. This has excellent effects such as to realize the calculations with very simple hardware configuration.

Furthermore, the image display apparatus of the present invention includes an overflow processing circuit that prevent the image data after adjusted from overflowing from the input range of the modulator. For the overflow processing, methods are changed between a television picture signal and a computer picture signal, so that high-quality images can be displayed.

What is claimed is:

1. An image display apparatus including a display panel having plural rows of wiring and plural columns of wiring, and image forming devices connected with the rows and columns of wiring and arranged in a matrix, scan means for selectively scanning the rows of wiring, and modulation means connected with the columns of wiring, said image display apparatus comprising:

adjusted image data calculation means for calculating adjusted image data with respect to image data; and amplitude adjustment means for adjusting the amplitude of the adjusted image data so that the amplitude will fall within an input range of said modulation means, wherein said modulation means takes in the adjusted image data with the amplitude adjusted and outputs modulated signals to the columns of wiring.

2. The image display apparatus according to claim 1, wherein said adjusted image data calculation means is means that compensates the image data at least for the influence of voltage drop due to resistance of the rows of wiring.

3. The image display apparatus according to claim 2, wherein said adjusted image data calculation means increases the size of the image data inputted into said adjusted image data calculation means to obtain the adjusted image data.

4. The image display apparatus according to claim 2, wherein said amplitude adjustment means includes a maximum value detection unit for detecting the maximum value of the outputs of said adjusted image data calculation means, and a gain calculation unit for calculating the gain so that the maximum value will fall within the input range of said modulation means.

5. The image display apparatus according to claim 4, wherein said amplitude adjustment means multiplies the adjusted image data or the image data by the gain to obtain the adjusted image data with the amplitude adjusted.

6. The image display apparatus according to claim 4, further comprising a limiter arranged for limiting the adjusted amplitude of the adjusted image data so that it will completely fall within the input range of said modulation means.

7. The image display apparatus according to claim 4, wherein the gain is adaptive gain calculated on a frame basis.

8. The image display apparatus according to claim 7, wherein said amplitude adjustment means includes filter means for limiting gain fluctuations in each frame.

9. The image display apparatus according to claim 8, wherein said amplitude adjustment means further includes a scene change judgment unit for detecting a scene change indicating that display images have changed from one scene to another, and said gain calculation unit calculates a gain the fluctuations in a time axis of which is suppressed, out of the adjusted image data from the time when the scene change has been judged to the current frame.

10. The image display apparatus according to claim 9, wherein said scene change judgment unit judges the change in scene from a differential between frames in the average picture level (APL) of the input image data calculated on a frame basis and/or a differential between frames in the maximum value of the adjusted image data calculated on a frame basis.

11. The image display apparatus according to claim 4, wherein said amplitude adjustment means includes a gain limitation unit for limiting the gain to or below an upper limit value settable in advance.

12. The image display apparatus according to claim 4, wherein said maximum value detection unit detects the maximum value of adjusted image data in a predetermined area rather than throughout the display area.

13. The image display apparatus according to claim 12, wherein said maximum value detection unit detects the maximum value of adjusted image data to which a weight is assigned by area selection means for assigning to the adjusted image data the weight determined according to its display position.

14. The image display apparatus according to claim 13, wherein weights assigned by said area selection means are heavy in the center and light on the periphery of the adjusted image data.

15. The image display apparatus according to claim 12, wherein said maximum value detection unit excludes adjusted image data for one to one-tenth of the total rows of wiring from the upper and lower ends of the display area so that the maximum value of the adjusted image data for the other rows will be detected.

16. The image display apparatus according to claim 9, wherein said scene change judgment unit divides the display area into plural areas and judges a scene change on an area basis, and judges a scene change on the entire screen from the judgment result of each area.

17. The image display apparatus according to claim 16, wherein said scene change judgment unit divides the display area into plural areas and calculates partial average picture level (L_APL) of the image data or adjusted image data in each area on a frame basis, while said scene change judgment unit calculates a differential between frames in the partial average picture level, compares the differential with a predetermined amount to judge a scene change in each area as well as convert the judgment results into numbers, such that said scene change judgment unit adds the numeric values of the judgment results, and compares the added value with a predetermined value to judge a scene change on the entire screen.

18. The image display apparatus according to claim 4, wherein said amplitude adjustment means includes an external intensity of external illumination input unit for detecting the intensity of illumination around said image display apparatus and outputting an output signal according to the detection result so that gain will be adjusted according to the output signal from said intensity of external illumination input unit.

19. The image display apparatus according to claim 18, wherein the maximum value of adjusted image data is adjusted according to the output of said intensity of external illumination input unit to calculate the amount of adjustment of the gain based on the adjusted maximum value.

20. The image display apparatus according to claim 18, wherein said amplitude adjustment means has a function that does not adjust the gain for amplitude adjustment when the intensity of illumination is lower than a reference value, or changes the gain to a larger value when the intensity of illumination is higher than the reference value.

21. The image display apparatus according to claim 18, wherein a method for gain adjustment performed by said amplitude adjustment means according to the intensity of external illumination is selected by user input means capable of being operated by a user.

22. The image display apparatus according to claim 4, wherein said amplitude adjustment means includes at least two operation modes, which include a first mode for outputting the adaptive gain calculated on a frame basis, and a second mode for outputting preset fixed gain that does not vary from frame to frame.

23. The image display apparatus according to claim 22, wherein when an input picture signal is a television picture signal, said first operation mode is selected, while when it is a computer picture signal, said second operation mode is selected.

24. The image display apparatus according to claim 22, wherein said operation modes are selectable by the user.

25. The image display apparatus according to claim 2, wherein said adjusted image data calculation means includes means for predictively calculating spatial distribution of and time variations in the amount of voltage drop that may occur on the row wiring during one horizontal scan interval according to the input image data, and means for calculating adjusted image data obtained by making an adjustment to the input image data from the amount of voltage drop calculated.

26. The image display apparatus according to claim 25, wherein said adjusted image data calculation means includes means for predictively calculating, in a discrete manner in both spatial and time-base directions, the amount of voltage drop that may occur on the row wiring during one horizontal scan interval according to the input image data, discrete adjusted image data calculation means for discretely calculating from the amount of voltage drop adjusted image data for image data corresponding to the time and spatial position at which the amount of voltage drop has been calculated, and adjusted image data interpolation means for interpolating the output of said discrete adjusted image data calculation means to calculate adjusted image data corresponding to the size of the input image data and its horizontal display position.

27. The image display apparatus according to claim 26, wherein said amplitude adjustment means performs the amplitude adjustment function in such a manner that the output of said discrete adjusted image data calculation means is multiplied by gain for adjusting the amplitude.

28. The image display apparatus according to claim 26, wherein said amplitude adjustment means performs the amplitude adjustment function in such a manner that the output of said discrete adjusted image data calculation means is multiplied by gain for adjusting the amplitude, and the maximum value of the multiplied result is limited to such a value that the maximum value will fall within the input range of said modulation means.

29. The image display apparatus according to claim 26, wherein said amplitude adjustment means performs the amplitude adjustment function in such a manner that the output of said discrete adjusted image data calculation means is multiplied by gain for adjusting the amplitude, and the output of said adjusted image data interpolation means is limited by the maximum value so that the output of said adjusted image data interpolation means will fall within the input range of said modulation means.

30. The image display apparatus according to claim 26, wherein said modulation means performs modulation by varying the width of a voltage pulse waveform applied to each row of wiring in response to input into said modulation means.

31. The image display apparatus according to claim 30, wherein said image forming devices are surface conduction electron-emitting devices.

* * * * *

UNITED STATES PATENT AND TRADEMARK OFFICE

CERTIFICATE OF CORRECTION

PATENT NO. : 6,873,308 B2
DATED : March 29, 2005
INVENTOR(S) : Osamu Sagano et al.

It is certified that error appears in the above-identified patent and that said Letters Patent is hereby corrected as shown below:

Title page,
Item [57], ABSTRACT,
Line 12, “8 the” should read -- 8 that --.

Column 1,
Line 46, “20ninthe” should read -- 209. The --.

Column 3,
Line 40, “on” should read -- an --.

Column 8,
Line 15, “row is” should read -- row are --.

Column 9,
Line 9, “display,” should read -- displayed, --.

Column 10,
Line 26, “DV fourthat occurs” should read -- DV4 that occur --.
Line 50, “once” should read -- once it --.
Line 61, “an” should read -- a --.

Column 11,
Line 51, “12eighthe” should read -- 128 the --.
Line 52, “outputs H” should read -- outputs “H” --.
Line 53, “and L” should read -- and “L” --.

Column 12,
Line 54, “6fourthe” should read -- 64, the --.
Line 55, “12eighthe” should read -- 128, the --.

Column 13,
Line 15, “IF,” should read -- IE, --.
Line 66, “(Ie0+Ie0)” should read -- (Ie0+Ie1) --.

Column 15,
Line 48, “sift” should read -- shift --.

UNITED STATES PATENT AND TRADEMARK OFFICE

CERTIFICATE OF CORRECTION

PATENT NO. : 6,873,308 B2
DATED : March 29, 2005
INVENTOR(S) : Osamu Sagano et al.

It is certified that error appears in the above-identified patent and that said Letters Patent is hereby corrected as shown below:

Column 16,
Line 4, “circuit seventhe” should read -- circuit 7. The --.
Lines 22, 23 and 42, “sift” should read -- shift --.

Column 17,
Line 34, “Parallel-to-serial” should read -- parallel-to-serial --.

Column 18,
Line 1, “1twentiethe” should read -- 120, the --.

Column 19,
Line 14, “describes” should read -- describe --.
Line 65, “can” should read -- can be --.

Column 21,
Line 27, “GΔ” should read -- ΔG --.
Line 35, “≧0” should read -- >0 --.
Line 36, “fount” should read -- found --.
Line 66, “sift” should read -- shift --.

Column 22,
Lines 3 and 7, “sift” should read -- shift --.
Line 6, “circuit sixthe” should read -- circuit 6. The --.

Column 23,
Line 53, “1eleventhat” should read -- 111 that --.

Column 26,
Line 43, “sift” should read -- shift --.

Column 29,
Line 39, “Equation twenty-secondat” should read -- Equation 22 at --.
Line 46, “FIG. 2seventhe” should read -- FIG. 27, the --.

Column 30,
Line 21, “sift” should read -- shift --.
Line 25, “FIG. 2seventhe” should read -- FIG. 27, the --.
Line 52, “of” should read -- of a --.

UNITED STATES PATENT AND TRADEMARK OFFICE

CERTIFICATE OF CORRECTION

PATENT NO. : 6,873,308 B2
DATED : March 29, 2005
INVENTOR(S) : Osamu Sagano et al.

It is certified that error appears in the above-identified patent and that said Letters Patent is hereby corrected as shown below:

Column 34,
Line 47, “4sixth” should read -- 46, the --.
Line 58, “has” should read -- have --.
Line 66, “sift” should read -- shift --.

Column 35,
Line 63, “<1.3.” should read -- ≤ 1.3. --.

Column 36,
Line 36, “is” should read -- are --.
Line 60, “FIG. 3seventhat” should read -- FIG. 37 that --.

Column 37,
Line 48, “FIG. 3seventhat” should read -- FIG. 37 that --.

Column 38,
Line 19, “5fourthat” should read -- 54 that --.

Column 39,
Line 66, “the-horizontal” should read -- the horizontal --.

Figure 47:
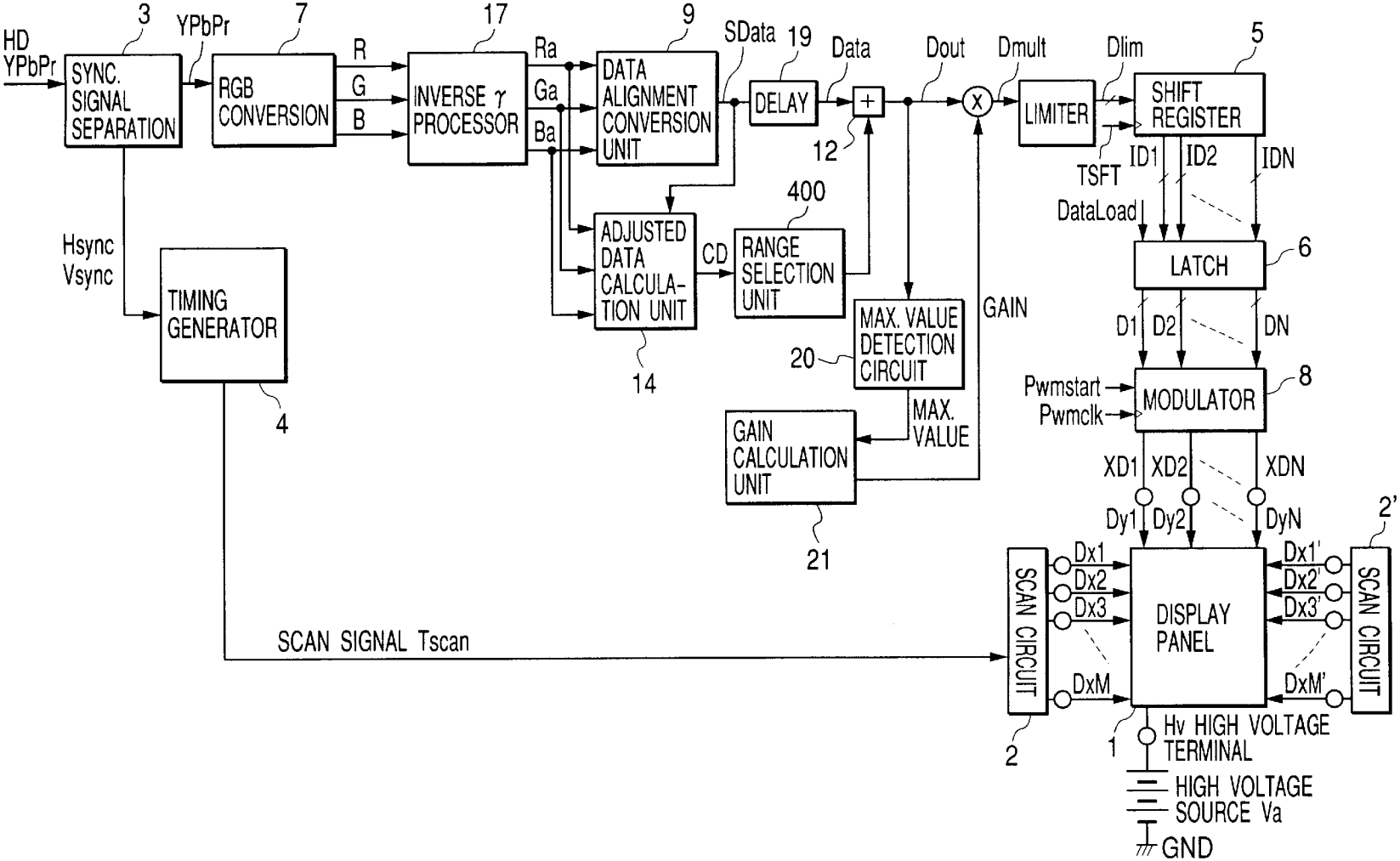
FIG. 47 is a block diagram showing a schematic configuration of an image display apparatus according to a twelfth embodiment of the present invention.

Column 40,
Line 25, “FIG. 4fourthat” should read -- FIG. 44 that --.
Line 31, “FIG. 4fifthe” should read -- FIG. 45, the --.
Line 54, “FIG. 4 sev-” should read -- FIG. 47, --.
Line 55, “enthis” should read -- this --.
Line 57, “FIG. 4seventhe” should read -- FIG. 47, the --.

Column 41,
Line 29, “also” should read -- also be --.
Line 51, “2fifthe” should read -- 25 the --.

Column 42,
Line 18, “one-frame.” should read -- one frame. --.

Column 43,
Line 66, “FIG. 5fifthe” should read -- FIG. 55, the --.

UNITED STATES PATENT AND TRADEMARK OFFICE

CERTIFICATE OF CORRECTION

PATENT NO. : 6,873,308 B2
DATED : March 29, 2005
INVENTOR(S) : Osamu Sagano et al.

It is certified that error appears in the above-identified patent and that said Letters Patent is hereby corrected as shown below:

Column 45,
Line 19, “25fifthe” should read -- 255, the --.

Column 48,
Line 66, “sift” should read -- shift --.

Column 49,
Line 18, “also” should read -- also be --.

Column 50,
Line 4, “varis” should read -- varies --.

Signed and Sealed this

Sixth Day of September, 2005

JON W. DUDAS
*Director of the United States Patent and Trademark Office*